US012161191B2

(12) United States Patent
Corcoran-Tadd et al.

(10) Patent No.: US 12,161,191 B2
(45) Date of Patent: Dec. 10, 2024

(54) ARTICLES OF FOOTWEAR COMPRISING A WOUND COMPONENT AND METHODS OF MAKING THE SAME

(71) Applicant: adidas AG, Herzogenaurach (DE)

(72) Inventors: Fionn Corcoran-Tadd, Portland, OR (US); Ian Hennebery, Portland, OR (US); Carl Arnese, Portland, OR (US); Matteo Padovani, Portland, OR (US); Benjamin Kleiman, Portland, OR (US); Andrea Nieto Perilla, Portland, OR (US); Fano Razafindrakoto, Portland, OR (US); Berin Skye B, Portland, OR (US); Jacques Perrault, Portland, OR (US)

(73) Assignee: adidas AG, Herzogenaurach (DE)

( * ) Notice: Subject to any disclaimer, the term of this patent is extended or adjusted under 35 U.S.C. 154(b) by 0 days.

(21) Appl. No.: 18/170,302

(22) Filed: Feb. 16, 2023

(65) Prior Publication Data

US 2023/0189930 A1 Jun. 22, 2023

Related U.S. Application Data

(63) Continuation of application No. 16/927,645, filed on Jul. 13, 2020, now Pat. No. 11,602,196.

(51) Int. Cl.
*A43B 23/00* (2006.01)
*A43B 23/02* (2006.01)

(52) U.S. Cl.
CPC ..... *A43B 23/0245* (2013.01)

(58) Field of Classification Search
CPC ..... A43B 23/026; A43B 23/0245; A43B 23/0265
See application file for complete search history.

(56) References Cited

U.S. PATENT DOCUMENTS 2,386,269 A 10/1945 Ryan
2,430,497 A 11/1947 Enright
3,296,490 A 1/1967 Price
(Continued)

FOREIGN PATENT DOCUMENTS

CN 102232671 A 11/2011
CN 102497792 A 6/2012
(Continued)

OTHER PUBLICATIONS http://modern-synthesis.com; retrieved Jul. 13, 2020.
(Continued)

*Primary Examiner* — Jeffry H Aftergut
(74) *Attorney, Agent, or Firm* — Sterne, Kessler, Goldstein & Fox P.L.L.C.

(57) ABSTRACT

Articles of footwear and methods of making articles of footwear including one or more continuous threads wound around anchor points. In some embodiments, thread lines of continuous thread(s) may extend tangential to an opening on a thread pattern or an upper. In some embodiments, thread lines of continuous thread(s) may define a portion of an upper and extend through a sole for an article of footwear. In some embodiments, thread patterns defined by the continuous thread(s) may be bonded to each other around a sheet to form an upper material for an upper.

24 Claims, 35 Drawing Sheets

(56) References Cited

U.S. PATENT DOCUMENTS

| | | | | |
|---|---|---|---|---|
| 4,556,440 | A * | 12/1985 | Krueger | D04H 3/04 156/181 |
| 4,677,831 | A * | 7/1987 | Wunner | D04H 3/045 66/196 |
| 4,724,612 | A | 2/1988 | Pearson | |
| 5,445,693 | A * | 8/1995 | Vane | D04H 3/153 428/113 |
| 5,706,590 | A | 1/1998 | Candela et al. | |
| 7,540,097 | B2 | 6/2009 | Greene et al. | |
| 7,703,220 | B2 | 4/2010 | Aveni | |
| 7,774,884 | B2 | 8/2010 | Greene et al. | |
| 8,056,173 | B2 | 11/2011 | Rongbo | |
| 8,065,818 | B2 | 11/2011 | Greene et al. | |
| 8,850,723 | B2 | 10/2014 | Greene et al. | |
| 8,906,275 | B2 | 12/2014 | Davis et al. | |
| 8,925,195 | B2 | 1/2015 | Schmidt et al. | |
| 9,227,363 | B2 | 1/2016 | Dua et al. | |
| 9,402,444 | B2 | 8/2016 | Dojan et al. | |
| 9,427,047 | B2 | 8/2016 | Dojan et al. | |
| 9,462,851 | B2 | 10/2016 | Baker et al. | |
| 9,675,134 | B2 | 6/2017 | Kosui et al. | |
| 9,681,708 | B2 | 6/2017 | Greene et al. | |
| 9,732,454 | B2 | 8/2017 | Davis et al. | |
| 10,194,714 | B2 | 2/2019 | Mcginnity et al. | |
| 10,619,280 | B2 | 4/2020 | Luedecke et al. | |
| 10,874,172 | B2 * | 12/2020 | Corcoran-Tadd | B32B 5/142 |
| 10,993,497 | B2 | 5/2021 | Gaba | |
| 2004/0118018 | A1 | 6/2004 | Dua | |
| 2007/0271822 | A1 | 11/2007 | Meschter | |
| 2010/0018075 | A1 | 1/2010 | Meschter et al. | |
| 2010/0251491 | A1 | 10/2010 | Dojan et al. | |
| 2010/0251564 | A1 | 10/2010 | Meschter | |
| 2012/0023786 | A1 | 2/2012 | Dojan | |
| 2012/0055044 | A1 | 3/2012 | Dojan et al. | |
| 2012/0233882 | A1 | 9/2012 | Huffa et al. | |
| 2013/0019500 | A1 | 1/2013 | Greene | |
| 2013/0025159 | A1 | 1/2013 | Dojan et al. | |
| 2013/0219636 | A1 | 8/2013 | Dojan et al. | |
| 2013/0219750 | A1 | 8/2013 | Dojan et al. | |
| 2013/0340283 | A1 | 12/2013 | Bell et al. | |
| 2014/0068968 | A1 | 3/2014 | Podhajny et al. | |
| 2014/0130372 | A1 | 5/2014 | Aveni et al. | |
| 2014/0173938 | A1 | 6/2014 | Beye et al. | |
| 2014/0237861 | A1 | 8/2014 | Podhajny | |
| 2014/0373389 | A1 | 12/2014 | Bruce | |
| 2015/0040428 | A1 | 2/2015 | Davis et al. | |
| 2015/0047225 | A1 | 2/2015 | Zavala et al. | |
| 2015/0059209 | A1 | 3/2015 | Dekovic et al. | |
| 2015/0164175 | A1 | 6/2015 | Katsuya | |
| 2015/0250256 | A1 | 9/2015 | Podhajny | |
| 2015/0272274 | A1 | 10/2015 | Berns et al. | |
| 2015/0359290 | A1 | 12/2015 | Podhajny et al. | |
| 2016/0058100 | A1 | 3/2016 | Dealey et al. | |
| 2016/0058121 | A1 | 3/2016 | Langvin et al. | |
| 2016/0088893 | A1 | 3/2016 | Meir | |
| 2016/0135543 | A1 | 5/2016 | Anceresi et al. | |
| 2016/0168774 | A1 | 6/2016 | Breithaupt et al. | |
| 2016/0192741 | A1 | 7/2016 | Mark | |
| 2016/0206044 | A1 | 7/2016 | Dimoff et al. | |
| 2017/0035149 | A1 | 2/2017 | Bruce et al. | |
| 2017/0202296 | A1 | 7/2017 | Fuerst, Jr. et al. | |
| 2017/0202309 | A1 | 7/2017 | Sterman et al. | |
| 2017/0245582 | A1 | 8/2017 | Green et al. | |
| 2017/0347754 | A1 | 12/2017 | Fuerst, Jr. et al. | |
| 2018/0110298 | A1 | 4/2018 | Schneider et al. | |
| 2018/0148861 | A1 | 5/2018 | Tarrier et al. | |
| 2018/0271216 | A1 | 9/2018 | La et al. | |
| 2019/0274392 | A1 | 9/2019 | Amis et al. | |
| 2019/0380425 | A1 | 12/2019 | Wood et al. | |
| 2020/0154816 | A1 | 5/2020 | Gaba | |
| 2020/0397090 | A1 | 12/2020 | Meir et al. | |
| 2021/0235807 | A1 | 8/2021 | Casillas et al. | |

FOREIGN PATENT DOCUMENTS

| | | | |
|---|---|---|---|
| CN | 204207163 | U | 3/2015 |
| CN | 105263351 | A | 1/2016 |
| CN | 107072353 | B | 7/2019 |
| EP | 3549470 | A1 | 10/2019 |
| EP | 3780985 | B1 | 9/2021 |
| JP | 11006005 | Y | 12/1936 |
| JP | 4939620 | B1 | 10/1974 |
| JP | 2015014058 | A | 1/2015 |
| JP | 2016524941 | A | 8/2016 |
| JP | 2017148422 | A | 8/2017 |
| WO | WO-9843506 | A1 | 10/1998 |
| WO | WO-2014/074966 | A3 * | 5/2014 |
| WO | WO-2014074928 | A1 | 5/2014 |
| WO | WO-2017115806 | A1 | 7/2017 |
| WO | WO-2017214199 | A1 | 12/2017 |

OTHER PUBLICATIONS

Martzer_, "2 hours to go!" Instagram.com, posted Jun. 27, 2017, https://www.instagram.com/p/BV1vc2KFXHq/.

Martzer_, "3d woven shoe" Instagram.com, posted Feb. 27, 2018, https://www.instagram.com/p/BftFi9siS4xl.

Martzer_, "Always experimenting! I wove some cotton thread on the last and stiffened it with latex. The outcome is interesting and promising for the future of my research. I shape the sole in hard foam!" Instagram.com, posted May 29, 2017, https://www.instagram.com/p/BUrTEigFmeX/.

Martzer_, "Experimenting with new material, and shapes! I am taking the opportunity here to thank you all for the upport and the likes!" Instagram.com, posted Sep. 25, 2017, https://www.instagram.com/p/BZd_qiSICKu/.

Martzer_, "I am back at it! This time it's to hopefully graduate from @design_academy_eindhoven I am continuing my dweaving and printing experiments from last semester and this is the first model! Stay posted if you want to follow the est of the process!" Instagram.com, posted Sep. 16, 2017, https://www.instagram.com/p/BZG217t1Rfu/.

Martzer_, "Small update on my research, this model is from two weeks ago. I'll be showing my final model on Tuesday or my last endterms before graduation! Stay posted . . . " Instagram.com, posted Jun. 22, 2017, https://www.instagram.com/p/BVpfr5pFVEf/.

Martzer_, "My outcome of the past two months! End terms are tomorrow, wish me luck! More photos of the project will come after tomorrow!" instagram.com, posted Jun. 26, 2017, https://www.instagram.com/p/BVzVqEiFw-a/.

Martzer_, "Off to graduation now! . . . " Instagram.com, posted Jun. 29, 2017, https://www.instagram.com/p/ BV7t3eSFolc/.

Martzer_, "Some close up shots of my graduation project "Shoelab" which you witnessed the process on my instram account throughout the past few month! Thank you all for the constant feedback and support! I hope you liked it!" instagram.com, posted Jan. 26, 2018, https://www.instagram.com/p/BeaOE5QIDIX/.

Martzer_, "The graduation period is coming to an end, one month left! Here is one of my latest experiments that I did a few weeks back! Also, any idea how to name this project? I'm struggling a bit haha" Instagram.com, posted Dec. 9, 2017, https://www.instagram.com/p/Bc43txTFS36.

Martzer_, "Two weeks before green light good to have a small overview of my progress so far" Instagram.com, posted Nov. 6, 2017, https://www.instagrams.com/p/BbJ1dpqleah/.

Martzer_, "Yesterday I graduated Cum Laude from @design_academy_eindhoven! One of my project being this 3D Woven shoe! More pictures to come!" Instagram.com, posted Jan. 24, 2018, https://www.instagram.com/p/ BeVw-21F26T/.

MAWS one—Martin Sallieres, Martzer, Jul. 12, 2017, https://vimeo.com/225224055.

* cited by examiner

ARTICLES OF FOOTWEAR COMPRISING A WOUND COMPONENT AND METHODS OF MAKING THE SAME

CROSS-REFERENCE TO RELATED APPLICATIONS

This application is a continuation of and claims priority to U.S. application Ser. No. 16/927,645, filed Jul. 13, 2020, which is incorporated herein by reference in its entirety.

FIELD

The described embodiments generally relate to articles of footwear and methods of making articles of footwear. In particular, described embodiments relate to articles of footwear with uppers including a component made by winding a continuous thread into a thread pattern.

BACKGROUND

Individuals are often concerned with the durability, weight, and/or comfort of an article of footwear. This is true for articles of footwear worn for non-performance activities, such as a leisurely stroll, and for performance activities, such as running. Durable footwear will properly function for an extended period of time. Lightweight footwear minimizes the weight an individual has to carry on his or her feet and may be comfortable for an individual. Customized footwear may increase comfort for an individual because it is tailored to the individual's foot anatomy.

For some individuals, for example athletes, stability and propulsion may be desired characteristics for an article of footwear. Footwear that facilitates propulsion (for example, forward and/or upward motion) may help an athlete perform at an optimal athletic level. Stability for footwear, and in particular stability in portions supporting the ankles of an individual, may reduce the chance of injury to the individual's feet.

Proper footwear should be durable, comfortable, and provide other beneficial characteristics for an individual. Therefore, a continuing need exists for innovations in footwear and components used to manufacture the footwear.

BRIEF SUMMARY

A first aspect (1) of the present application is directed to an upper for an article of footwear, the upper including an opening comprising a perimeter edge; a plurality of anchor points disposed around the perimeter edge; and a continuous thread wound around the plurality of anchor points, the continuous thread comprising a plurality of thread lines with each thread line extending between two respective anchor points and extending tangential to the perimeter edge of the opening.

In a second aspect (2), the plurality of thread lines extending tangential to the perimeter edge of the opening according to the first aspect (1) are not wound around an anchor point located at the perimeter edge of the opening.

In a third aspect (3), the opening according to the first aspect (1) or the second aspect (2) defines at least a portion of a collar for an article of footwear.

In a fourth aspect (4), the plurality of thread lines according to any one of aspects (1)-(3) comprise one or more thread lines located on the medial side of the perimeter edge and one or more thread lines located on the lateral side of the perimeter edge.

In a fifth aspect (5), the perimeter edge of the opening according to any one of aspects (1)-(4) is surrounded by a plurality of the plurality of thread lines.

In a sixth aspect (6), the plurality of thread lines according to any one of aspects (1)-(5) comprise: a first thread line, and a second thread line, where the first thread line and the second thread line overlap each other at an overlap point, and where the first thread line is disposed at an angle relative to the second thread line.

In a seventh aspect (7), an angle of intersection at the overlap point of the first thread line and the second thread line according to the sixth aspect (6) is greater than 90°.

In an eighth aspect (8), an angle of intersection at the overlap point of the first thread line and the second thread line according to the sixth aspect (6) is greater than 120°.

In a ninth aspect (9), the plurality of anchor points according to any one of aspects (1)-(8) comprise a forefoot anchor point and a rearfoot anchor point, and one of the plurality of thread lines extends from the forefoot anchor point to the rearfoot anchor point.

In a tenth aspect (10), the plurality of anchor points according to any one of aspects (1)-(9) comprise a medial side anchor point and a lateral side anchor point, and one of the plurality of thread lines extends from the medial side anchor point to the lateral side anchor point.

In an eleventh aspect (11), the plurality of thread lines according to any one of aspects (1)-(10) comprise 10 or more thread lines.

In a twelfth aspect (12), the plurality of thread lines according to any one of aspects (1)-(10) comprise 20 or more thread lines.

In a thirteenth aspect (13), the plurality of anchor points according to any one of aspects (1)-(12) comprise: a first rearfoot anchor point, a second rearfoot anchor point adjacent to the first rearfoot anchor point, a first forefoot anchor point, and a second forefoot anchor point, and the plurality of thread lines comprise: a first thread line extending from the first rearfoot anchor point to the first forefoot anchor point, and a second thread line extending from the second rearfoot anchor point to the second forefoot anchor point.

In a fourteenth aspect (14), the first thread line and the second thread line according to the thirteenth aspect (13) overlap each other at an overlap point.

In a fifteenth aspect (15), the first thread line and the second thread line according to the fourteenth aspect (14) are directly bonded to each other at the overlap point.

In a sixteenth aspect (16), the plurality of anchor points according to the thirteenth aspect (13) further comprise: a third rearfoot anchor point adjacent to the second rearfoot anchor point, and a third forefoot anchor point, and the plurality of thread lines further comprise a third thread line extending from the third rearfoot anchor point to the third forefoot anchor point.

In a seventeenth aspect (17), the plurality of anchor points according to any one of aspects (1)-(12) comprise a first rearfoot anchor point and five adjacent forefoot anchor points, where one of the plurality of thread lines extends from the rearfoot anchor point to a first one of the five adjacent forefoot anchor points, and where the continuous thread further comprises a plurality of non-opening-tangential thread lines that are not tangential to the perimeter edge of the opening, the non-opening-tangential thread lines comprising: a first non-opening-tangential thread line extending from the rearfoot anchor point to a second one of the five adjacent forefoot anchor points, a second non-opening-tangential thread line extending from the rearfoot anchor point to a third one of the five adjacent forefoot anchor points, a third non-opening-tangential thread line extending from the rearfoot anchor point to a fourth one of the five adjacent forefoot anchor points, and a fourth non-opening-tangential thread line extending from the rearfoot anchor point to a fifth one of the five adjacent forefoot anchor points.

In an eighteenth aspect (18), the plurality of anchor points according to the seventeenth aspect (17) comprise a second rearfoot anchor point adjacent to the first rearfoot anchor point, and wherein the continuous thread comprises a non-opening-tangential thread line extending from the second rearfoot anchor point to one of the five adjacent forefoot anchor points.

A nineteenth aspect (19) of the present application is directed to an upper for an article of footwear, the upper comprising: an opening comprising a perimeter edge; and a thread pattern defining at least a portion of the perimeter edge of the opening, the thread pattern comprising a first thread line extending tangential to the perimeter edge of the opening and a second thread line extending tangential to the perimeter edge of the opening, where the first thread line and the second thread line overlap each other at an overlap point, and where the first thread line and the second thread line are directly bonded to each other at the overlap point.

In a twentieth aspect (20), the first thread line and the second thread line according to the nineteenth aspect (19) are directly bonded to each other via a polymeric material of at least one of: the first thread line or the second thread line.

In a twenty-first aspect (21), an angle of intersection at the overlap point of the first thread line and the second thread line according to the nineteenth aspect (19) or the twentieth aspect (20) is greater than 90°.

In a twenty-second aspect (22), an angle of intersection at the overlap point of the first thread line and the second thread line according to the nineteenth aspect (19) or the twentieth aspect (20) is greater than 120°.

In a twenty-third aspect (23), the opening according to any one of aspects (19)-(22) defines at least a portion of a collar for an article of footwear.

In a twenty-fourth aspect (24), the upper according to any one of aspects (19)-(23) further comprises a third thread line extending tangential to the perimeter edge of the opening and a fourth thread line extending tangential to the perimeter edge of the opening, where the third thread line and the fourth thread line overlap each other at a second overlap point, and where the third thread line and the fourth thread line are directly bonded to each other at the second overlap point.

In a twenty-fifth aspect (25), the first and second thread lines according to the twenty-fourth aspect (24) extend tangential to a first side of the perimeter edge of the opening, and the third and fourth thread lines extend tangential to a second side of the perimeter edge of the opening.

In a twenty-sixth aspect (26), the upper according to the twenty-fifth aspect (25) is provided and the first side is a medial side of the perimeter edge and the second side is a lateral side of the perimeter edge.

A twenty-seventh aspect (27) of the present application is directed to an upper material for an article of footwear, the upper material comprising: an opening comprising a perimeter edge; a plurality of anchor points disposed around the perimeter edge; and a continuous thread wound around the plurality of anchor points, the continuous thread comprising a plurality of thread lines with each thread line extending between two respective anchor points and extending tangential to the perimeter edge of the opening.

In a twenty-eighth aspect (28), the plurality of thread lines extending tangential to the perimeter edge of the opening according to the twenty-seventh aspect (27) are not wound around an anchor point located at the perimeter edge of the opening.

In a twenty-ninth aspect (29), the opening according to the twenty-seventh aspect (27) or the twenty-eighth aspect (28) defines at least a portion of a collar for an article of footwear.

In a thirtieth aspect (30), plurality of thread lines according to any one of aspects (27)-(29) comprise one or more thread lines located on the medial side of the perimeter edge and one or more thread lines located on the lateral side of the perimeter edge.

In a thirty-first aspect (31), the perimeter edge of the opening according to any one of aspects (27)-(30) is surrounded by a plurality of the plurality of thread lines.

In a thirty-second aspect (32), the plurality of thread lines according to any one od aspects (27)-(31) comprise: a first thread line, and a second thread line, where the first thread line and the second thread line overlap each other at an overlap point, and where the first thread line is disposed at an angle relative to the second thread line.

In a thirty-third aspect (33), an angle of intersection at the overlap point of the first thread line and the second thread line according to the thirty-second aspect (32) is greater than 90°.

In a thirty-fourth aspect (34), an angle of intersection at the overlap point of the first thread line and the second thread line according to the thirty-second aspect (32) is greater than 120°.

In a thirty-fifth aspect (35), the plurality of anchor points according to any one of aspects (27)-(34) comprise a forefoot anchor point and a rearfoot anchor point, and one of the plurality of thread lines extends from the forefoot anchor point to the rearfoot anchor point.

In a thirty-sixth aspect (36), the plurality of anchor points according to any one of aspects (27)-(35) comprise a medial side anchor point and a lateral side anchor point, and one of the plurality of thread lines extends from the medial side anchor point to the lateral side anchor point.

In a thirty-seventh aspect (37), the plurality of thread lines according to any one of aspects (27)-(36) comprise 10 or more thread lines.

In a thirty-eighth aspect (38), the plurality of thread lines according to any one of aspects (27)-(36) comprise 20 or more thread lines.

In a thirty-ninth aspect (39), the plurality of anchor points according to any one of aspects (27)-(34) comprise: a first rearfoot anchor point, a second rearfoot anchor point adjacent to the first rearfoot anchor point, a first forefoot anchor point, and a second forefoot anchor point, and the plurality of thread lines comprise: a first thread line extending from the first rearfoot anchor point to the first forefoot anchor point, and a second thread line extending from the second rearfoot anchor point to the second forefoot anchor point.

In a fortieth aspect (40), the first thread line and the second thread line according to the thirty-ninth aspect (39) overlap each other at an overlap point.

In a forty-first aspect (41), the first thread line and the second thread line according to the fortieth aspect (40) are directly bonded to each other at the overlap point.

In a forty-second aspect (42), the plurality of anchor points according to the thirty-ninth aspect (39) further comprise: a third rearfoot anchor point adjacent to the second rearfoot anchor point, and a third forefoot anchor point, and the plurality of thread lines further comprise a third thread line extending from the third rearfoot anchor point to the third forefoot anchor point.

In a forty-third aspect (43), the plurality of anchor points according to any one of aspects (27)-(34) comprise a first rearfoot anchor point and five adjacent forefoot anchor points, where one of the plurality of thread lines extends from the rearfoot anchor point to a first one of the five adjacent forefoot anchor points, and where the continuous thread further comprises a plurality of non-opening-tangential thread lines that are not tangential to the perimeter edge of the opening, the non-opening-tangential thread lines comprising: a first non-opening-tangential thread line extending from the rearfoot anchor point to a second one of the five adjacent forefoot anchor points, a second non-opening-tangential thread line extending from the rearfoot anchor point to a third one of the five adjacent forefoot anchor points, a third non-opening-tangential thread line extending from the rearfoot anchor point to a fourth one of the five adjacent forefoot anchor points, and a fourth non-opening-tangential thread line extending from the rearfoot anchor point to a fifth one of the five adjacent forefoot anchor points.

In a forty-fourth aspect (44), the plurality of anchor points according to the forty-third aspect (43) comprise a second rearfoot anchor point adjacent to the first rearfoot anchor point, and the continuous thread comprises a non-opening-tangential thread line extending from the second rearfoot anchor point to one of the five adjacent forefoot anchor points.

A forty-fifth aspect (45) of the present application is directed to a method of making an upper for an article of footwear, the method comprising: defining a plurality of anchor points; defining a boundary line; winding a continuous thread around the plurality of anchor points, the continuous thread comprising a set of thread lines with each thread line in the set extending between two respective anchor points and tangential to the boundary line; and bonding the continuous thread at points of intersection between two or more the thread lines.

In a forty-sixth aspect (46), the boundary line according to the forty-fifth aspect (45) comprises a curved shape.

A forty-seventh aspect (47) of the present application is directed to a method of making an upper for an article of footwear, the method comprising: winding a first continuous thread around a plurality of anchor points disposed on a support plate to form a first thread pattern, the first continuous thread comprising a plurality of thread lines with each thread line extending between two respective anchor points; disposing a sheet over the first continuous thread wound around the plurality of anchor points; winding a second continuous thread over the sheet and around the plurality of anchor points disposed on the support plate to form a second thread pattern, the second continuous thread comprising a plurality of thread lines with each thread line extending between two respective anchor points; and bonding the first thread pattern to the second thread pattern to form an upper material.

In a forty-eighth aspect (48), the method according to the forty-seventh aspect (47) further comprises removing the sheet.

In a forty-ninth aspect (49), the method according to the forty-seventh aspect (47) or the forty-eighth aspect (48) further comprises turning the upper material inside-out.

In a fiftieth aspect (50), the first continuous thread and the second continuous thread according to any one of aspects (47)-(49) are portions of a single thread.

In a fifty-first aspect (51), the first continuous thread and the second continuous thread according to any one of aspects (47)-(49) comprise different threads.

In a fifty-second aspect (52), the sheet according to any one of aspects (47)-(51) comprises a polymeric material.

In a fifty-third aspect (53), the sheet according to any one of aspects (47)-(51) comprises a silicone material.

In a fifty-fourth aspect (54), bonding the first thread pattern to the second thread pattern according to any one of aspects (47)-(53) comprises bonding the first thread pattern to the second thread pattern around a perimeter of the sheet.

In a fifty-fifth aspect (55), bonding the first thread pattern to the second thread pattern according to any one of aspects (47)-(54) comprises directly bonding the first continuous thread to the second continuous thread.

In a fifty-sixth aspect (56), the method according to any one of aspects (47)-(55) further comprises cutting the first thread pattern and the second thread pattern around a perimeter of the sheet.

In a fifty-seventh aspect (57), the method according to any one of aspects (47)-(56) further comprises defining an opening in the upper material.

In a fifty-eighth aspect (58), the method according to the fifty-seventh aspect (57) further comprises removing the sheet through the opening.

In a fifty-ninth aspect (59), the opening according to the fifty-seventh aspect (57) or the fifty-eighth aspect (58) defines at least a portion of a collar for an article of footwear.

In a sixtieth aspect (60), the method according to any one of aspects (47)-(59) further comprises directly bonding the thread lines of the first thread pattern to each other and directly bonding the thread lines of the second pattern to each other.

In a sixty-first aspect (61), directly bonding the thread lines of the first thread pattern to each other and directly bonding the thread lines of the second thread pattern to each other according to the sixtieth aspect (60) is performed while the sheet is disposed between the first thread pattern and the second thread pattern.

In a sixty-second aspect (62), directly bonding the thread lines of the first thread pattern to each other and directly bonding the thread lines of the second thread pattern according to the sixtieth aspect (60) is performed while bonding the first thread pattern to the second thread pattern.

A sixty-third aspect (63) of the present application is directed to a method of making an upper for an article of footwear, the method comprising: winding a first continuous thread around a plurality of anchor points disposed on first a support plate to form a first thread pattern, the first continuous thread comprising a plurality of thread lines with each thread line extending between two respective anchor points; winding a second continuous thread around a plurality of anchor points disposed on a second support plate to form a second thread pattern, the second continuous thread comprising a plurality of thread lines with each thread line extending between two respective anchor points; disposing a sheet between the first thread pattern and the second thread pattern; bonding the first thread pattern to the second thread pattern while the sheet is disposed between the first thread pattern and the second thread pattern to form an upper material.

In a sixty-fourth aspect (64), the method according to the sixty-third aspect (63) further comprises removing the sheet.

In a sixty-fifth aspect (65), the method according to the sixty-third aspect (63) or sixty-fourth aspect (64) further comprises turning the upper material inside-out.

In a sixty-sixth aspect (66), the method according to any one of aspects (63)-(65) further comprises directly bonding the thread lines of the first thread pattern to each other and directly bonding the thread lines of the second thread pattern to each other.

A sixty-seventh aspect (67) of the present application is directed to an article of footwear including a sole; and an upper coupled to the sole, the upper comprising: a seam; a plurality of thread lines extending from a first side of the seam, through the sole, and to a second side of the seam.

In a sixty-eighth aspect (68), a portion of each of the plurality of thread lines that extend through the sole according to the sixty-seventh aspect (67) is embedded within the sole.

In a sixty-ninth aspect (69), the plurality of thread lines according to the sixty-seventh aspect (67) or the sixty-eighth aspect (68) are directly bonded to each other at points of intersection between two or more of the thread lines.

In a seventieth aspect (70), the plurality of thread lines according to any one of aspects (67)-(69) define a thread pattern, and wherein a first end of the thread pattern is directly coupled to a second end of the thread pattern at the seam.

In a seventy-first aspect (71), a portion of the first end of the thread pattern according to the seventieth aspect (70) overlaps a portion of the second end of the thread pattern at the seam.

In a seventy-second aspect (72) the plurality of thread lines according to the seventy-first aspect (71) extend from the first side of the seam, over a portion of a first side of the sole, through the sole, over a portion of a second side of the sole, and to the second side of the seam.

In a seventy-third aspect (73), the sole according to any one of aspects (67)-(72) is an injection-molded sole.

In a seventy-fourth aspect (74), the sole according to any one of aspects (67)-(73) comprises a top surface and bottom surface disposed opposite the top surface, and the plurality of thread lines comprise: a first plurality of thread lines extending through the sole at a first distance from the bottom surface of the sole, and a second plurality of thread lines extending through the sole at a second distance from the bottom surface of the sole, the second distance being different from the first distance.

In a seventy-fifth aspect (75), the second distance according to the seventy-fourth aspect (74) is 10% or more different from the first distance.

In a seventy-sixth aspect (76), the plurality of thread lines according to any one of aspects (67)-(75) define a first set of thread lines and the upper comprises a second set of thread lines extending from a first side of a second seam, through the sole, and to a second side of the second seam.

In a seventy-seventh aspect (77), the article of footwear according to the seventy-sixth aspect (76) is provided and the first set of thread lines is disposed in a forefoot portion of the article of footwear and the second set of thread lines is disposed in a heel portion of the article of footwear.

In a seventy-eighth aspect (78), the sole according to the seventy-seventh aspect (77) comprises a top surface and bottom surface disposed opposite the top surface, the first set of thread lines extends through the sole at a first distance from the bottom surface of the sole, the second set of thread lines extends through the sole at a second distance from the bottom surface of the sole, and the second distance is different from the first distance.

An seventy-ninth aspect (79) of the present application is directed to an article of footwear including a sole; and an upper coupled to the sole and comprising a plurality of thread lines defining a thread pattern, wherein the thread pattern comprises a plurality of thread lines that extend from a medial side of the upper, through the sole, and to a lateral side of the upper.

In an eightieth aspect (80), a portion of each of the plurality of thread lines that extend through the sole according to the seventy-ninth aspect (79) is embedded within the sole.

In an eighty-first aspect (81), a first side of the thread pattern according to the seventy-ninth aspect (79) or the eightieth aspect (80) is directly coupled a second side of the thread pattern at a seam.

An eighty-second aspect (82) of the present application is directed to a method of making an article of footwear, the method including defining a plurality of anchor points; winding a continuous thread around the plurality of anchor points to form a thread pattern, the continuous thread comprising a plurality of thread lines with each thread line extending between two respective anchor points; and molding a sole material on the thread pattern such that a least a portion of the thread pattern is embedded within the sole material.

In an eighty-third aspect (83), the method according to the eighty-second aspect (82) further comprises bonding the continuous thread at points of intersection between two or more of the thread lines.

In an eighty-fourth aspect (84), molding the sole material according to the eighty-second aspect (82) or the eighty-third aspect (83) comprises an injection molding process.

In an eighty-fifth aspect (85), the plurality of anchor points according to any one of aspects (82)-(84) are disposed on a mold for molding the sole material on the thread pattern.

In an eighty-sixth aspect (86), the plurality of anchor points according to the eighty-fifth aspect (85) comprise two anchor points separated from each other in a longitudinal direction, a transverse direction, and a vertical direction orthogonal to the longitudinal and transverse directions.

In an eighty-seventh aspect (87), the method according to any one of aspects (82)-(86) further comprises coupling a first side of the thread pattern to a second side of the thread pattern.

In an eighty-eighth aspect (88), coupling the first side of the thread pattern to the second side of the thread pattern according to the eighty-seventh aspect comprises directly coupling the first side to the second side at a seam.

BRIEF DESCRIPTION OF THE DRAWINGS/FIGURES

DETAILED DESCRIPTION

Figure 1A:
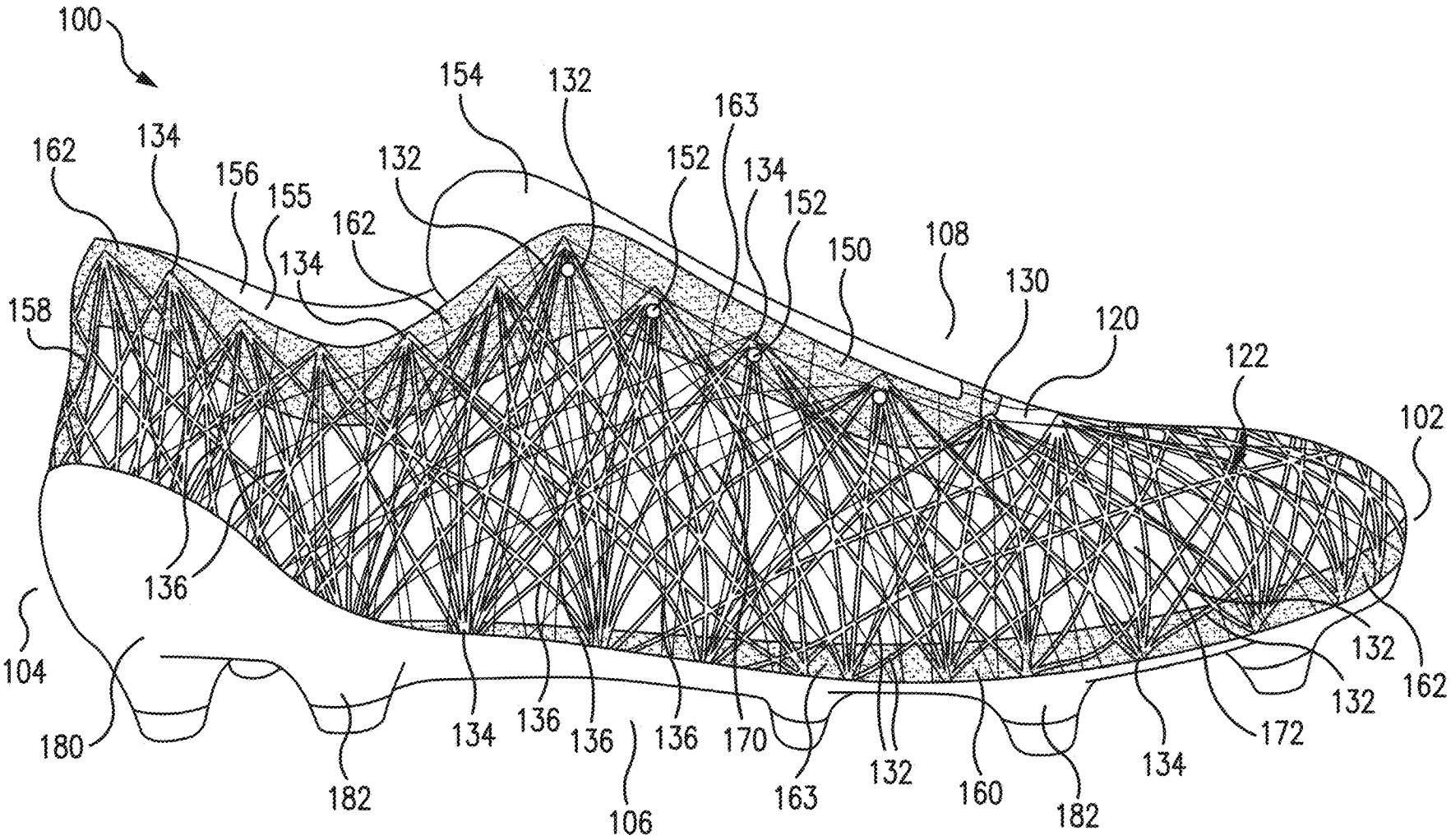
FIG. 1A shows an article of footwear according to some embodiments.

The present invention(s) will now be described in detail with reference to embodiments thereof as illustrated in the accompanying drawings. References to "some embodiments", "one embodiment", "an embodiment", "an exemplary embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

An article of footwear has many purposes. Among other things, an article of footwear may serve to provide cushioning for a wearer's foot, support a wearer's foot, and protect a wearer's foot. Each of these purposes, alone or in combination, provides for a comfortable article of footwear suitable for use in a variety of scenarios (for example, exercise and every day activities). The features of an article of footwear (for example, the materials and components used to make footwear, and the way these materials/components are assembled in a manufacturing process) may be altered to produce desired characteristics, for example, durability, support, weight, tackiness, texture, haptics, and/or breathability.

Durable footwear will properly function for an extended period of time and may instill a wearer's trust in a specific manufacturer's footwear, leading to repeat sales. Supportive footwear may protect an individual's feet from injury. For example, an article of footwear configured to provide ankle support may prevent injury to an individual's ankle by inhibiting undue twisting of the ankle. Lightweight footwear may be conformable for an individual, and for individuals competing in an athletic activity, such as running or biking, may provide a competitive edge due to the decreased weight the individual carries on his or her feet. Breathable footwear may increase comfort for an individual by wicking sweat and heat away from an individual's foot. Designing footwear having a high degree of one or more of these characteristics without detrimentally affecting other characteristics of the footwear may be desirable. Additionally, proper fitting footwear that adapts to the wearer's foot or is correctly shaped to the wearer's foot may provide a benefit in comfort and stability, particularly during changes of direction. The proper zoning of areas of support, flexibility, stiffness, and softness may also benefit the wearer by more accurately providing him or her desired characteristics of the footwear for different movements, or different parts of their foot.

Propulsion enabled by an article of footwear may optimize the performance of a wearer's foot by, for example, maximizing the energy transfer from the individual's foot to the surface his or her foot is in contact with (for example, the ground), via the article of footwear. Maximizing the energy transfer between the individual's foot and a surface (i.e., reducing energy lost via and/or absorbed by an article of footwear) may help an athlete, for example, accelerate faster, maintain a higher maximum speed, change directions faster, and jump higher. Designing footwear having a high degree of propulsion without detrimentally affecting other characteristics of the footwear may be desirable. Providing tackiness in specific areas on an upper may tailor an upper to an individual's liking. For example, some soccer players may like a soccer boot that is smooth for ease of dribbling while others may like high friction for control during hard strikes.

An article of footwear, or a portion thereof (for example, an upper), may be configured to provide various degrees of durability, support, weight, breathability, etc. But the cost of manufacturing the article of footwear may also be a consideration. Footwear, or a portion thereof, that may be manufactured at a relatively low cost may be desirable for manufacturers and consumers. Footwear that can be manufactured using a relatively small amount of resources (for example, energy and labor), materials, and time reduces manufacturing costs and may also reduce the environmental impact of manufacturing.

Further, a manufacturing process that facilitates the manufacture of customized footwear without increasing the complexity of the manufacturing process may be desirable. Customizing an article of footwear, or a portion thereof (for example, an upper), for a particular individual or a group of individuals having similar foot anatomies (for example, foot size and shape) may provide proper support and increased comfort for an individual. Also, it may allow an individual to order/buy articles of footwear customized to his or her needs. Moreover, it may allow the individual to order/buy new and/or replacement articles of footwear customized to his or her needs when desired.

The articles of footwear discussed herein include a component, for example an upper or a sole, made by winding one or more continuous threads into a desired thread pattern. In some embodiments, the continuous thread(s) may be wound around and between fixed anchor points. In some embodiments, the continuous thread(s) may be wound around and between moveable anchor points. Winding the continuous thread(s) around the anchor points includes wrapping a continuous thread around a first anchor point, extending that continuous thread to a second anchor point, wrapping that continuous thread around the second anchor point, and so on. The number and position of the anchor points may be utilized to control characteristics of the thread pattern, and therefore the article of footwear component. Also, the number of times a continuous thread is wound from anchor point to anchor point may be utilized to control characteristics of the thread pattern, and therefore the article of footwear component.

Continuous thread(s) of a thread pattern may be bonded within the thread pattern. The bonding of continuous thread(s) of a thread pattern may consolidate the thread pattern and fix thread lines in a wound pattern. In some embodiments, bonding continuous thread(s) of a thread pattern may be utilized to control characteristics of the thread pattern. In some embodiments, a continuous thread may be bonded to itself within a thread pattern. In some embodiments, a continuous thread may be bonded to itself at one or more anchor points of a thread pattern. In some embodiments, a continuous thread may be bonded to itself at points of overlap between different thread lines of the continuous thread (i.e., at thread line intersection points). In some embodiments, different continuous threads of a thread pattern may be bonded together. In some embodiments, different continuous threads may be bonded to each other at one or more anchor points of a thread pattern. In some embodiments, different continuous threads may be bonded to each other at points of overlap between the different continuous threads (i.e., at intersection points between the different continuous threads). The bonding of continuous thread(s) may fix the continuous thread(s) in tension as the thread(s) are wound around anchor points in tension. The bonding of thread(s) in tension allows a thread pattern to contract once removed from anchor points used to wind the thread pattern, which may be utilized to control characteristics of the thread pattern.

In some embodiments, a plurality of different continuous threads may be wound around anchor points to form a thread pattern. In some embodiments, different continuous threads may be wound in the same configuration (i.e., around the same anchor points and along the same paths). In some embodiments, different continuous threads may be wound in different configurations (i.e., around one or more different anchor points and/or along different paths between one or more anchor points). Different continuous threads may define different wound layers for a footwear component. And these different layers may provide different characteristics for a thread pattern, and therefore the footwear component.

Continuous thread(s) may be wound around anchor points in various configurations to provide varying degrees of characteristics for an article of footwear component. The number of anchor points, the position of the anchor points, and/or the way continuous threads are wound around the anchor points may be utilized to produce a footwear component having desired characteristics, such as strength, support, propulsion, breathability, comfort, tackiness, abrasion resistance, fit, texture, haptics, and durability. Characteristics of a footwear component can be varied by changing the arrangement of anchor points and/or the way continuous thread(s) are wound around the anchor points. Characteristics can also be varied by altering the material of continuous thread(s).

In some embodiments, when winding continuous threads for an upper, the anchor points may be peripheral anchor points arranged in positions corresponding to a perimeter of an upper, or a portion of an upper, for an article of footwear. Winding a continuous thread around and between the peripheral anchor points may define the perimeter shape of the upper, or portion of an upper. The way continuous thread(s) are wound between respective peripheral anchor points (i.e., the winding path for the continuous thread(s)) can be leveraged to produce an upper having desired characteristics.

In some embodiments, winding one or more continuous threads for an upper may include winding one or more threads such that thread lines are positioned tangential to a feature of the upper. The feature may be, for example, an opening, an edge, an insert in the upper, or a functional zone of the upper. Threading thread lines tangential to a feature may define a perimeter boundary of the feature. By threading thread lines tangential to a feature, characteristics of an upper at the feature may be tailored as described herein. Threading thread lines tangential to a feature may result in a relatively high density of thread lines at and around the feature. A high density of thread lines may provide an upper with desired characteristics at and around the feature.

In some embodiments, threading thread lines tangential to a feature may also include threading thread lines such that a relatively high density of thread lines are located near a perimeter of the feature. By threading a high density of thread lines nearly tangential to a feature, characteristics of a thread pattern near the feature can be controlled.

In some embodiments, a plurality of thread patterns may be bonded together in a process for forming an upper material that surrounds all or a portion of a wearer's foot during use. The upper material that surrounds all or a portion of a wearer's foot during use may include a portion that extends across and wraps around at least a portion of the bottom of a wearer's foot. In some embodiments, bonding a plurality of thread patterns together may create an upper material having a void configured to receive all or a portion of a wearer's foot. In some embodiments, the process for forming an upper material may include bonding a medial thread pattern to a lateral thread pattern.

In some embodiments, a plurality of thread patterns may be bonded together at a seam and flipped inside-out to form an upper material that surrounds all or a portion of a wearer's foot during use. In some embodiments, the plurality of thread patterns may be bonded to each other about a temporary substrate that is removed after bonding the thread patterns to each other. The temporary substrate may be a sheet that resists bonding to the thread patterns while forming an upper material.

In some embodiments, winding continuous thread(s) for an upper may include forming a thread pattern with a portion incorporated into a sole for an article of footwear. In some embodiments, winding continuous thread(s) for an upper may include forming a thread pattern with a portion that defines a portion of a sole for an article of footwear. In some embodiments, a thread pattern defining a portion of an upper may wrap around a portion of a sole. In some embodiments, a thread pattern defining a portion of an upper may be embedded within a sole.

Figure 1B:
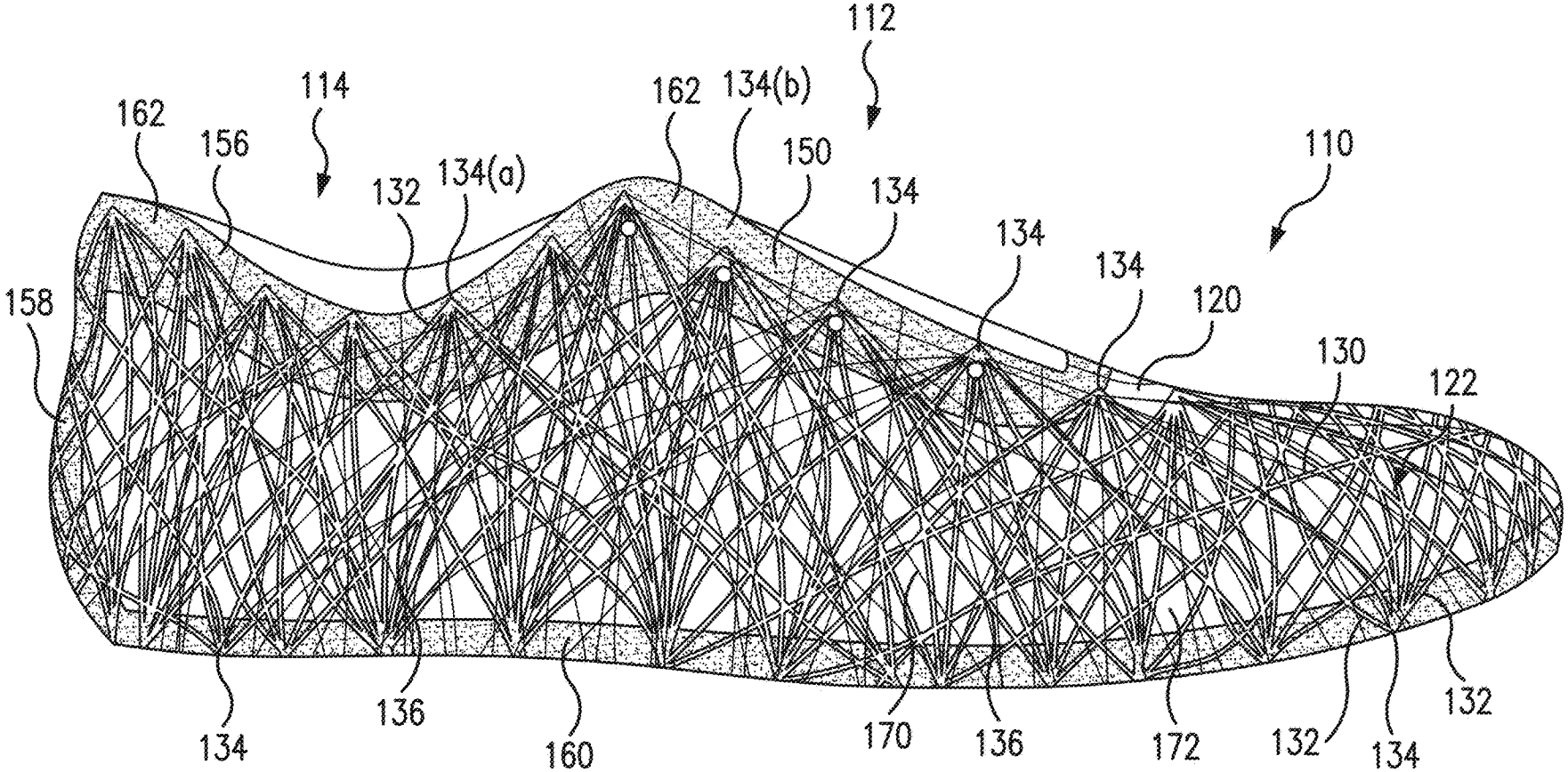
FIG. 1B shows the upper of FIG. 1A.

FIGS. 1A and 1B show an article of footwear 100 and upper 120 according to some embodiments. Article of footwear 100 may include upper 120 coupled to a sole 180. Article of footwear 100 and upper 120, include a forefoot end 102, a heel end 104, a medial side 106, and a lateral side 108 opposite medial side 106. As illustrated in FIG. 1*i*, upper 120 includes a forefoot portion 110, a midfoot portion 112, and a heel portion 114. Portions 110, 112, and 114 are not intended to demarcate precise areas of upper 120. Rather, portions 110, 112, and 114 are intended to represent general areas of upper 120 that provide a frame of reference. Although portions 110, 112, and 114 are illustrated in connection with upper 120 in FIG. 1B, references to portions 110, 112, and 114 also may apply specifically to article of footwear 100 or sole 180, or individual components of article of footwear 100 or sole 180.

Upper 120 may be formed of one or more components that are stitched, bonded, or otherwise joined together to form a structure for receiving and securing a foot relative to sole 180. And upper 120 includes a least a portion defined by a thread pattern 122. Thread pattern 122 is made by winding one or more continuous threads into a thread pattern as discussed herein. Thread pattern 122 is not a knitted or woven pattern. Thread pattern 122 may be referred to as a thread network of adjacent and overlapping thread lines.

In some embodiments, thread pattern 122 may include a network of individual thread lines that form a substantially continuous material with minimal void space between thread lines. As used herein, "void space" means an opening extending through a thread pattern between thread lines of the thread pattern. In some embodiments, the substantially continuous material may have a ratio (V:T) of void space (V) to thread material (T) of at least 1:1 measured across all or a portion of an outer surface of a thread pattern. In some embodiments, the ratio of void space to thread material may be at least 1:1, 1:2, 1:2.5, 1:3, 1:4, 1:5, 1:6, 1:7, 1:8, 1:9, 1:10, 1:20, 1:50, or 1:100. In some embodiments, a thread pattern may include a network of thread lines that form a continuous material with no void space between thread lines. A ratio of void space to thread material may be measured for a thread pattern before or after bonding of thread lines. In some embodiments, bonding of thread lines may serve to reduce the amount of void space of a thread pattern. For example, thermally bonding thread lines via a polymer material of the thread lines may reduce the amount of void space by filling in void space with thermally melted polymer material. In some embodiments, melted polymer material(s) of a thread pattern may fill void spaces between thread lines to form a continuous material without void space between thread lines.

Thread pattern 122 may wrap around all or a portion of the sides, the top, and/or the heel of a wearer's foot. In some embodiments, thread pattern 122 may wrap around at least a portion of the bottom surface (i.e., the sole) of a wearer's foot when worn. For example, an upper with thread pattern 122 may wrap the bottom surface of a wearer's foot when worn. As another example, thread pattern 122 may wrap around the bottom surface of a wearer's foot by wrapping around a sole for an article of footwear. As another example, thread pattern 122 may wrap around the bottom surface of a wearer's foot by extending through a sole for an article of footwear (see for example, FIGS. 13 and 14).

Upper 120 may extend along the lateral side of the foot, along the medial side of the foot, over the foot, around a heel of the foot, and/or under the foot when worn. Upper 120 defines a void 155, which is a generally hollow area having the general shape of a foot and is configured to receive the foot. An opening of void 155 may be defined in whole or in part by a collar 156 located in at least heel portion 114 of upper 120.

In some embodiments, collar 156 may be a separate piece attached to the reminder of upper 120 via, for example, stitching and/or an adhesive. In some embodiments, collar 156 may be attached to thread pattern 122 at a seam. In some embodiments, collar 156 may be a separate piece of material defined in whole or in part by a wound thread pattern as described herein. In some embodiments, collar 156 may be an integral component of thread pattern 122. In other words, collar 156 may be formed in the same manner as thread pattern 122 (for example, via a winding process as discussed herein).

In addition, upper 120 may include a throat area 150 extending from collar 156 towards forefoot portion 110 of upper 120. Throat area 150 extends over a dorsal area of a wearer's foot that corresponds generally to the location of a wearer's cuneiform and metatarsal bones. In some embodiments, throat area 150 may define a portion of the opening of void 155 to assist a wearer in inserting and removing his or her foot from void 155. In some embodiments, throat area 150 may define an opening for a tongue 154 that extends between lateral and medial perimeter sides of throat area 150 and moveably opens and closes a portion of void 155 to enhance the adjustability of footwear 100. In some embodiments, throat area 150 may be a "tongue-less" throat area 150.

In some embodiments, throat area 150 may be a separate piece attached to the reminder of upper 120 via, for example, stitching and/or an adhesive. In some embodiments, throat area 150 may be attached to thread pattern 122 at a seam. In some embodiments, throat area 150 may be a separate piece of material defined in whole or in part by a wound thread pattern as described herein. In some embodiments, throat area 150 may be an integral component of thread pattern 122. In other words, throat area 150 may be formed in the same manner as thread pattern 122 (for example, via a winding process as discussed herein).

Upper 120 may also include one or more eyelets 152 formed in a perimeter portion of throat area 150 for securing and tensioning a shoelace. In some embodiments, eyelets 152 may be integrally formed during formation of upper 120. In some embodiments, eyelets 152 may be separate components coupled to upper 120 via, for example, stitching or an adhesive. A shoelace may extend through the eyelets 152 and permits a wearer to adjust dimensions of upper 120 to accommodate his or her foot. More particularly, the shoelace may allow a wearer to tighten or loosen upper 120 around his or her foot. In addition to or alternative to eyelets 152, upper 120 may include other lace-receiving elements, such as loops or hooks.

In some embodiments, upper 120 may include a heel counter 158. Heel counter 158 provides cushioning, support, and/or protection for a wearer's heel and/or Achilles tendon. In some embodiments, heel counter 158 may be a separate piece attached to the reminder of upper 120 via, for example, stitching and/or an adhesive. In some embodiments, heel counter 158 may be a separate piece of material defined in whole or in part by a wound thread pattern as described herein. In some embodiments, heel counter 158 may be attached to thread pattern 122 at a seam. In some embodiments, heel counter 158 may be an integral component of thread pattern 122. In other words, heel counter 158 may be formed in the same manner as thread pattern (for example, via a winding process as discussed herein).

With reference to FIG. 1A, for example, upper 120 is coupled to sole 180 at a biteline 160 (i.e., a sole connection area). Together, biteline 160, collar 156, heel counter 158, and a perimeter portion of throat area 150 may define a perimeter portion 162 of upper 120. Perimeter portion 162 may include an outer edge defined by biteline 160 and an inner edge defined by collar 156 and a perimeter of throat area 150. Perimeter portion 162 may define a frame having a shape corresponding to at least a portion of a perimeter shape of upper 120. Portions of upper 120 within perimeter portion 162 include the quarter panels, vamp portion, and toe box portion of upper 120. Thread pattern 122 may define all or a portion of perimeter portion 162 and/or any portion of upper 120 within perimeter portion 162 of upper.

In some embodiments, all or part of perimeter portion 162 may include one or more seams 163 for attaching thread pattern 122, or any other thread pattern described herein, to other footwear components. At seam(s) 163, thread pattern 122 may be attached to another footwear component, such as but not limited to, a sole, a collar element, a heel counter, or a throat element.

As used herein, a "seam" is any attachment region between two components. Exemplary attachment regions include, but are not limited to, stitched attachment regions, adhesive attachment regions, thermally bonded attachment regions, and interlocking attachments. Exemplary seam structures include, but are not limited to, a self-attaching seam, a hem, a butt stich, a Merrow stitch (tight overlock stitch), a gathered edge, a surge stitch, an overlock stitch, and an interlocking seam construction. In some embodiments, a "seam" may include a region where two attached components overlap. For example, a seam can be a region where a first component overlaps and is bonded to a second component.

Seam(s) 163 may include one or more mechanical attachments, including but not limited to direct bonding attachments, adhesive attachments, interlocking mechanical attachments, and/or stitched attachments. Exemplary stitches for use in a seam construction for seam 163 include, but are not limited to, a Merrow stitch (tight overlock stitch), a gathered edge, a surge stitch, or an overlock stitch.

In some embodiments, thread pattern 122, or any other thread pattern described herein, may be folded at seam 163 to and attached to another footwear component. In some embodiments, a seam 163 may include bonding tape.

In some embodiments, folding a thread pattern at a seam 163 may serve to provide a suitable surface for attaching another footwear component. In some embodiments, folding a thread pattern at a seam 163 may serve to conceal anchor points of a thread pattern within the seam 163.

Figure 13:
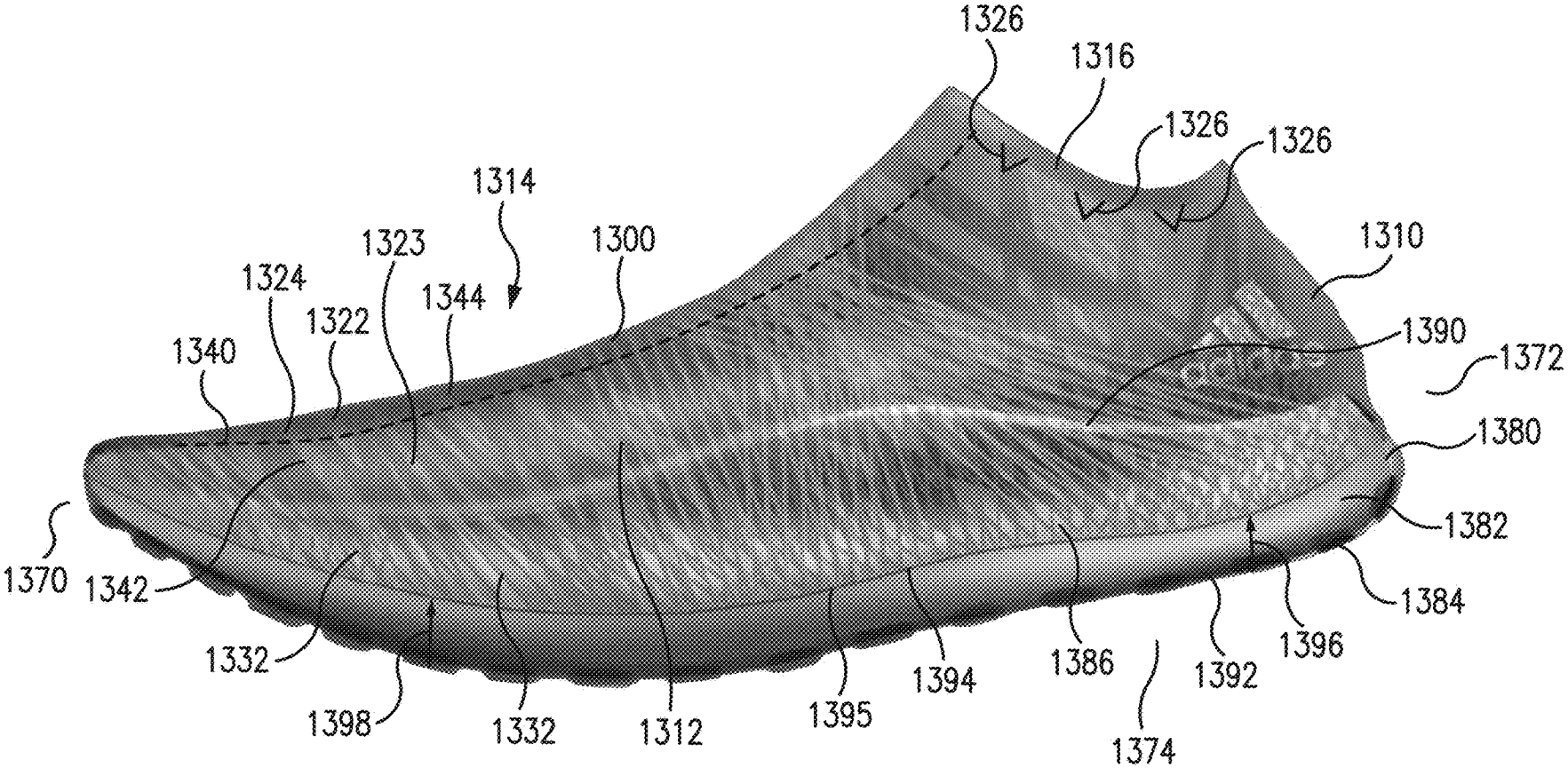
FIG. 13 shows an article of footwear according to some embodiments.

In some embodiments, thread pattern 122, or any other thread pattern described herein, may include cutouts located in or adjacent a seam 163. For example, FIG. 13 illustrates thread pattern 1322 with a plurality of cutouts 1326 located adjacent a collar seam 1316. Cutouts 1326 may be voids in a thread pattern for providing flexibility to the thread pattern at a seam. By providing flexibility at a seam, cutouts 1326 may provide comfort for a wearer. In some embodiments, cutouts 1326 may be concealed within a seam. In some embodiments, all or a portion of cutouts 1326 may extend from a seam.

In some embodiments, a seam 163 may include one or more interlocking features that serve to provide a mechanical attachment between a thread pattern and another footwear component, such as but not limited to, a sole, a collar element, a heel counter, or a throat element. In such embodiments, a thread pattern may include one or more first interlocking features and the footwear component may include one or more second interlocking features. In some embodiments, a thread pattern may include an interlocking female component (for example, an opening or slit) and the footwear component may include a male interlocking component (for example, a tab, loop, or hook). In some embodiments, a thread pattern may include an interlocking male component (for example, a tab, loop, a strap, or hook) and the footwear component may include a female interlocking component (for example, an opening or slit).

Figure 27A:
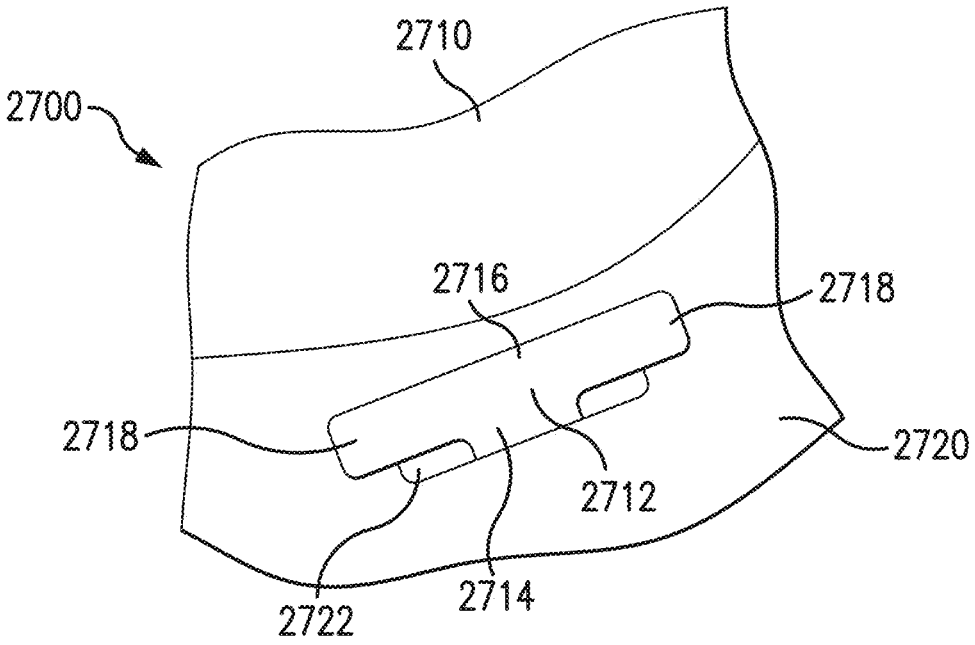
FIGS. 27A and 27B show interlocking seam structures according to some embodiments.

FIG. 27A illustrates an exemplary interlocking seam structure 2700 for a seam 163. Interlocking seam structure 2700 includes a footwear component 2710 and thread pattern 2720. Footwear component 2710 may be, for example, a sole, a collar element, a heel counter, or a throat element. Thread pattern 2720 may be any thread pattern described herein.

For interlocking seam structure 2700, footwear component 2710 includes a tab 2712 inserted through an opening 2722 in thread pattern 2720. Tab 2712 may include a base 2714 directly connected to a portion of footwear component 2710 and a free end 2716 opposite base 2714 and configured to be inserted through opening 2722. Free end 2716 of tab 2712 may include one or more flanges 2718. Free end 2716 with flange(s) 2718 may have a length greater than the length of opening 2722 to provide an interlocking mechanical attachment between footwear component 2710 and thread pattern 2720 when tab 2712 is inserted through opening 2722.

Figure 27B:
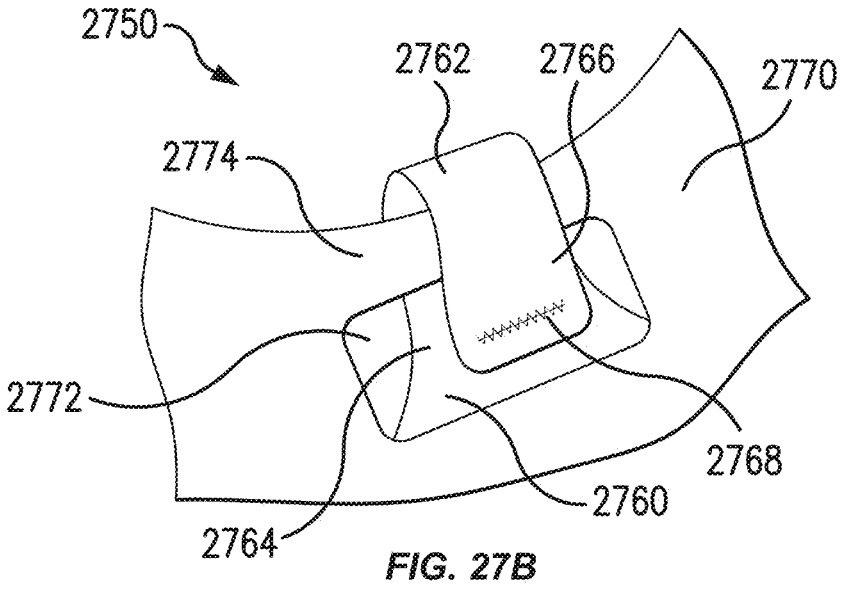

FIG. 27B illustrates another exemplary interlocking seam structure 2750 for a seam 163. Interlocking seam structure 2750 includes a footwear component 2760 and thread pattern 2770. Footwear component 2760 may be, for example, a sole, a collar element, a heel counter, or a throat element. Thread pattern 2770 may be any thread pattern described herein.

For interlocking seam structure 2750, footwear component 2760 includes a strap 2762 inserted through an opening 2772 in thread pattern 2770. Strap 2762 may include a base 2764 directly connected to a portion of footwear component 2760 and a free end 2766 opposite base 2764. Strap 2762 may wrap around an edge portion 2774 of thread pattern 2770 adjacent opening 2772 and attach to itself at opening 2722. In particular, free end 2766 of strap 2762 may attach to base 2764 of strap 2762 at an attachment point 2768 located within opening 2772. The attachment at attachment point 2768 may be, for example, a stitched attachment and/or an adhesive attachment.

In some embodiments, upper 120 may include a fabric layer 172 disposed on the outer surface and/or the inner surface of thread pattern 122. As used herein, the term "outer surface" or "outer side" refers to the surface of a component that faces away from the foot when worn by a wearer. And "inner surface" or "inner side" refers to the surface of a component that faces toward the foot when worn by a wearer.

In some embodiments, fabric layer 172 may be a woven, non-woven, or knitted polymeric layer. In some embodiments, fabric layer 172 may be a woven, non-woven, or layer composed of thermoplastic polyurethane (TPU), polyester, polyamide, polyethylene (PE), PE foam, polyurethane (PU) foam, and co-polymers or polymer blends including one or more these polymers. In some embodiments, fabric layer 172 may be a bioengineered woven, knitted or layered synthetic spider silk, woven, knitted or layered plant based materials, or woven, knit or layered recycled and/or extruded plastics. In some embodiments, fabric layer 172 may be film or sheet of a polymeric material, such as thermoplastic polyurethane (TPU), polyester, polyamide, polyethylene (PE), PE foam, polyurethane (PU) foam, and co-polymers or polymer blends including one or more these polymers. In some embodiments, fabric layer 172 may include a plurality of layers stacked vertically and/or arranged side-by-side. In some embodiments, the plurality of layers may be laminated. In some embodiments, fabric layer 172 may be a woven, non-woven, or knitted layer for providing cushion and/or thermal insulation for article of footwear 100. In some embodiments, fabric layer 172 may be a sock bootie. In some embodiments, fabric layer 172 may be sheet 1220. In some embodiments, fabric layer 172 may be a discontinuous layer formed of individual spaced-apart fabric elements, like padding elements 2220.

Upper 120 and sole 180 may be configured for a specific type of footwear, including, but not limited to, a running shoe, a hiking shoe, a water shoe, a training shoe, a fitness shoe, a dancing shoe, a biking shoe, a tennis shoe, a cleat (for example, a baseball cleat, a soccer cleat, or a football cleat), a basketball shoe, a boot, a walking shoe, a casual shoe, or a dress shoe. Moreover, sole 180 may be sized and shaped to provide a desired combination of cushioning, stability, and ride characteristics to article of footwear 100. The term "ride" may be used herein in describing some embodiments as an indication of the sense of smoothness or flow occurring during a gait cycle including heel strike, midfoot stance, toe off, and the transitions between these stages. In some embodiments, sole 180 may provide particular ride features including, but not limited to, appropriate control of pronation and supination, support of natural movement, support of unconstrained or less constrained movement, appropriate management of rates of change and transition, and combinations thereof.

In some embodiments, sole 180 may include traction elements, such as cleats 182 or tread. In some embodiments, sole 180 may include a midsole. In some embodiments, sole 180 may include an outsole coupled to a midsole. For example, in reference to FIG. 13, sole 180 may be sole including midsole 1382 and outsole 1384. Sole 180 and portions thereof (for example, midsole 1382 and outsole 1384) may comprise material(s) for providing desired cushioning, ride, and stability. Suitable materials for sole 180 (midsole 1382 and/or outsole 1384) include, but are not limited to, a foam, a rubber, ethyl vinyl acetate (EVA), expanded thermoplastic polyurethane (eTPU), expandable polyether block amide (ePEBA), thermoplastic rubber (TPR) and a thermoplastic polyurethane (TPU). In some embodiments, the foam may comprise, for example, an EVA-based foam or a PU-based foam and the foam may be an open-cell foam or a closed-cell foam. In some embodiments, midsole 1382 and/or outsole 1384 may comprise elastomers, thermoplastic elastomers (TPE), foam-like plastics, and gel-like plastics.

In some embodiments, portions of sole 180 (for example, midsole 1382 and outsole 1384) may comprise different materials to provide different characteristics to different portions of sole 180. In some embodiments, midsole 1382 and outsole 1384 may have different hardness characteristics. In some embodiments, the material density of midsole 1382 and outsole 1384 may be different. In some embodiments, the elastic moduli of the materials used to make midsole 1382 and outsole 1384 may be different. As a non-limiting example, the material of outsole 1384 may have a higher modulus than the material of midsole 1382.

Sole 180 and portions thereof (for example, midsole 1382 and outsole 1384) may be formed using suitable techniques, including, but not limited to, injection molding, blow molding, compression molding, and rotational molding. In some embodiments, midsole 1382 and outsole 1384 may be discrete components that are formed separately and attached. In some embodiments, midsole 1382 may be attached to outsole 1384 via, for example, but not limited to, adhesive bonding, stitching, welding, or a combination thereof. In some embodiments, midsole 1382 may be attached to outsole 1384 via an adhesive disposed between midsole 1382 and outsole 1384.

As shown in FIGS. 1A and 1, upper 120 includes thread pattern 122. All or a portion of upper 120 may include thread pattern 122. In some embodiments, thread pattern 122 may be a single thread structure defining at least a portion of upper 120. In some embodiments, thread pattern 122 may include a plurality of thread structures coupled together to define at least a portion of upper 120.

In some embodiments, thread pattern 122 may include a plurality of anchor points 134 and a continuous thread 130 fixed at a plurality of anchor points 134. In some embodiments, anchor points 134 may be disposed along a perimeter of upper 120 (for example, in perimeter portion 162). Such anchor points 134 may be referred to as "peripheral anchor points."

As used herein, "thread" means a material having a length that is substantially larger than its width. A "thread" may be a filament, a fiber, a yarn, a knitted element, a cable, a cord, a fiber tow, a tape, a ribbon, a monofilament, a braid, a string, a plied thread, and other forms of materials which can be spooled and laid down in a thread pattern as described herein.

As used herein, "anchor point" means a location to which a thread or group of thread lines is fixedly attached. A thread or thread line may be wrapped, wound, bonded, or otherwise attached at an anchor point. An anchor point may be a location on an upper (for example, anchor points 134). For example, an anchor point may be a hole or opening left behind by a structure (for example, pin, projection, or nub) used to wind continuous thread(s) of a thread pattern. In some embodiments, a thread pattern for an upper may not include any anchor point locations because all the anchor point locations present during winding of the thread pattern have been removed (for example, cut off the thread pattern). An anchor point may also be a structure (for example, pin, projection, or nub) used to wind continuous thread(s) of a thread pattern. And the anchor point structure may or may not form a portion of a thread pattern for an upper. For example, a thread pattern for an upper may be removed from anchor points defined by metal pins, but anchor points defined by pins composed of a meltable material may be present in a thread pattern for an upper (after being melted and re-solidified).

Continuous thread 130 may be wrapped around a plurality of anchor points 134 and includes a plurality of thread lines 132. Each thread line 132 extends between two respective anchor points 134. Continuous thread(s) 130 may be wrapped around a plurality of anchor points 134 in tension such that individual thread lines 132 are in tension when wrapped around anchor points 134. In some embodiments, different continuous threads 130 and/or thread lines 132 may be wrapped around anchor points 134 at different tensions to impart desired characteristics to thread pattern 122. By winding continuous(s) threads 130 in tension, thread pattern 122 may be bonded while thread lines 132 are under tension such that thread lines 132 are in tension in a bonded thread pattern 122. Bonding thread lines 132 while thread lines 132 are under tension fixes the thread lines 132 in tension within thread pattern 122. Fixing thread lines 132 in tension will result in thread lines 132 wanting to contract when removed from anchor points used to wind thread pattern 122. In cases where a portion of a thread line 132 is not bonded in a fully fixed position, the thread line 132 may contract when removed anchor points. In such embodiments, the portion(s) of the thread line 132 that is/are fixed during a bonding process will be under tension while the other portion(s) will be free to contract, and thus will not be under tension in thread pattern 122.

In embodiments where different thread lines 132 were wound at different tensions, different thread lines 132 of thread pattern 122 will be under different values of tension in thread pattern 122. The tension of thread lines 132 may be utilized to control characteristics of thread pattern 122, and therefore upper 120.

The number of thread lines 132 fixed at an anchor point 134 is defined by the "thread line communication number" of an anchor point 134. As used herein, "thread line communication number" means the number of thread lines extending from an anchor point to different anchor points. Two thread lines extending between the same two anchor points (i.e., overlaying thread lines) only counts as "1" for purposes of calculating a thread line communication number for the anchor points. For example, a thread line communication number of five means that an anchor point has five thread lines extending from it with each of the five thread lines leading to another, different anchor point. As another example, a thread line communication number of six means that an anchor point has six thread lines extending from it with each of the six thread lines leading to another, different anchor point.

Anchor points 134 may have a thread line communication number of "X" or more for continuous thread 130. In some embodiments, two or more respective anchor points 134 may have a thread line communication number of "X" or more. In some embodiments, all the anchor points 134 of thread pattern 122 may have a thread line communication number of "X" or more. "X" may be, for example, 2, 3, 4, 5, 6, 7, 8, 9, 10, 11, 12, 13, 14, 15, 16, 17, 18, 19, 20, 25, or 30, within a range having any two of these values as end points. For example, in some embodiments "X" may be in a range of 2 to 30, 3 to 30, 4 to 30, 5 to 30, 6 to 30, 7 to 30, 8 to 30, 9 to 30, 10 to 30, 11 to 30, 12 to 30, 13 to 30, 14 to 30, 15 to 30, 16 to 30, 17 to 30, 18 to 30, 19 to 30, 20 to 30, or 25 to 30. In some embodiments, "X" may be greater than 30. As a non-limiting example, as show in FIG. 1B, anchor point 134(*a*) has a thread line communication number of six and anchor point 134(*b*) has a thread line communication number of seven.

Thread lines 132 may be bonded at anchor points 134. Thread lines 132 may be bonded at anchor points 134 via an adhesive, a bonding layer, thermal (conductive or convective) heat (for example, in a heat press or oven), IR (infrared) heating, laser heating, microwave heating, steam, a mechanical fastener (for example, a clip), hook and loop fasters, needle-punching, hydro-entanglement, ultrasonic/vibratory entanglement, felting, knotting, chemical bonding with a catalyst of biomaterial, adhesive spraying (for example, CNC adhesive spray deposition), or by pushing one thread line through the other thread line(s).

In some embodiments, thread lines 132 may be directly bonded together at anchor points 134. In some embodiments, thread lines 132 may be directly bonded together at anchor points 134 via the polymeric material of continuous thread 130). For example, heat and/or pressure may be applied to an anchor point 134 to directly bond thread lines 132 at any peripheral anchor points 134. In some embodiments, thread lines 132 may be directly bonded together at perimeter portion 162 via the polymeric material(s) of continuous thread 130. For example, heat and/or pressure may be applied to perimeter portion 162 of upper 120 to directly bond thread lines 132 in perimeter portion, and at any peripheral anchor points 134 within perimeter portion 162. In embodiments where heat and/or pressure is utilized to directly bond the polymeric material of thread lines 132, the thread lines 132 may be thermally fused together at one or more anchor points 134. In embodiments including direct bonding of thread lines 132 at a perimeter portion and/or anchor points, thread lines 132 are directly bonded at the perimeter portion and/or anchor points without the use of an adhesive or bonding layer.

In some embodiments, thread lines 132 may be bonded together via a bonding layer. In some embodiments, thread lines 132 may be bonded together at anchor points 134 (for example, peripheral anchor points) via a bonding layer. In such embodiments, the bonding layer is attached to one or more anchor points 134 and mechanically couples the anchor point(s) 134 to each other. The bonding layer may be, for example, a laminated layer, an adhesive layer, a stitched layer, a cured layer, or a screen-printed layer. In some embodiments, the lamination layer, adhesive layer, cured layer, or screen-printed layer may serve to encase anchor points 134 in a bonding layer. The bonding layer may bond thread lines 132 via any suitable mechanical bonding technique.

In some embodiments, thread lines 132 may be bonded together without the use of a bonding layer. For example, in some embodiments, thread lines 132 may be directly bonded together via, for example, but not limited to, local bonding via an adhesive, direct local bonding via material(s) of thread lines 132, needle punching, hydro-entanglement, and ultrasonic/vibratory entanglement.

In some embodiments, thread lines 132 may be bonded at points where two or more thread lines 132 overlap in thread pattern (i.e., intersection points 136). Thread lines 132 may be bonded at intersection points 136 via an adhesive, a bonding layer, thermal (conductive or convective) heat (for example, in a heat press or oven), IR (infrared) heating, laser heating, microwave heating, steam, a mechanical fastener (for example, a clip), hook and loop fasters, needle-punching, hydro-entanglement, ultrasonic/vibratory entanglement, felting, knotting, chemical bonding with a catalyst of biomaterial, adhesive spraying (for example, CNC adhesive spray deposition), or by pushing one thread line through the other thread line(s). Intersection points for thread lines may be referred to as "overlap points."

In some embodiments, thread lines 132 may be directly bonded together at intersection points 136. In some embodiments, thread lines 132 may be directly bonded together at intersection points 136 via the polymeric material of continuous thread 130. In embodiments including direct bonding of thread lines 132 at intersection points 136, thread lines 132 are bonded at intersection points 136 without the use of an adhesive or bonding layer. For example, heat and/or pressure may be applied to a thread pattern to directly bond thread lines 132 at any intersection points 136. In embodiments where heat and/or pressure is utilized to directly bond the polymeric material of thread lines 132, the thread lines 132 may be thermally fused together at one or more intersection points 136.

In some embodiments, a bonding layer may bond thread lines 132 together at a plurality of intersection points 136 within thread pattern 122. In embodiments including multiple continuous threads, thread lines of respective continuous threads may be bonded at intersection points between the thread lines, either directly or via a bonding layer.

In some embodiments, continuous thread 130 includes overlaying thread lines 132. As used herein, "overlaying thread lines" means two or more thread lines that follow the same path between two respective anchor points. Overlaying thread lines need not be overlaid directly over each other. Two or more thread lines are considered overlaying as long as they extend between the same two anchor points.

Thread pattern 122 may include one or more continuous threads 130 with thread lines 132 crossing over underlying thread line(s) 132 in various directions. The thread lines 132 of thread pattern 122 may not be woven or knitted together. In such embodiments, thread lines 132 may be referred to as "non-woven" and "non-knitted" thread lines. The thread lines 132 of thread pattern 122 may not be embroidered threads stitched to a base layer. In such embodiments, thread lines 132 may be referred to as "non-embroidered" thread lines. Thread lines 132 may be threaded over each other to form a thread network defining a patterned layer for an article of footwear component.

In some embodiments, continuous thread 130 may be a polymer thread. As used herein "polymer thread" means a thread composed at least in part of a polymeric material. In some embodiments, a polymer thread may be composed entirely of one or more polymeric materials. In some embodiments, a polymer thread may include a polymeric material coated around a core (which may or may not be composed of a polymeric material). In such embodiments, the core may be encapsulated by the coating material. In some embodiments, a polymer thread may include a non-polymer core coated, covered, or encapsulated with a polymeric material. In some embodiments, a polymer thread may include a polymer core coated, covered, or encapsulated with a non-polymeric material. In some embodiments, a polymer thread may be a braided thread with one or more braids composed of a polymeric material. In some embodiments, the polymeric material(s) of a polymer thread may be thermoplastic material(s). In some embodiments, continuous thread 130 may be a thread coated with an activatable agent, for example a heat activated adhesive or a UV-activated adhesive. In some embodiments, a CNC machine for winding a continuous thread 130 with an activatable agent coating may include a robotic arm for activing the coating as continuous thread 130 is being wound into a thread pattern.

Suitable polymeric materials for polymer threads discussed herein include, but are not limited to, thermoplastic polyurethane (TPU), a rubber, and silicone. In some embodiments, the TPU may be recycled TPU. In some embodiments, the polymeric material may be a photo-reactive (infrared or ultraviolet light reactive) polymeric material, such as a photo-reactive TPU. In some embodiments, the polymeric material may be soluble (for example, water-soluble). In embodiments including polymer threads with a coated core, suitable materials for the core include, but are not limited to, polyester, nylon, ultra-high molecular weight polyethylene (for example, DYNEEMA® (a type of ultra-high molecular weight polyethylene)), carbon fiber, KEVLAR® (a type of para-aramid), bioengineered woven, knit or layered materials (for example, synthetic spider silk), woven, knit or layered plant based materials, knit or layered recycled and/or extruded plastics, cotton, wool, and natural or artificial silk. In some embodiments, polymer threads may be thermoplastic polyurethane coated polyester threads. In some embodiments, continuous thread 130 may be a non-polymer thread composed of non-polymer materials, such as carbon fiber, cotton, wool, or silk. In some embodiments, continuous thread 130 may be a thread composed of a biomaterial, such as mango yarn or bio-silk. In some embodiments, polymer threads may be a thermoplastic melt yarn, polymer yarn with non-melt core, and other similar types of yarn.

In some embodiments, continuous thread 130 may be a plied thread. In some embodiments, the plied thread 130 may be plied while winding thread 130. For example, a winding assembly used to wind thread 130 may ply the thread using thread from a plurality of thread spools (see for example, winding assembly 2900). In some embodiments, the plied thread may be a pre-plied thread spooled around a thread spool.

In some embodiments, a plied thread may include a plurality of different types of threads. For example, a plied thread may include one or more polymer threads and one or more non-polymer threads. As another example, a plied thread may include one or more polymer threads including a first polymer material and one or more threads including a second, different, polymer material.

In some embodiments, continuous thread 130 may be a composite co-extruded thread. In such embodiments, different portions of the composite co-extruded thread are formed of different materials. In such embodiments, the different materials of the composite co-extruded thread may provide varying mechanical characteristics to a thread pattern.

In some embodiments, continuous thread 130 may be a foamable thread. In such embodiments, a foaming agent in the foamable thread may be activated to expand the thread after the thread is wound in a thread pattern. The foaming agent in a foamable thread may be activated by, for example, heat. In such embodiments, continuous thread 130 may be wound in a thread pattern to provide areas of increase padding for a wearer's comfort.

In some embodiments, continuous thread 130 may be a dissolvable thread. Dissolvable threads may be dissolved after being wound in a thread pattern by a solvent. In such embodiments, a portion of a thread pattern may be removed by dissolving the dissolvable thread.

In some embodiments, continuous thread 130 may be an "active thread." As used herein, an "active thread" is a thread that changes in length when activated by an activating agent. An active thread may expand or contract in length when activated by an activating agent. Exemplary activating agents include, but are not limited to, heat, water, and electrical current. In embodiments including an active thread, dimensional characteristics of a thread pattern may be altered after winding the thread pattern. For example, in some embodiments, the dimensional characteristics of a thread pattern may be altered while heating a thread pattern within a mold or heat press as described herein.

In some embodiments, continuous thread 130 may include one or more threads disposed within a hollow tube.

In some embodiments, continuous thread 130 may be a composed of a viscoelastic shear thickening (dilatant) material. The elastic modulus of a dilatant material is dependent on the rate of strain applied to the material. By incorporating a thread composed of a dilatant material in a thread pattern, the stiffness of the thread pattern can change depending on the degree of stain applied to the thread pattern during use. For example, a thread pattern may remain relatively compliant during a low stress activity, for example walking, but increase in stiffness when high stress levels are applied during a high stress activity, such as running.

In some embodiments, upper 120, and thread pattern 122, includes more than one continuous thread. For example, as shown in FIGS. 1A and 1, thread pattern 122 may include a second continuous thread 170. Second continuous thread 170 has the same or different characteristics as first continuous thread 130. And second continuous thread 170 may be incorporated into thread pattern 122 in the same manner as first continuous thread 130.

Like continuous thread 130, continuous thread 170 may include a plurality of thread lines wound around and extending between two respective peripheral anchor points 134. Anchor points 134 may have a thread line communication number of "Y" or more for second continuous thread 170. The thread line communication number for second continuous thread 170 may be the same as or similar to the thread line communication number for continuous thread 130. "Y" may be less than "X", more than "X", or the same as "X".

In some embodiments, first continuous thread 130 may be composed of the same material(s) as second continuous thread 170. In some embodiments, first continuous thread 130 may be composed of different material(s) than second continuous thread 170. The material(s) of different continuous threads in a thread pattern may be selected to provide targeted characteristics to areas of a thread pattern, and therefore an upper. In embodiments including polymer thread(s) having a core coated with a polymeric material, the material of the core for different continuous threads may be different or the same. And the material of the core for different continuous threads may be selected to provide targeted characteristics to different areas of a thread pattern, and therefore an upper. Similarly, for braided threads, the material(s) of the braided thread(s) may be selected to provide targeted characteristics to different areas of a thread pattern, and therefore an upper.

In some embodiments, continuous threads of a thread pattern may have a denier in the range of 1 denier to 3000 denier, including subranges. For example, continuous threads may have a denier of 1, 10, 50, 100, 200, 300, 400, 500, 600, 700, 800, 900, 1000, 1100, 1200, 1300, 1400, 1500, 1600, 1700, 1800, 1900, 2000, 2500, or 3000 denier, or within any range having any two of these values as endpoints. For example, in some embodiments, continuous threads of a thread pattern may have a denier in the range of 10 denier to 2500 denier, 50 denier to 2000 denier, 100 denier to 1900 denier, 200 denier to 1800 denier, 300 denier to 1700 denier, 400 denier to 1600 denier, 500 denier to 1500 denier, 600 denier to 1400 denier, 700 denier to 1300 denier, 800 denier to 1200 denier, 900 denier to 1100 denier, or 900 denier to 1000 denier.

In some embodiments, the denier of continuous thread(s) in a thread pattern may be selected to provide varying degrees of a characteristic (for example, strength or stretchability) to different areas of the thread pattern. In embodiments including coated threads, the denier of the core material and/or the overall denier of the continuous thread(s) may be selected to provide varying degrees of a characteristic (for example, strength or stretchability) to different areas of a thread pattern. As a non-limiting example, a larger overall diameter or a larger core diameter for a given continuous thread may increase the degree of directional strength imparted by the given continuous thread within a thread pattern.

While FIGS. 1A and 1B show thread pattern 122 including two continuous threads (130 and 170), thread pattern 122 may include any suitable number of continuous threads, such as for example, three or more, four or more, five or more, six or more, seven or more, eight or more, nine or more, ten or more, fifteen or more, or twenty or more continuous threads. Additional continuous threads may be the same as or different from continuous threads 130 and 170. And additional continuous threads may be incorporated into thread pattern 122 in the same manner as continuous threads 130 and 170. Additional continuous threads may be wound around and extended between anchor points 134 in the same fashion as continuous threads 130 and 170.

In embodiments including a plurality of continuous threads, each wound continuous thread may define a layer of thread pattern 122. For example, a layer defined by wound continuous thread 130 may define a first layer of thread pattern 122 and a layer defined by wound continuous thread 170 may define a second layer of thread pattern 122. And different layers of a thread pattern may be disposed over each other in areas of overlap between the two layers. For example, a first layer defined by continuous thread 130 may be disposed over a second layer defined by continuous thread 170, or vice versa, in areas of overlap between the two layers. Different layers defined by different continuous wound threads may provide different characteristics to different areas of upper 120.

In some embodiments, one or more of the layers of thread pattern 122 defined by a wound continuous thread may serve to bond other layers of thread pattern 122 together. In such embodiments, these one or more layers may be wound using a polymeric thread, which when heated, bonds other layers of thread pattern 122 together at anchor points and other intersection points between continuous threads. For example, in a thread pattern 122 including three layers, each defined by a continuous thread, one of the three continuous threads (for example, the middle continuous thread) may be a polymeric thread that serves to bond all three threads together. In some embodiments, one or more of the layers of thread pattern 122 may be defined by a wound continuous thread coated or impregnated with an adhesive. In some embodiments, the adhesive may be activated with the application of heat. In some embodiments, the adhesive may be a dissolvable adhesive that, when contacted with a solvent, such as water, fully or partially dissolves to bond continuous threads. In some embodiments, one or more layers of thread pattern 122 may be defined by a wound continuous thread that is a braided or twisted thread including a polymeric and/or adhesive thread braided or twisted with a non-polymeric or non-adhesive thread. In such embodiments, the braided or twisted polymeric and/or adhesive thread may serve to bond thread lines 132 at anchor points 134 and/or intersection points 136.

In some embodiments, thread pattern 122 may define at least 10%, at least 20%, at least 30%, at least 40%, at least 50%, at least 60%, at least 70%, at least 80%, or at least 90% of a component of upper 120. In some embodiments, thread pattern 122 may occupy at least 10%, at least 20%, at least 30%, at least 40%, at least 50%, at least 60%, at least 70%, at least 80%, or at least 90% of the outer surface area of upper 120. In some embodiments, thread pattern 122 may be visibly exposed on the outer surface of upper 120. In some embodiments, no lamination layer or supporting textile layer is disposed over thread pattern 122 on the outer surface of upper 120. In some embodiments, thread pattern 122 may be devoid of a lamination layer.

Thread pattern 122 may provide targeted characteristics (for example, strength, support, propulsion, breathability, comfort (stretchability), tackiness, abrasion resistance, texture, haptics, and durability) to areas of upper 120. In some embodiments, thread pattern 122, or a portion thereof, may provide a first degree of a characteristic in one area of upper 120 and a second degree of that characteristic in a second area of upper 120.

In some embodiments, different layers of thread pattern 122 may provide a first degree of a characteristic in one area of upper 120 and a second degree of that characteristic in a second area of upper 120. In some embodiments, different layers of thread pattern 122 may include different thread patterns to provide targeted characteristics to different areas of upper 120. In some embodiments, different layers of thread pattern 122 may include thread patterns with thread lines oriented in different directions to provide targeted characteristics to different areas of upper 120.

Figure 2:
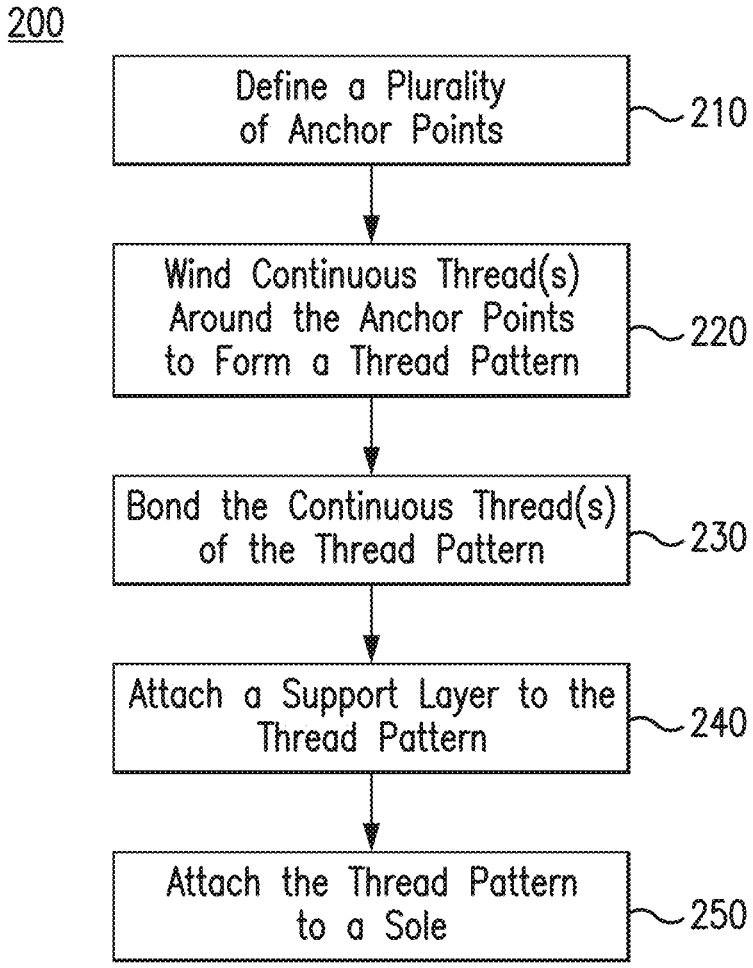
FIG. 2 is an exemplary flowchart of a method of according to some embodiments.

FIG. 2 shows a method 200 of making an upper (for example, upper 120), and an article of footwear (for example, article of footwear 100) according to some embodiments. In step 210, a plurality of anchor points (for example, anchor points 134) may be defined. In some embodiments, the anchor points may include peripheral anchor points. In some embodiments, the anchor points may include interior anchor points disposed interior of peripheral anchor points.

In step 220, one or more continuous threads (for example, continuous thread 130) may be wound (wrapped) around the defined anchor points such that individual thread lines (for example, thread lines 132) of the continuous thread(s) extend between two respective anchor points. Winding continuous thread(s) in step 220 forms a desired thread pattern (for example, thread pattern 122). During winding step 220, anchor points are defined by fixed or moveable members, such as pins, projections, nubs, or shafts coupled to a support structure, or any other similar fixed anchor point discussed herein. These fixed members serve to support continuous thread(s) during winding step 220. For example, thread(s) may be wound around anchor points on a plate, a three-dimensional object (for example, a last), or a frame as discussed herein. For example, the anchor points may be pins 304 coupled to support plate 300. As another example, the anchor points may be projections 606 extending from support plate 600. As another example, the anchor points may be anchor points 1540 extending from a mold plate 1510/1520. As another example, the anchor points may be anchor points 1906 extending form three-dimensional object 1900.

In some embodiments, the anchor points may be defined by pins coupled to and extending from a supporting structure, such as a plate, platform, or three-dimensional object. In some embodiments, the three-dimensional object may be a last or other three-dimensional object having a volumetric shape corresponding to the shape of a human foot. In operation, the pins defining the anchor points are configured to support the continuous thread(s) during winding in step 220.

In some embodiments, the plate, object, or frame may be held stationary and a winding device may wind thread(s) around stationary anchor points. In some embodiments, the plate, object, or frame may move relative to a stationary thread source during winding.

In some embodiments, the anchor point locations about which one or more continuous threads are wound (wrapped) in step 220 may be temporary structures that are removed from a thread pattern defining an upper, or may be present in a thread pattern defining an upper. Portions of a thread pattern having one or more temporary anchor point locations may be cut from, or otherwise removed from, a thread pattern when shaping a thread pattern into an upper. In such embodiments, a thread pattern for a finished upper will have a fewer number of anchor point locations than the number of anchor point locations used in winding the thread pattern.

Figure 25:
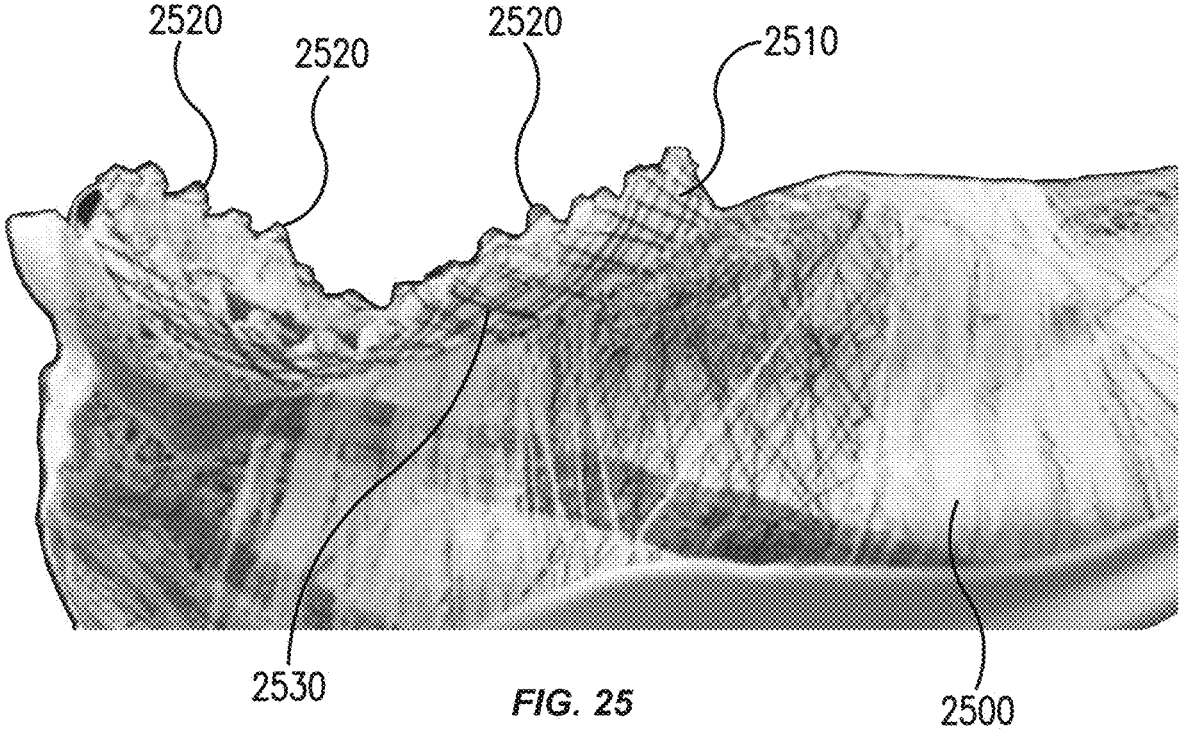
FIG. 25 shows an article of footwear according to some embodiments.

In some embodiments, all or a portion of the anchor point locations about which one or more continuous threads are wound (wrapped) in step 220 may be present on an upper formed using the thread pattern wound in step 220. For example, in some embodiments, anchor point locations may be located around an opening for an upper, for example a collar or a throat. FIG. 25 illustrates an exemplary upper 2500 having a thread pattern 2510 with anchor points 2520 located at a collar 2530 of upper 2500. In some embodiments, anchor points 2520 may provide collar 2530, or other opening in an upper, with a desired aesthetic look. In some embodiments, anchor points 2520 may serve to provide cushioning at collar 2530, or other opening in an upper, for wearer comfort.

As another example, in some embodiments, anchor point locations may be folded or otherwise concealed on an upper. In some embodiments, anchor point locations may be concealed within a seam located on upper. In some embodiments, anchor point locations may be folded in area used for stitching or bonding a footwear component to an upper.

Figure 26B:
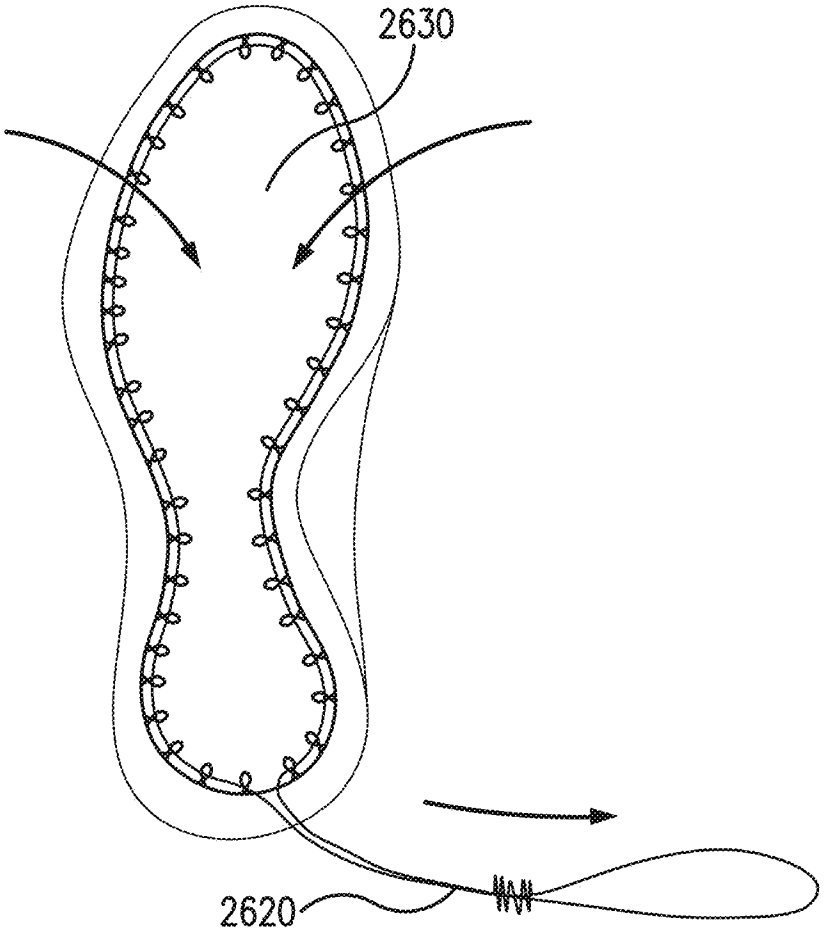
FIGS. 26A and 26B show an exemplary process for making a padded thread pattern according to some embodiments.
Figure 26A:
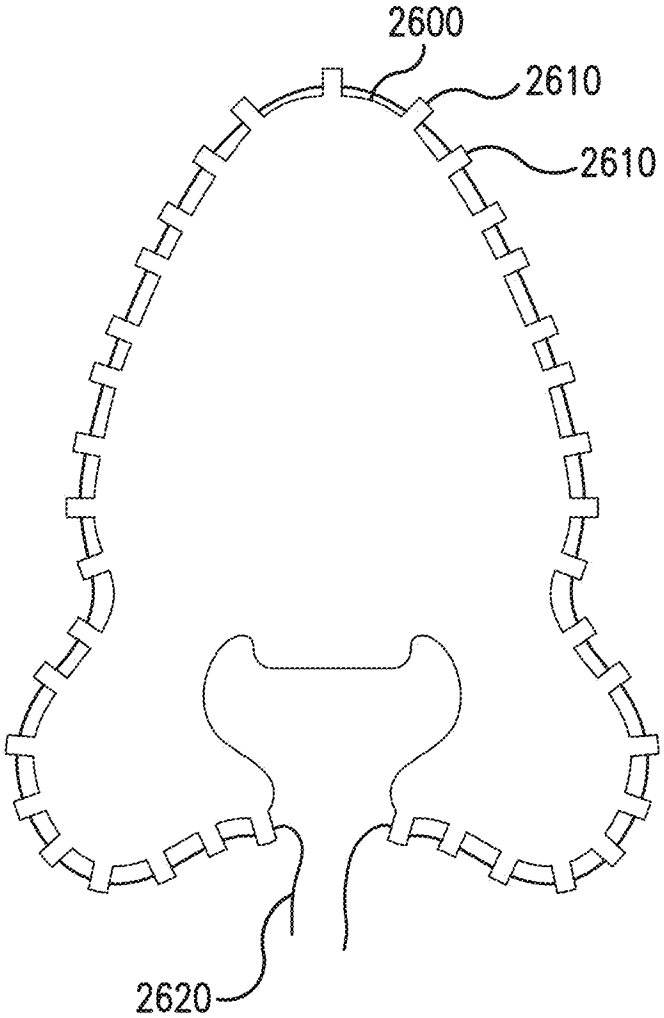

In some embodiments, all or a portion of the anchor point locations about which one or more continuous threads are wound (wrapped) in step 220 may be utilized in a lasting process for making an upper using the thread pattern wound in step 220. FIGS. 26A and 26B illustrate an exemplary upper lasting process according to some embodiments. In such embodiments, after winding a thread pattern 2600, a string 2620 may be fed through openings defined by all or a portion of anchor point locations 2610. Once string 2620 is fed through the openings and thread pattern 2600 is placed around a last 2630, string 2620 may be tightened so that thread pattern 2600 is positioned and cinched around last 2630. After cinching thread pattern 2600 around last, thread pattern 2600 may be bonded on last 2630 herein to form a portion of an upper. Bonding thread pattern 2600 on last 2630 may including bonding continuous thread(s) and/or thread lines as described herein.

In step 230, the continuous thread(s) are bonded within the thread pattern. In some embodiments, continuous thread(s) may be bonded at points of intersection between thread lines via, for example, an adhesive, a bonding layer, thermal (conductive or convective) heat (for example, in a heat press or oven), IR (infrared) heating, laser heating, microwave heating, steam, a mechanical fastener (for example, a clip), hook and loop fasters, needle-punching, hydro-entanglement, ultrasonic/vibratory entanglement, felting, knotting, chemical bonding with a catalyst of biomaterial, adhesive spraying (for example, CNC adhesive spray deposition), or by pushing one thread line through the other thread line(s). In some embodiments, continuous thread(s) may be directly bonded at points of intersection between thread lines.

In some embodiments, continuous thread(s) may be bonded at the anchor points via, for example, an adhesive, a bonding layer, thermal (conductive or convective) heat (for example, in a heat press or oven), IR (infrared) heating, laser heating, microwave heating, steam, a mechanical fastener (for example, a clip), hook and loop fasters, needle-punching, hydro-entanglement, ultrasonic/vibratory entanglement, felting, knotting, chemical bonding with a catalyst of biomaterial, adhesive spraying (for example, CNC adhesive spray deposition), or by pushing one thread line through the other thread line(s). In some embodiments, continuous thread(s) may be directly bonded at the anchor points.

In some embodiments, step 230 includes the formation of a bonding layer for bonding thread lines together.

In some embodiments, method 200 may include multiple winding steps 220 and multiple bonding steps 230. For example, a portion of a thread pattern may be wound in a first winding step 220 and then that portion may be bonded in a first bonding step 230. Then a second portion of a thread pattern may be wound in a second winding step 220 and then that portion may be bonded in a second bonding step 230. In some embodiments, bonding step 230 may include a preliminary bonding step to hold the pattern of a thread pattern until a final bonding step is performed. For example, a preliminary bonding step may allow a thread pattern to be removed from anchor points and be finally bonded after removal.

In some embodiments, steps 220 and 230 are performed in the absence of a base layer disposed between the thread pattern and a support structure (for example, support plate 300 or 600). As used herein "base layer" means a layer of material employed to facilitate the placement or arrangement of threads when winding and/or bonding a thread pattern. A base layer may be a layer to which threads are bonded, stitched, woven into, printed on, deposited on, or otherwise in contact with during manufacturing of a thread pattern. A layer attached to a thread pattern after formation of the thread pattern is complete is not considered a base layer.

In some embodiments, a support layer may be attached to a thread pattern in step 240. In some embodiments, the support layer attached in step 240 may be a fabric layer 172 discussed herein. In some embodiments, method 200 does not include step 240.

In some embodiments, the thread pattern may be attached to a sole in step 250 to form an article of footwear. In some embodiments, continuous thread(s) of the thread pattern may be directly attached to a sole in step 250 via, for example, stitching, an adhesive, a lamination process, or a heat pressing process. In some embodiments, the bonding layer of a thread pattern may be attached to a sole in step 250 via, for example, stitching, an adhesive, a lamination process, or a heat pressing process. In embodiments including a support layer, the support layer may additionally or alternatively be attached to the sole in step 250. In some embodiments, step 250 may include shaping a thread pattern into the shape of an upper (for example, by cutting excess portions of a thread pattern to for a thread pattern with a perimeter shape for an upper). In some embodiments, a sole may be attached to the thread pattern in step 250 by molding a sole around portion of the thread pattern. In some embodiments, a sole may be attached to the thread pattern in step 250 by injection molding a sole around portion of the thread pattern (see for example, FIGS. 15A and 15B).

Figure 3:
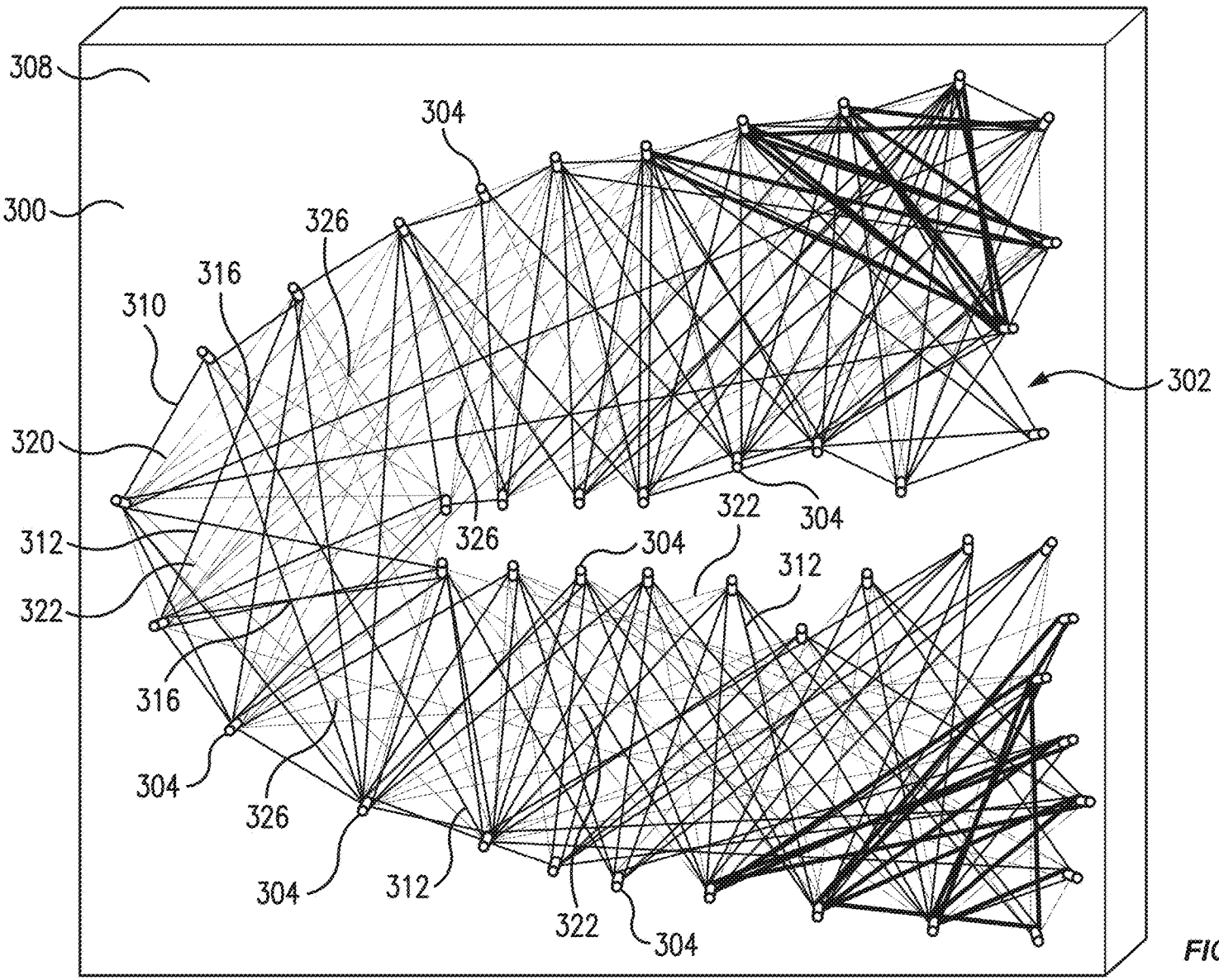
FIG. 3 shows a thread pattern and support plate according to some embodiments.

FIG. 3 shows continuous threads 310 and 320 wound around anchor point pins 304 coupled to a support plate 300 to define a thread pattern 302 according to embodiments. Thread pattern 302 in FIG. 3 is a representative exemplary thread pattern. Various thread patterns discussed herein (for example, thread pattern 122) may be wound around anchor point pins 304 coupled support plate 300. Anchor point pins 304 extend from an upper surface 308 of support plate 300 and serve to support continuous threads 310 and 320 during winding of thread pattern 302. Anchor point pins 304 may be peripheral anchor point pins 304 arranged in a peripheral area corresponding to a perimeter portion of an upper. In some embodiments, anchor point pins 304 may include interior anchor point pins.

First continuous thread 310 may be wound about anchor point pins 304 with thread lines 312 extending between two respective anchor point pins 304. In other words, first continuous thread 310 may be wrapped around a first anchor point pin 304, threaded to a second anchor point pin 304, wrapped around the second anchor point pin 304, threaded to a third anchor point pin 304, wrapped around the third anchor point pin 304, and so on.

Similar to first continuous thread 310, second continuous thread 320 may be wound around anchor point pins 304 with thread lines 322 extending between two respective anchor point pins 304. A continuous thread wrapped or wound around an anchor point pin (or other anchor point members discussed herein) need not be wrapped or wound completely (i.e., 360 degrees) around a perimeter of the pin. A continuous thread wrapped or wound around an anchor point pin may be wrapped or wound around only a portion of a pin. For example, a continuous thread wrapped or wound around a pin may be wrapped or wound around 25% (90 degrees) of a pin's perimeter, 50% (180 degrees) of a pin's perimeter, 75% (270 degrees) of a pin's perimeter, or 100% (360 degrees) of a pin's perimeter. In some embodiments, a continuous thread may be wrapped or wound around a pin's perimeter more than once before being threaded to the next pin. For example, a continuous thread may be wrapped or wound around a pin's perimeter one and a half times (540 degrees) or twice (720 degrees) before being threaded to the next pin.

Continuous threads 310 and 320 may be wrapped around any number of anchor point pins 304 to define thread pattern 302. In some embodiments, continuous thread 310 and/or continuous thread 320 may be wrapped or wound around a single anchor point pin 304 more than once during winding in step 220. For example, during winding in step 220, first continuous thread 310 may be wrapped around a first anchor point pin 304, threaded to and wrapped around a second anchor point pin 304, thread to and wrapped around a third anchor point pin 304, and threaded to and wrapped around the first anchor point pin 304 again. As another example, during winding in step 220, first continuous thread 310 may be wrapped around a first anchor point pin 304, threaded to and wrapped around a second anchor point pin 304, and threaded to and wrapped around the first anchor point pin 304 again. In such embodiments, this creates overlaying thread lines 312.

During winding in step 220, thread lines 312 of first continuous thread 310 may overlap each other at intersection points 316. Similarly, thread lines 322 of second continuous thread 320 may overlap each other at intersection points 326. In bonding step 230, thread lines 312 and/or 322 may be bonded at intersection points 316 and 326, respectively. Each anchor point pin 304 may have a thread line communication number for first continuous thread 310 and second continuous thread 320 as discussed herein.

Figure 4A:
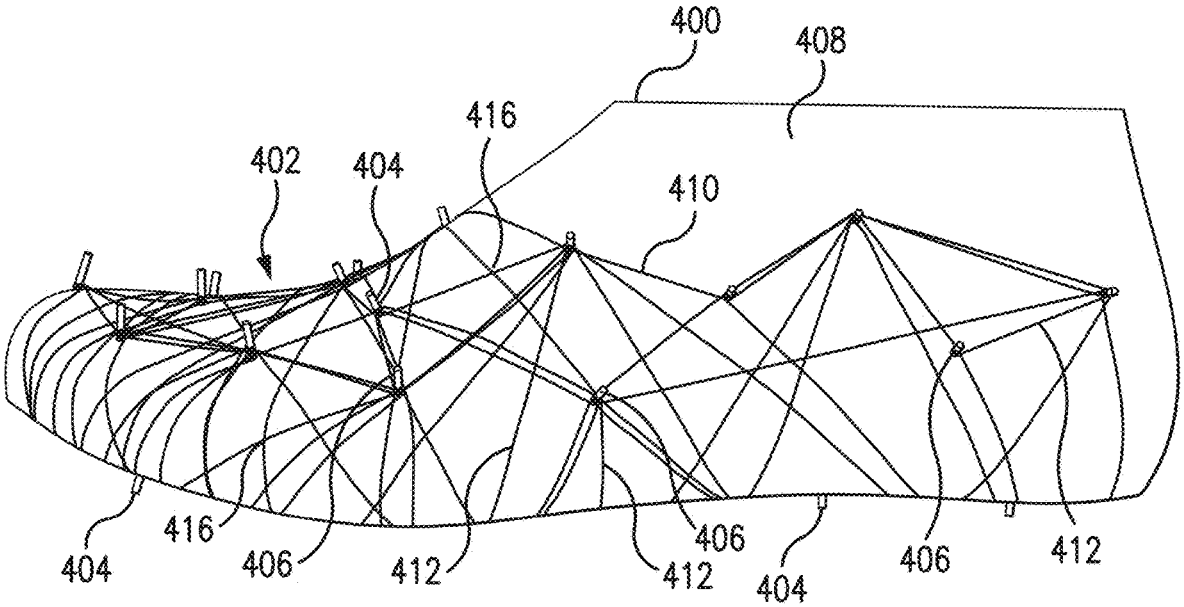
FIG. 4A shows a side view of a thread pattern and a three-dimensional pin assembly object according to some embodiments.
Figure 4B:
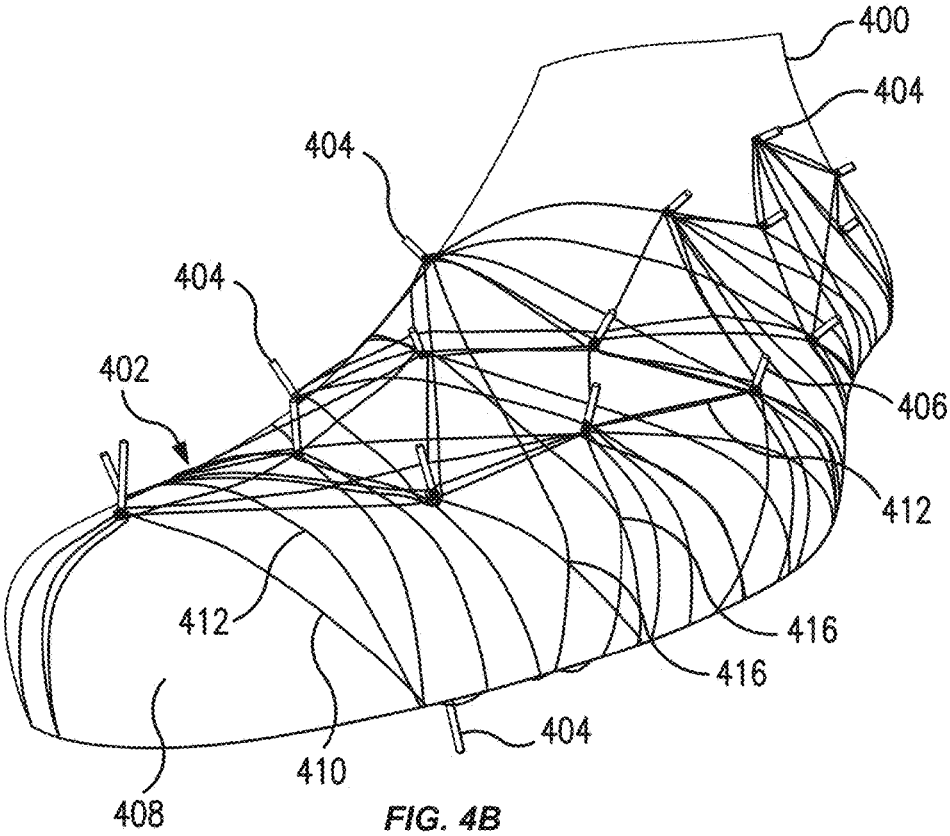
FIG. 4B shows a perspective view the thread pattern and the three-dimensional pin assembly object of FIG. 4A.

FIGS. 4A and 4B show continuous thread 410 wrapped around peripheral anchor point pins 404 and interior anchor point pins 406 coupled to a three-dimensional object 400 to define a thread pattern 402. Thread pattern 402 in FIGS. 4A-4B is a representative exemplary thread pattern. Various thread patterns discussed herein (for example, thread pattern 122) may be wound around anchor points pins 404/406 coupled to three-dimensional object 400. Anchor point pins 404 and 406 extend from an exterior surface 408 of three-dimensional object 400 and serve to support continuous thread(s) during winding of thread pattern 402.

Peripheral anchor point pins 404 may be arranged in a peripheral area corresponding to a perimeter portion of an upper including thread pattern 402. Interior anchor point pins 406 may be disposed in the area between peripheral anchor point pins 404 (i.e., within perimeter portion 162 of upper 120, including the quarter panels, vamp portion, and toe box portion of upper 120 including thread pattern 402). Interior anchor point pins 406 may be arranged to provide additional points for fixing thread lines in a thread pattern. These additional points may provide desired characteristics to corresponding areas of a thread pattern, and therefore an upper. Interior anchor points, such as interior anchor point pins 406 may be utilized in the formation of various thread patterns discussed herein.

Similar to first continuous thread 310, continuous thread 410 may be wound around anchor point pins 404 and 406 with thread lines 412 extending between two respective anchor point pins 404/406. For example, continuous thread 410 may be wrapped around a first anchor point pin 404, threaded to a second anchor point pin 406, wrapped around the second anchor point pin 406, threaded to a third anchor point pin 404, wrapped around the third anchor point pin 404, and so on.

Also similar to continuous thread 310, continuous thread 410 may be wrapped around any number of anchor point pins 404/406 to define thread pattern 402. In some embodiments, continuous thread 410 may be wrapped or wound around a single anchor point pin 404/406 more than once during winding in step 220. Further, during winding in step 220, thread lines 412 of continuous thread 410 may overlap each other at intersection points 416. And each anchor point pin 404/406 may have a thread line communication number for continuous thread 410. In bonding step 230, thread lines 412 may be bonded at anchor points 404/406 and/or intersection points 416. Pins 404/406 may be integrally formed with object 400 or may be removably coupled to object 400. After winding and/or bonding of continuous thread 410 of thread pattern 402, thread pattern 402 may be removed from pins 404/406.

In some embodiments, padding may be incorporated into a thread pattern for providing cushioning, support, and/or protection to areas of an upper. In some embodiments, padding may be incorporated into a thread pattern prior to bonding in step 230. Padding may be incorporated into one or more areas of an upper (for example, upper 120), such as but not limited to, the throat area 150 of upper 120, collar 156 of upper 120, heel counter 158 of upper 120, biteline 160 of upper 120, quarter panels of upper 120, vamp portion of upper 120, and toe box portion of upper 120.

Figure 5:
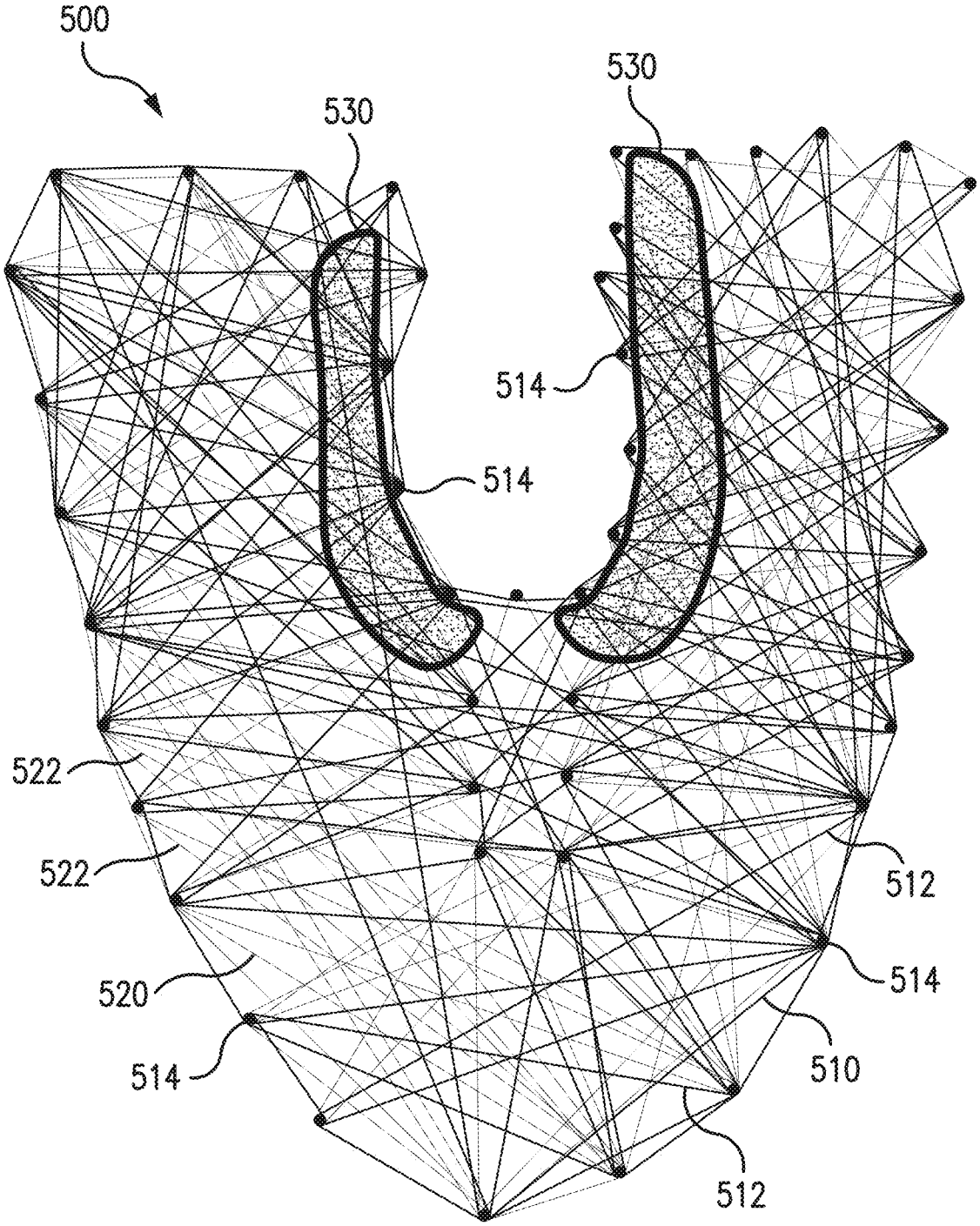
FIG. 5 shows a thread pattern with cushioning elements according to some embodiments.

FIG. 5 shows an exemplary thread pattern 500 including padding elements 530 according to some embodiments. Thread pattern 500 in FIG. 5 is a representative exemplary thread pattern. Any thread pattern discussed herein (for example, thread pattern 122) may include padding elements 530. Thread pattern 500 may be made using method 200 and may be used to construct an upper (for example, upper 120) as discussed herein.

Similar to other thread patterns discussed herein, thread pattern 500 includes first and second continuous threads 510 and 520 wound around anchor points 514 with thread lines 512 and 522 extending between two respective anchor points 514. Thread lines 512 of first continuous thread 510 may overlap each other at intersection points. Similarly, thread lines 522 of second continuous thread 520 may overlap each other at intersection points.

In some embodiments, padding elements 530 may be disposed within thread pattern 500 vertically between thread lines 512 of first continuous thread 510 and/or thread lines 522 of second continuous thread 520. In such embodiments, padding elements 530 may be suspended between thread lines 512/522 of thread pattern 500. For example, in some embodiments, some thread lines 512 may be disposed above (i.e., on the outer side of) padding elements 530 and some thread lines 512 may be disposed below (i.e., on the inner side of) padding elements 530 to support padding elements within thread pattern 500. As another example, in some embodiments, some thread lines 522 may be disposed above padding elements 530 and some thread lines 522 may be disposed below padding elements 530 to support padding elements within thread pattern 500. As another example, in some embodiments, some thread lines 512 may be disposed above padding elements 530 and some thread lines 522 may be disposed below padding elements 530.

Padding elements 530 may be composed of, for example, neoprene, ePEBA, eTPU, EVA, TPU, or a foam, such as polyethylene foam, polyurethane foam, or a urethane foam. In some embodiments, padding elements 530 may be a knit fabric, a woven fabric, or a non-woven fabric.

In some embodiments, padding elements 530 may be placed within thread pattern 500 during winding step 220 to suspend padding elements 530 within thread pattern 500. In some embodiments, padding elements 530 may include padded regions 2210 or padding elements 2220 (see FIG. 22) disposed on a surface of thread pattern 500. In some embodiments, padding elements 2220 may be disposed on an outer surface and/or an inner surface of thread pattern 500.

Figure 6:
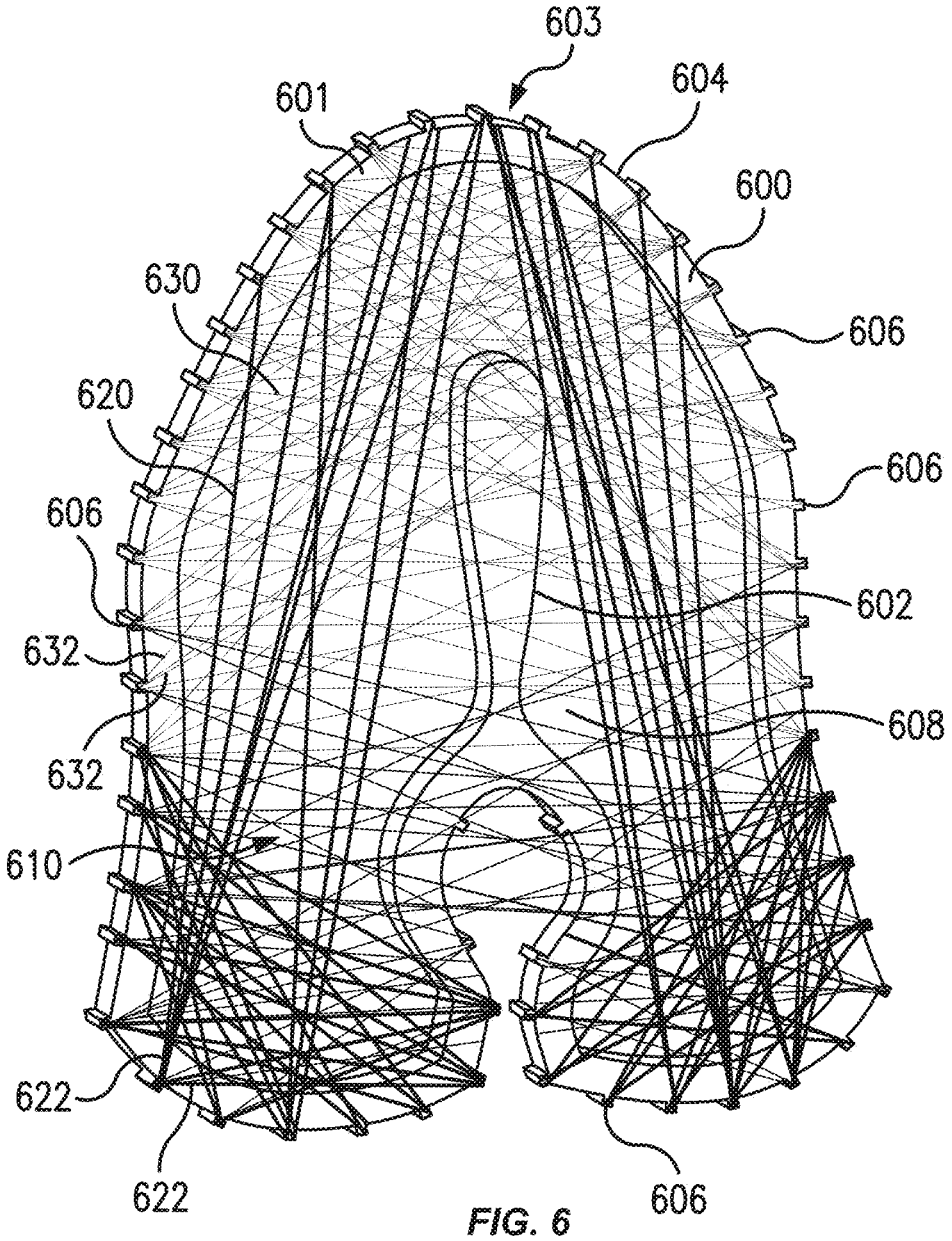
FIG. 6 shows a thread pattern and a support plate according to some embodiments.

In some embodiments, winding step 220 may include winding a thread pattern on a support plate. FIG. 6 shows a support plate 600 for winding a thread pattern according to some embodiments. Support plate 600 includes front side 601 and a rear side 603.

In some embodiments, support plate 600 may have a frame structure including an interior perimeter wall 602 and an exterior perimeter wall 604. In such embodiments, interior perimeter wall 602 of support plate 600 may define a hollow opening 608.

In some embodiments, support plate 600 may not include interior perimeter wall 602 defining a hollow opening 608. In such embodiments, support plate 600 may include front and rear surfaces defining the area between exterior perimeter wall 604.

Exterior perimeter wall 604 of support plate 600 includes a plurality of projections 606 extending laterally from exterior perimeter wall 604. Projections 606 may be integrally formed with support plate 600 or may be removably coupled to support plate 600. Projections 606 may be, for example, pins, knobs, or studs.

In operation, a thread pattern (for example, thread pattern 610) may be wound around projections 606 of support plate 600. Thread pattern 610 in FIG. 6 is a representative exemplary thread pattern. Various thread patterns discussed herein (for example, thread pattern 122) may be wound around projections 606 of support plate 600.

When winding thread pattern 610, one or more continuous threads (for example, continuous threads 620 and 630) are wound around projections 606 and across front side 601 and/or rear side 603 of support plate 600. In such embodiments, thread lines 622/632 of continuous threads 620/630 extend between respective projections 606 of support plate 600. In some embodiments, one or more continuous threads (for example, continuous threads 620 and 630) may be wound around projections 606 and across front side 601 and rear side 603 of support plate 600. In such embodiments, thread lines 622/632 of continuous threads 620/630 extend between respective projections 606 on front side 601 and rear side 603 of support plate 600, and may wrap around exterior perimeter wall 604. For support plate 600, projections 606 define anchor points of thread pattern 610.

Once a desired thread pattern 610 is wound, continuous thread(s) of thread pattern 610 may be bonded to mechanically set the thread pattern 610. In some embodiments, thread lines of continuous thread(s) may be bonded to support plate 600 around projections 606. In some embodiments, thread lines of continuous thread(s) may be directly bonded to each other around projections 606. In some embodiments, thread lines of continuous thread(s) may be bonded at together at points of intersection between the thread lines. The thread lines may be bonded at intersection points via an adhesive, a bonding layer, thermal (conductive or convective) heat (for example, in a heat press or oven), IR (infrared) heating, laser heating, microwave heating, steam, a mechanical fastener (for example, a clip), hook and loop fasters, needle-punching, hydro-entanglement, ultrasonic/vibratory entanglement, felting, knotting, chemical bonding with a catalyst of biomaterial, adhesive spraying (for example, CNC adhesive spray deposition), or by pushing one thread line through the other thread line(s). In some embodiments, thread lines of continuous thread(s) may be directly bonded at together at points of intersection between the thread lines. In embodiments including polymeric continuous thread(s), the polymeric material(s) of the continuous thread(s) may directly bond thread lines at projections 606 and/or at points of intersection between thread lines. In some embodiments, thread lines of continuous thread(s) may alternatively or additionally be bonded with a bonding layer as discussed herein.

Once thread pattern 610 is mechanically set by bonding continuous thread(s), thread pattern 610 may be removed from support plate 600. In some embodiments, removing thread pattern 610 from support plate 600 may include cutting a portion of thread pattern 610 from support plate 600. In some embodiment, the cutting process may include a laser cutting process. In some embodiments, a bonding layer may be applied to thread pattern 610 after it is cut from support plate 600.

In some embodiments, support plate 600 may be a handheld plate. In some embodiments, support plate 600 may be attached to a device configured to rotate the support plate 600 (for example, a lathe). During rotation of support plate 600, continuous thread(s) may be wound around support plate 600 either manually or with a computer-assisted machine (for example, a CNC machine). In some embodiments, thread may be wound around projections 606 of support plate 600 while support plate 600 is held stationary.

In some embodiments, a support plate may include one or more pads about which thread lines of a thread pattern are threaded. In such embodiments, thread lines of a thread pattern may be diverted around a perimeter of the pad(s) during winding. In some embodiments, by winding thread lines of a thread pattern around pad(s), one or more openings in a thread pattern may be created after the pad(s) are separated from the thread pattern. In some embodiments, by winding thread lines of a thread pattern around pad(s), the pad(s) may be incorporated into a thread pattern.

Figure 28:
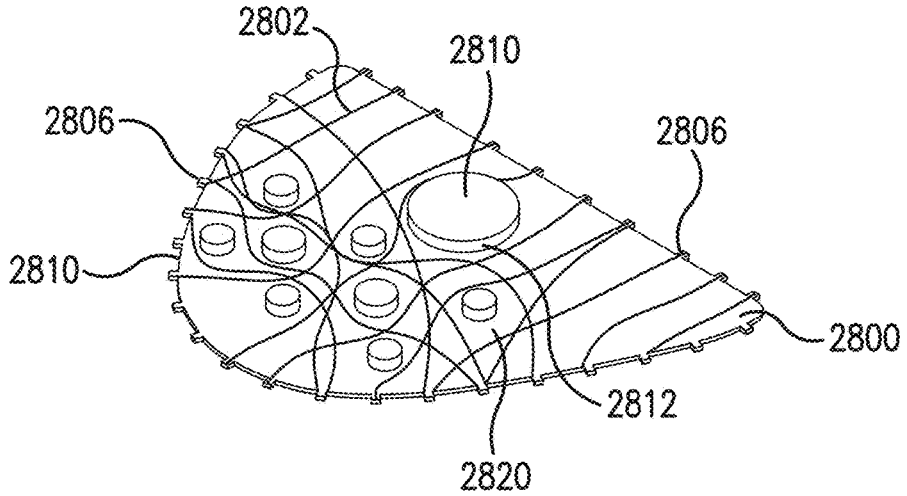
FIG. 28 shows a support plate according to some embodiments.

FIG. 28 shows a support plate 2800 including a plurality of pads 2810 around which thread lines of a thread pattern 2820 are diverted during winding between anchor points 2806 of support plate 2800. Pad(s) 2810 may be disposed on and extend above a surface 2802 of support plate 2800 between anchor points 2806. In some embodiments, the tension in thread lines diverted around pad(s) 2810 may serve to hold diverted thread lines in contact with pad(s) 2810 during and after winding.

Thread pattern 2820 in FIG. 28 is a representative exemplary thread pattern. Various thread patterns discussed herein (for example, thread pattern 122) may be wound around anchor points 2806 of support plate 2800 and include thread lines diverted around pads 2810.

In some embodiments, pad(s) 2810 maybe an integral component of support plate 2800. In such embodiments, pad(s) 2810 may be integrally formed with support plate 2800. In some embodiments, pad(s) 2810 may be permanently attached to support plate 2800. In some embodiments, pad(s) 2810 may be removably attached to support plate 2800.

In some embodiments, a pad 2810 may be located on support plate 2800 for the purpose of creating an opening in thread pattern 2820. In such embodiments, thread lines of thread pattern 2820 may be diverted around a perimeter wall 2812 of pad 2810 and set prior to removing thread pattern 2820 from support plate 2800, thereby forming an opening in thread pattern 2820. In some embodiments, the thread lines may be locally set around pad 2810. For example, thread lines may be locally bonded around pad 2810 before removing thread pattern 2820 from support plate 2800. In some embodiments, the entire thread pattern 2820 may be bonded around pad 2810. For example, the entire thread pattern 2820 may be bonded in a heat press or an oven configured to bond thread lines of a thread pattern as described herein. In embodiments where pad(s) 2810 are for the purpose of creating an opening, the opening may be, for example, an opening for a collar of an upper, an opening for at least a portion of a throat for an upper, an opening for an interlocking seam structure, or an aesthetic opening on an upper.

In some embodiments, a pad 2810 may be located on support plate 2800 for the purpose of incorporating the pad 2810 into thread pattern 2820. In such embodiments, thread lines of thread pattern 2820 may be diverted around a perimeter wall 2812 of pad 2810 and bonded to the pad 2810, thereby incorporating the pad 2810 into thread pattern 2820. In some embodiments, thread lines may be bonded to the pad 2810 in a heat press or an oven configured to bond thread lines of a thread pattern as described herein. In some embodiments, thread lines may be bonded to pad 2810 using an adhesive. In embodiments where pad(s) 2810 are included for incorporating into thread pattern 2820, pad(s) 2810 may define all or a portion of a footwear component, for example a collar for an upper, a throat for an upper, a heel counter for an upper, or an aesthetic feature on an upper.

Figure 7:
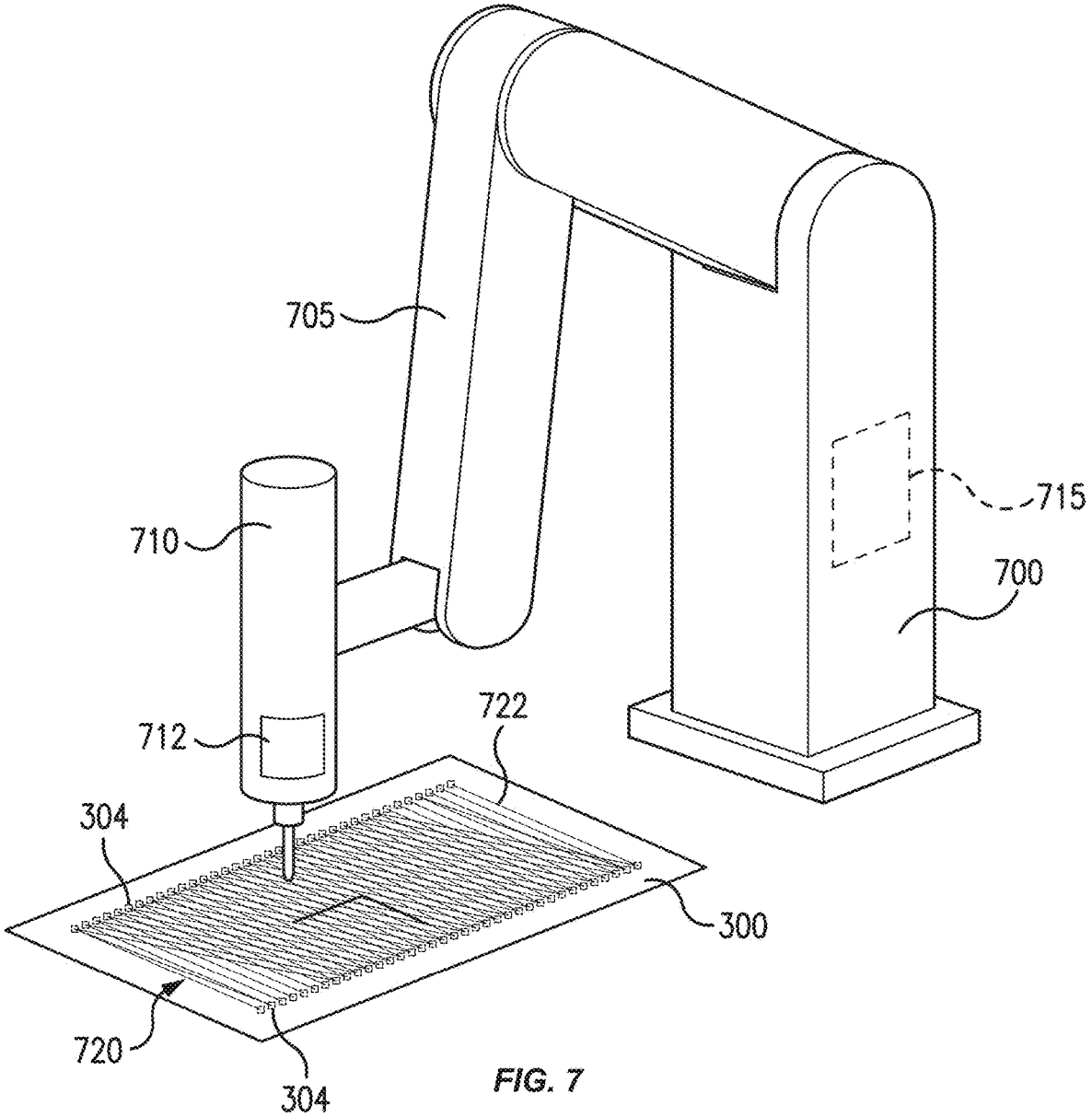
FIG. 7 shows a robotic arm for producing thread patterns according to some embodiments.

In some embodiments, a thread pattern may be wound around anchor points on a support plate (for example, pins 304 of support plate 300 or projections 606 of support plate 600) manually. In some embodiments, a thread pattern may be wound around anchor points (for example, pins 304 of support plate 300 or projections 606 of support plate 600) using an automated, computer-assisted process. FIG. 7 illustrates a CNC machine 700 including a robotic arm 705 for winding a thread pattern 720 including thread lines 722 around pins 304 on support plate 300. Thread pattern 720 in FIG. 7 is a representative exemplary thread pattern.

Robotic arm 705 may include a thread spool 710 for threading and winding thread lines 722 of thread pattern 720 around pins 304. In some embodiments, CNC machine 700 may include a thread tensioner 712 configured to apply a desired tension to thread(s) that are wound around pins 304. CNC machine 700 may include a controller 715 configured to wind a desired thread pattern 720 around pins 304 using a thread model and input data. In some embodiments, controller 715 may control tensioner 712 to wind thread(s) at desired tensions. Controller 715 may include components of computer system 3500 discussed herein.

Figure 29:
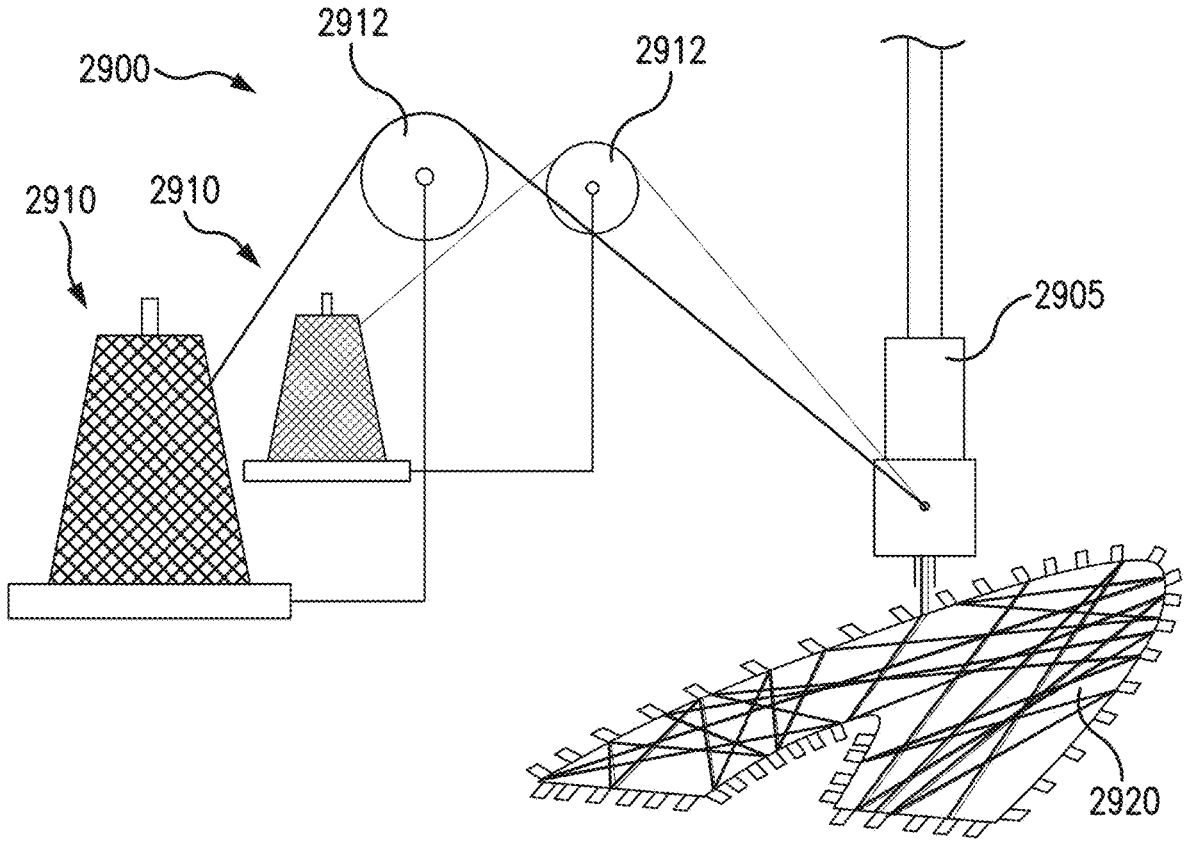
FIG. 29 shows a winding assembly according to some embodiments.

In some embodiments, CNC machine 700 may include a winding assembly including a plurality of thread spools for threading and winding a plurality of different threads for a thread pattern. FIG. 29 illustrates a winding assembly 2900 including a plurality of thread spools 2910 in connection with a robotic arm 2905 for winding a thread pattern 2920 according to some embodiments. Thread pattern 2920 in FIG. 29 is a representative exemplary thread pattern. Various thread patterns discussed herein (for example, thread pattern 122) may be wound using winding assembly 2900.

In some embodiments, winding assembly 2900 may include a plurality of tensioners 2912 configured to apply a desired tension to threads from different thread spools 2910.

In some embodiments, CNC machine 700 with winding assembly 2900 may wind a plurality of threads from a plurality of thread spools 2910 simultaneously when winding a thread pattern. In some embodiments, winding assembly 2900 may be used to simultaneously wind "overlaying thread lines" from a plurality of thread spools 2910. By simultaneously winding threads from a plurality of thread spools 2910, the speed at which a desired thread pattern can be created may be increased.

In some embodiments, CNC machine 700 may include two or more robotic arms 2905 for winding a plurality of threads simultaneously. In such embodiments, the two or more robotic arms 2905 may wind different threads in different regions of a thread pattern simultaneously.

In some embodiments, robotic arm 2905 of winding assembly 2900 may ply two or more threads from different thread spools 2910. In such embodiments, thread pattern 2920 will include one or more plied threads. As used herein, "plying" two or more threads means coupling the two or more threads together by twisting at least one of the two or more threads. In some embodiments, plying may include twisting one or more threads around one or more non-twisted threads. In some embodiments, plying may include twisting two or more threads together.

In some embodiments, arm 2905 of winding assembly 2900 may be configured to vary how two or more threads are plied as a plied thread is wound into a thread pattern. In such embodiments, arm 2905 of winding assembly 2900 may be configured to vary one or more of: (i) the number of threads plied or (ii) how tightly one or more threads is twisted. For example, arm 2905 may be configured to ply three threads for a first portion of a thread pattern and four threads for a second portion of the thread pattern. As another example, arm 2905 may be configured to tightly twist one or more threads for a first portion of a thread pattern and loosely twist one or more threads for a second portion of the thread pattern. By varying how two or more threads are plied, characteristics of a thread pattern in different portions and/or regions of the thread pattern may be varied. Exemplary characteristics that may be varied include strength, support, propulsion, breathability, comfort (stretchability), tackiness, abrasion resistance, texture, haptics, or durability.

In some embodiments, tensioners 712, 2912 may be a mechanical tensioning devices with digitally controlled impedance that is used to dynamically control how tight a thread is fed through a winding machine (for example, CNC machine 700). In some embodiments, thread may be run through tensioner 712, 2912 before it exits a thread spool, thereby giving an exact tension as it is fed out. In some embodiments, thread may be run through tensioner 712, 2912 after it exits a thread spool to give the thread a desired tension. In some embodiments, the tension value for thread can be changed dynamically by adjusting the voltage in tensioner 712, 2912. In some embodiments, tensioner 712, 2912 may be a manually adjustable tensioner. In some embodiments, tensioner 712, 2912 may include a spring configured to adjust the amount of tension applied to thread(s). The spring may be manually controlled or digitally controlled.

Adjusting the tension as the thread is wound can provide a number of benefits. With elastic threads, tensioning the threads places a preload on them, allowing them to act as if they have a different stiffness in a thread pattern. By dynamically adjusting the tension, one thread can behave with a range of stiffness, which allows for customized zones of stiffness and compliance without the need for changing thread material. This change in stiffness between different zones may be large or small. For example, high stiffness can be provided in areas where high tensioned threads are bonded together and low stiffness can be provided in areas where stretch is preferred.

In some embodiments, adjusting thread tension within a thread pattern may facilitate customization of an article of footwear for an individual, or group of individuals, by providing desired characteristics to different areas on the footwear. Moreover, tensioning may be used to customize the fit of an article of footwear. For example, when a wound thread pattern is removed from pins 304, the thread pattern may contract to an un-stretched shape, which relieves any tension in thread lines that is not fixed by bonding. This may facilitate a customized fit for an individual, or group of individuals, because the un-stretched shape may better conform with the shape of a wearer's foot. In some embodiments, tensioning and un-stretched shapes may be designed based on biometric data, such as foot volume data.

In some embodiments, tensioning of thread lines in a thread pattern may be based on a biometric data profile for an individual. In some embodiments, a biometric data profile may be collected using a physiological and personal characteristic collection and analysis system, such as a Run Genie® system. In some embodiments, the biometric data profile may be collected using the data collection and analysis system described in U.S. patent application Ser. No. 14/579,226, filed on Dec. 22, 2014, and published as US 2016/0180440, which is hereby incorporated by reference in its entirety by reference thereto.

The physiological characteristics collected may include, but are not limited to, gait characteristics, such as foot strike type (e.g. heel, midfoot, forefoot, etc.), rate of pronation or supination, and degree of pronation and supination. In some embodiments, the biometric data profile may include receiving personal information about the individual before or after receiving physiological characteristics data about the individual. Personal information may include information such as their name, prior injury information, height, weight, gender, shoe size, an athletic goal, intended athletic environment or terrain, intended athletic activity duration, intended athletic activity frequency, intended athletic activity distance, quantitative or qualitative preferences about athletic equipment or footwear (such as level of cushion, preference of weight, materials and the like), and current athletic footwear.

Figure 30:
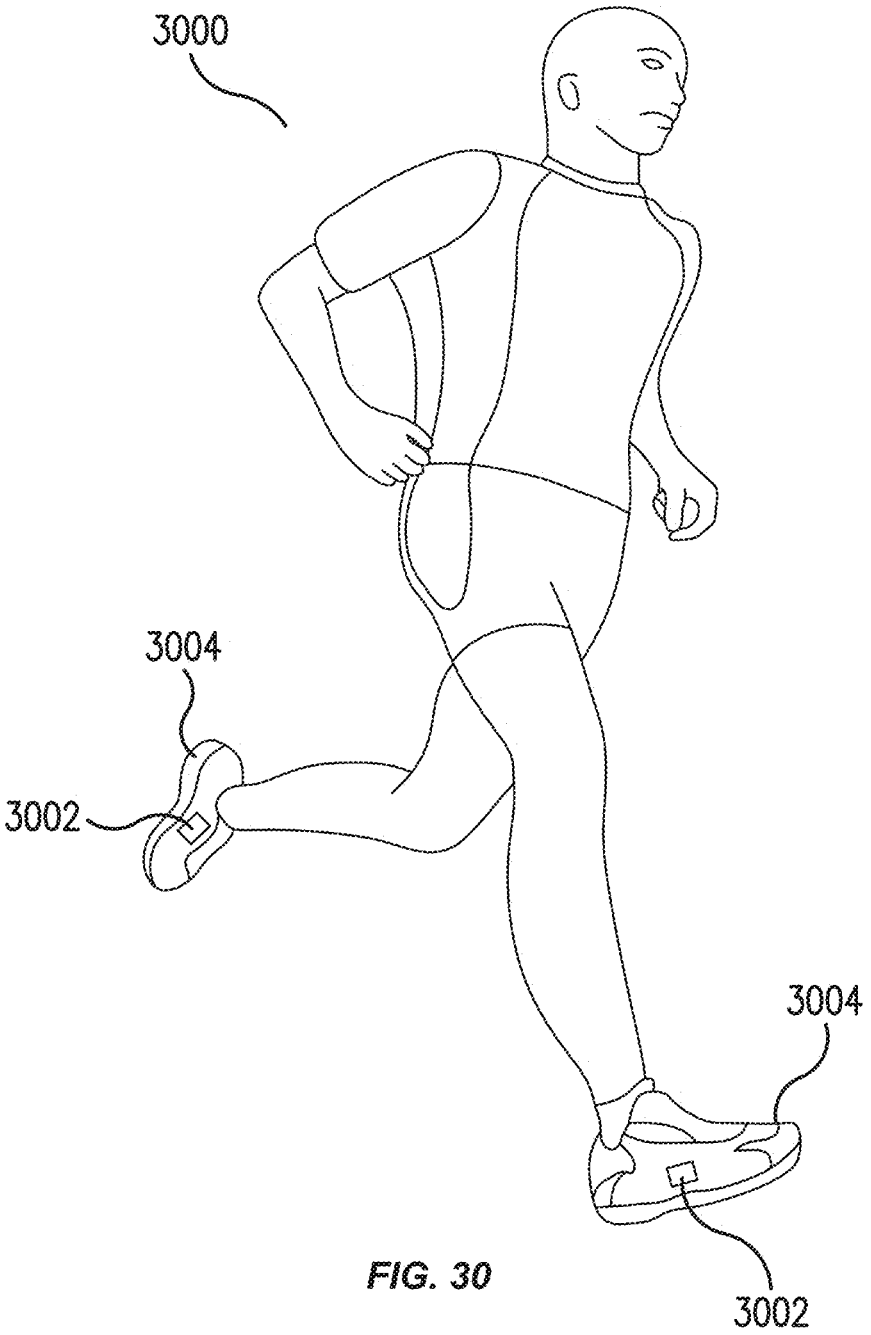
FIG. 30 is an illustration of an individual having sensor modules coupled to articles of footwear.

In some embodiments, collecting a biometric data profile may include monitoring an individual (e.g., individual 3000 shown in FIG. 30) in real time during an athletic activity, such as jogging, and collecting physiological characteristics using one or more sensor modules (e.g., modules 3002). A sensor module may include one or more sensors, and may be physically coupled to an object (e.g., article of footwear 3004) during an everyday or athletic activity conducted by an individual. A sensor module may be used to monitor changes in the spatial orientation of an individual's body or a piece of the individual's athletic equipment or article of footwear in some embodiments. A sensor module may be used in combination with predetermined correlation data stored in a data structure to determine a correlation between body or equipment or article of footwear movement data and a characteristic such as a gait characteristic in some embodiments.

In some embodiments, a sensor module is placed and/or built into an article of footwear to measure, for example, a runner's running form and gait cycle (e.g., sensor is placed on, removably attached to, or built into the heel, midsole, or toe of an article of footwear). Additional sensors/motion monitors can also be placed on the runner's knee and hip, for example, to obtain more information about the runner's running form.

A sensor module may include a plurality of sensors, including but not limited to, one or more motion sensors, such as acceleration sensors and magnetic field sensors, or angular momentum sensors. In some embodiments, a sensor module may include one or more temperature sensors, a heart rate monitoring device, a pedometer, and/or an accelerometer-based monitoring device. Sensors of a sensor module may be capable of measuring a variety of athletic performance parameters. The term "performance parameters" may include physical parameters and/or physiological parameters associated with the individual's athletic activity. Physical parameters measured may include, but are not limited to, time, distance, speed, pace, pedal count, wheel rotation count, rotation generally, stride count, stride length, airtime, stride rate, altitude, temperature, strain, impact force, jump force, force generally, and jump height. Physiological parameters measured may include, but are not limited to, heart rate, respiration rate, blood oxygen level, blood lactate level, blood flow, hydration level, calories burned, or body temperature.

An acceleration sensor may be adapted to measure the acceleration of a sensor module. Accordingly, when the sensor module is physically coupled to an object (such as an individual's 3000 body, article of footwear 3004, or other a piece of athletic equipment), the acceleration sensor may be capable of measuring the acceleration of the object, including the acceleration due to the earth's gravitational field. In some embodiments, an acceleration sensor may include a tri-axial accelerometer that is capable of measuring acceleration in three orthogonal directions. In some embodiments one, two, three, or more separate accelerometers may be used.

A magnetic field sensor may be adapted to measure the strength and direction of magnetic fields in the vicinity of a sensor module. Accordingly, when the sensor module is physically coupled to an object (such as an individual's 3000 body, article of footwear 3004, or other a piece of athletic equipment), a magnetic field sensor may be capable of measuring the strength and direction of magnetic fields in the vicinity of the object, including the earth's magnetic field. In some embodiments, a magnetic field sensor may be a vector magnetometer. In some embodiments, a magnetic field sensor may be a tri-axial magnetometer that is capable of measuring the magnitude and direction of a resultant magnetic vector for the total local magnetic field in three dimensions. In some embodiments one, two, three, or more separate magnetometers may be used.

In some embodiments, an acceleration sensor and a magnetic field sensor may be contained within a single accelerometer-magnetometer module.

An angular momentum sensor, which may be, for example, a gyroscope, may be adapted to measure the angular momentum or orientation of a sensor module. Accordingly, when the sensor module is physically coupled to an object (such as an individual's body, an article of footwear, or other athletic equipment), the angular momentum sensor may be capable of measuring the angular momentum or orientation of the object. In some embodiments, an angular momentum sensor may be a tri-axial gyroscope that is capable of measuring angular rotation about three orthogonal axes. In some embodiments one, two, three, or more separate gyroscopes may be used. In some embodiments, angular momentum sensor may be used to calibrate measurements made by one or more of an acceleration sensor and a magnetic field sensor.

A heart rate sensor may be adapted to measure an individual's heart rate. A heart rate sensor may be placed in contact with the individual's skin, such as the skin of the individual's chest, and secured with a strap. A heart rate sensor may be capable of reading the electrical activity the individual's heart.

A temperature sensor may be, for example, a thermometer, a thermistor, or a thermocouple that measures changes in the temperature. In some embodiments, a temperature sensor may primarily be used for calibration other sensors, such as, for example, an acceleration sensor and a magnetic field sensor.

In some embodiments, a sensor module may include a position receiver, such as an electronic satellite position receiver that is capable of determining its location (i.e., longitude, latitude, and altitude) using time signals transmitted along a line-of-sight by radio from satellite position system satellites. Known satellite position systems include the GPS system, the Galileo system, the BeiDou system, and the GLONASS system. In some embodiments, a position receiver may be an antenna that is capable of communicating with local or remote base stations or radio transmission transceivers such that the location of the sensor module may be determined using radio signal triangulation or other similar principles. In some embodiments, position receiver data may allow the sensor module to detect information that may be used to measure and/or calculate position waypoints, time, location, distance traveled, speed, pace, or altitude.

In some embodiments, data collected by a sensor module may classify individuals based on their running style, utilizing data analysis such as an anterior-posterior plot angle vs. time; medial-lateral plot angle vs. time; and the like. Calculations of these characteristics may be used to group individuals into different categories (groups), such as a heel striker, a midfoot striker, a forefoot striker, a pronator, supinator, a neutral individual, or some combination of characteristics. In some embodiments, gait analysis may utilize personal information of an individual, such a gender, shoe size, height, weight, running habits, and prior injuries.

In some embodiments, a regression analysis can be used to determine gait characteristics such as foot strike type, rate of pronation, degree of pronation, and the like based on acceleration data obtained from a sensor module. In some embodiments, the regression analysis can be used to determine gait characteristics such as foot strike type, rate of pronation, degree of pronation, and the like based on other data such as magnetometer data, angular momentum sensor data, or multiple types of data. In some embodiments, the analysis can include other user-input information such as prior injury information, an athletic goal, intended athletic environment or terrain, intended athletic duration, and current athletic footwear.

Athletic goals may be, for example, training for a race, to stay healthy, to lose weight, and training for sports. Other examples of athletic goals may include training for a race, or other sporting event, improving individual fitness, simply enjoy running, or the like. Frequency intervals may include for example about 1 to 2 times per week, about 3 to 4 times per week, about 5 to 7 times per week, or the individual doesn't know. Length intervals may include for example about less than about 5 miles per week, about 5 to 10 miles per week, about 10 to 20 miles per week, greater than about 20 miles per week, or the individual doesn't know. Examples of intended athletic terrain environments may include roads, track, treadmill, trail, gym, or particular athletic fields designed for a specific sport. Examples of athletic equipment preferences may include for example more cushioning, less weight, better fit, strength, durability, intended athletic activity range, balance, weight balance, more color choices, and the like.

In some embodiments, information from sensor module(s) may be used to map areas of an individual's foot subject to different pressures or stresses. And information from sensor module(s) may be used to generate a biometric date profile map. For example, high stress areas may be associated with a heel portion, areas corresponding to the location of the ball of an individual's foot (i.e., at a position corresponding to a location near the anterior end of metatarsals), and a medial most portion of the individual's arch. Mild stress areas may be associated with a medial portion of the individual's arch and areas corresponding to the location of an individual's phalanges. And low stress areas may be associated with a lateral portion of the individual's arch. The size, location, and degree of stress areas for an individual will depend on, among other things, the anatomy of the individual's foot and the individual's gait.

In some embodiments, collecting a biometric data profile may include obtaining previously collected and stored data for an individual. In some embodiments, collecting biometric data may include obtaining a standard biometric data profile for a group of individuals. For example, a standard profile for individuals having a certain shoe size, weight, height, arch shape, stability characteristic, and/or touchdown characteristic may be retrieved. In some embodiments, the standard biometric data profile for a group of individuals may be modified for a particular individual based on personal information about the individual. Personal information may include information such as, prior injury information, height, weight, gender, shoe size, an athletic goal, intended athletic environment or terrain, intended athletic activity duration, intended athletic activity frequency, intended athletic activity distance, quantitative or qualitative preferences about athletic equipment or footwear (such as level of cushion, preference of weight, materials and the like), and current athletic footwear.

Figure 8A:
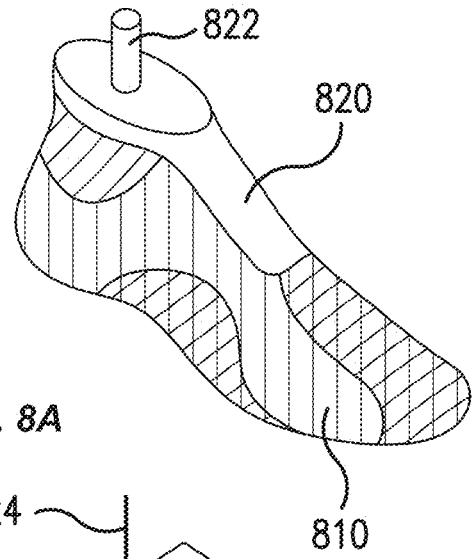
FIGS. 8A-8C show an exemplary process for three-dimensionally thermo-molding an upper according to some embodiments.
Figure 8B:
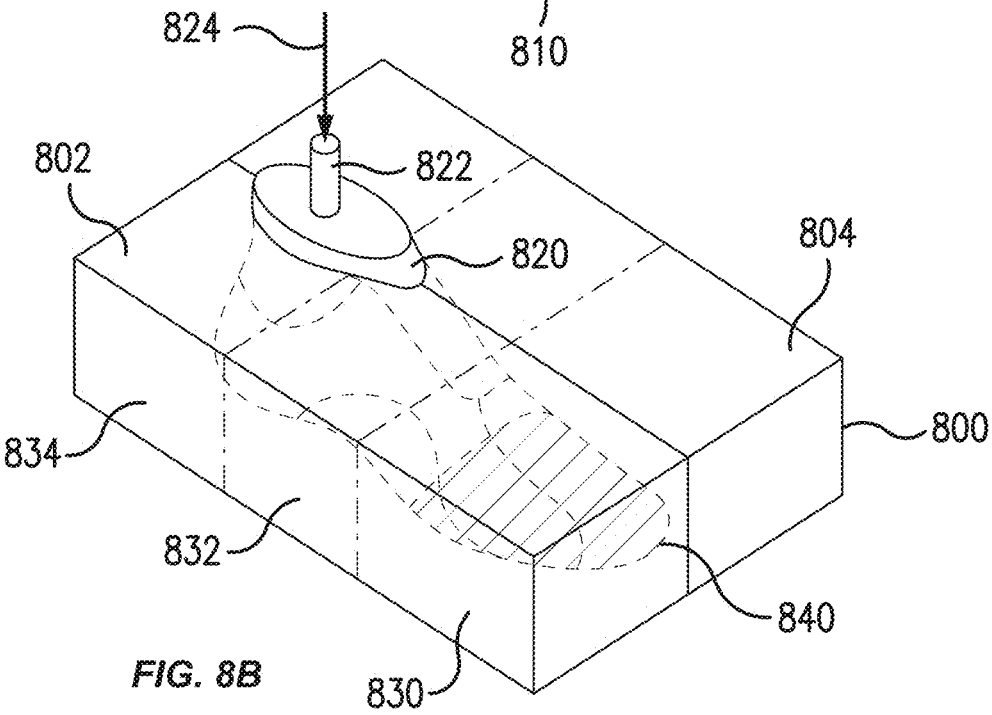
Figure 8C:
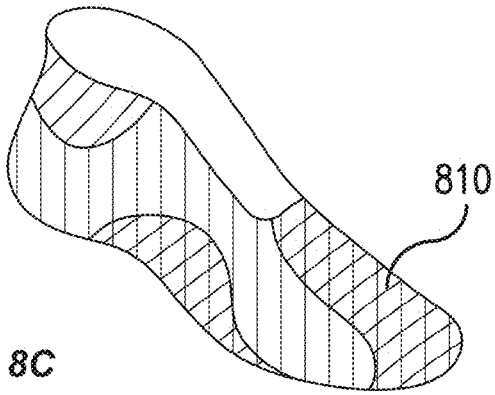
Figure 9:
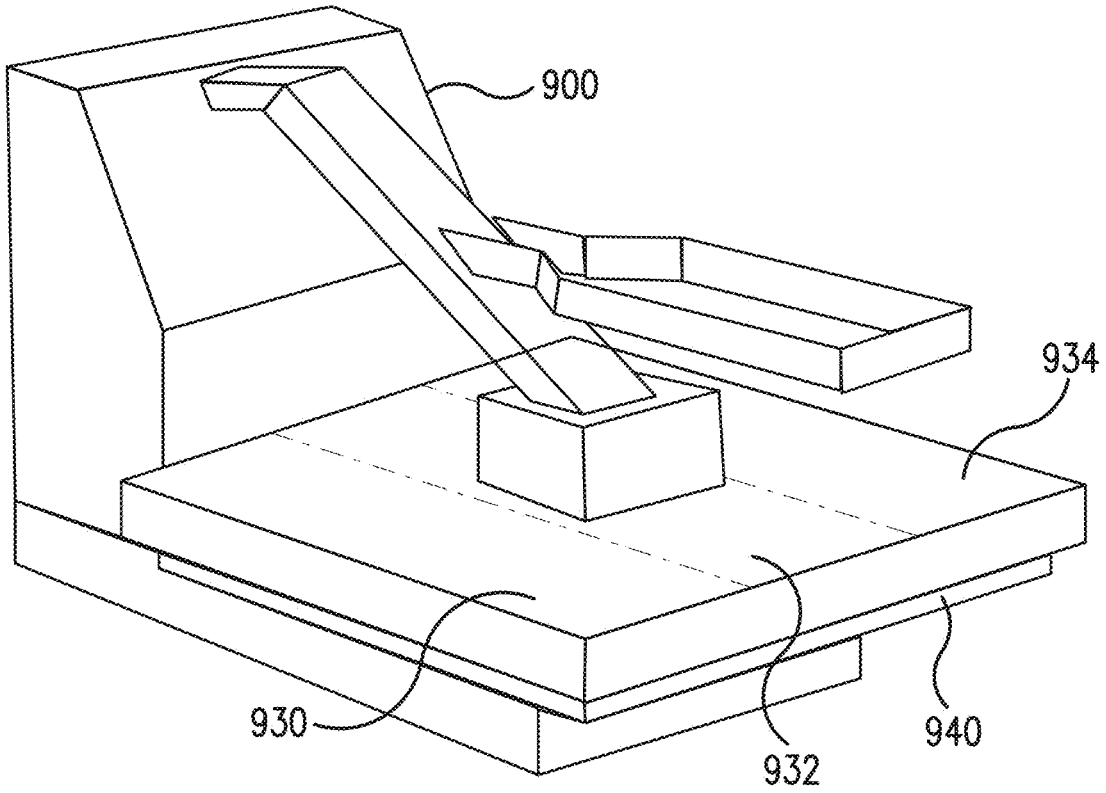
FIG. 9 shows a heat press according to some embodiments.

FIGS. 8A-9 illustrate exemplary apparatuses for bonding continuous thread(s) of a thread pattern at locations of anchor points and/or intersection points between thread lines. In some embodiments, bonding of continuous thread(s) for a thread pattern may set the thread pattern such that the pattern forms a portion of an upper for an article of footwear. In some embodiments, bonding of continuous thread(s) for a thread pattern may set the thread pattern so that the pattern can shaped into a structure that forms a portion of an upper for an article of footwear. In some embodiments, after bonding of continuous thread(s) for a thread pattern, the thread pattern may be cut to define a shape utilized to form a portion of an upper for an article of footwear. For example, in some embodiments, a thread pattern may be cut to define a perimeter shape for a portion of an upper for an article of footwear. As another example, in some embodiments, a thread pattern may be cut to define a shape for at least one of a biteline, a collar, or a throat of an upper for an article of footwear.

FIGS. 8A-8C show an exemplary process and mold for three-dimensionally thermo-molding a thread pattern according to some embodiments according to some embodiments. As shown, in FIGS. 8A and 8B, a mold 800 may be assembled around a thread pattern 810 on an inflatable bladder 820. For example, thread pattern 810 and inflatable bladder 820 may be inserted into the mold cavity of mold 800.

In some embodiments, a connector 822 may be coupled to inflatable bladder 820. Connector 822 may include a first end coupled to inflatable bladder 820 and a second end configured to couple with a pressure conduit for delivering pressurized air 824 from a pressure source. In some embodiments, connector 822 may include a pressure valve for regulating the pressure of pressurized air 824 pumped into inflatable bladder 820.

In some embodiments, the mold cavity of mold 800 and/or thread pattern 810 may be coated with a non-stick material, such as but not limited to a silicone spray, to reduce potential adhesion between thread pattern 810 and the mold cavity during forming. Before or after thread pattern 810 and inflatable bladder 820 are inserted into the mold cavity, mold 800 may be heated to a predetermined temperature. The temperature of mold 800 may be such that it softens polymer thread(s) of thread pattern 810 to allow thread lines of thread pattern 810 to directly bond to each other. In some embodiments, thread pattern 810 may take on the shape of an upper for an article of footwear in mold 800.

In some embodiments, the predetermined temperature may be equal to or above the melting point of polymeric material(s) of polymer thread(s) of thread pattern 810. In some embodiments, the predetermined temperature may be below the melting point of the polymeric material(s), but high enough to cause the polymeric material(s) to bond (fuse) together, or to other materials of thread pattern 810. In some embodiments, the predetermined temperature may be 180 degrees C. or less. In some embodiments, the predetermined temperature may be in the range of 80 degrees C. to 180 degrees C. In some embodiments, the predetermined temperature may be 160 degrees C. or less. In some embodiments, the predetermined temperature may be in the range of 65 degrees C. to 160 degrees C. In some embodiments, the predetermined temperature may be selected such that polymeric material(s) of polymer thread(s) of thread pattern 810 undergo no chemical reactions during thermo-forming.

In some embodiments, the polymer thread(s) of thread pattern 810 may be bonded at a temperature that creates little to no volatile substances (for example, vapors created by chemical reactions such as those created during curing of a polymer). In some embodiments, the bonding of polymer thread(s) of thread pattern 810 may not cause a change in the chemical composition of the polymeric material(s) of the polymer thread(s). The use of low processing temperatures may reduce manufacturing cost and may reduce environmental impact of a manufacturing process by reducing the release of volatile substances. Further, a manufacturing process that does not rely on the occurrence of chemical reactions may result in a manufacturing process that is easier to control and reproduce. In some embodiments, the temperature used to bond polymer thread(s) of thread pattern 810 may be greater than the softening point temperature of the polymeric material(s) of the polymer thread(s). The softening point temperature of a polymer may be measured using a Vicat softening point test.

In some embodiments, the predetermined temperature may be greater than 180 degrees C. In some embodiments, the predetermined temperature may be in a range of 180 degrees C. to 320 degrees C., including subranges. For example, the predetermined temperature may be 200 degrees C. to 300 degrees C., 220 degrees C. to 280 degrees C., 240 degrees C. to 260 degrees C., or within a range having any two of these valves as endpoints. In some embodiments, the predetermined temperature may be in a range of 65 degrees C. to 320 degrees C.

In some embodiments, after heating mold 800, inflatable bladder 820 may be expanded to press thread pattern 810 against the interior surface of the mold cavity defined by a medial mold plate 802 and lateral mold plate 804 of mold 800. In some embodiments, inflatable bladder 820 may be expanded to press thread pattern against the interior surface of the mold cavity defined by a medial mold plate 802 and lateral mold plate 804 of mold 800, and after expanding inflatable bladder, mold 800 may be heated. In either case, the combination of pressure and heat can cause thread pattern 810 to take on the shape of the interior surface of the mold cavity, thereby taking on the shape of an upper for an article of footwear. In some embodiments, inflating inflatable bladder 820 may press thread pattern 810 in direct contact with the interior surface of the mold cavity.

Heat may be applied to mold 800 in one or more ways, such as but not limited to, radio frequency heating, high frequency heating, and infrared heating. Heat transfer between thread pattern 810 and mold 800 may be via conduction and/or convection.

In some embodiments, heat may be uniformly applied to thread pattern 810 within mold 800. In such embodiments, the temperature at which thread pattern 810 is bonded within mold 800 may be substantially the same across all portions of thread pattern 810. For example, heat may be uniformly applied to forefoot, midfoot, and heel portions of thread pattern 810 in forefoot portion 830, midfoot portion 832, and heel portion 834 of mold 800.

In some embodiments, heat may be non-uniformly applied to thread pattern 810 within mold 800. In such embodiments, the temperature at which thread pattern 810 is bonded within mold 800 may be different for different portions and/or regions of thread pattern 810. For example, in some embodiments, heat may be non-uniformly applied to two or more of forefoot, midfoot, and heel portions of thread pattern 810 in forefoot portion 830, midfoot portion 832, and heel portion 834 of mold 800. In such embodiments, thread pattern 810 may be heated to a first temperature in one of the portions and heated to a second temperature in another one of the portions. As another example, in some embodiments, heat may be non-uniformly applied to medial and lateral sides of thread pattern 810 in medial mold plate 802 and lateral mold plate 804 of mold 800. In such embodiments, a medial side of thread pattern 810 may be heated to a first temperature and a lateral side of thread pattern 810 may heated to a second temperature.

In some embodiments, heat may be non-uniformly applied to two or more of a medial forefoot region, a lateral forefoot region, a medial midfoot region, a lateral midfoot region, a medial heel region, and a lateral heel region of thread pattern 810 in mold 800. For example, thread pattern 810 may be heated to a first temperature in forefoot portion 830 of medial mold plate 802 and heated to a second temperature in forefoot portion 830 of lateral mold plate 804.

By varying the bonding temperature of different portions and/or regions of thread pattern 810, characteristics of thread pattern 810 in different portions and/or regions may be varied. Exemplary characteristics that may be varied include strength, support, propulsion, breathability, comfort (stretchability), tackiness, abrasion resistance, texture, haptics, and durability. Variable heating can control the variation in one or more of these characteristics by controlling one or more of: (i) the degree of melting or softening of a polymeric material in thread pattern 810, (ii) the degree of bonding at intersection points between thread lines in thread pattern 810, (iii) the activation of activatable agents or coatings and/or active threads in thread pattern 810, and (iv) in embodiments including a thread pattern 810 with a plurality of thread layers, the degree of bonding between layers of thread pattern 810.

In some embodiments, a first bonding temperature within mold 800 may be +/−10 degrees C. or more different from a second bonding temperature.

In some embodiments, the heat applied to thread pattern 810 may be controlled by controlling heat applied to mold 800. In some embodiments, the heat applied to thread pattern 810 may be additionally or alternatively controlled by one or more inserts 840 disposed between the interior surface of mold 800 and thread pattern 810. In such embodiments, insert(s) 840 may control the heat applied to thread pattern 810 by controlling the heat transfer between mold 800 and thread pattern 810. In some embodiments, insert(s) 840 may serve to uniformly distribute heat across all or a portion of thread pattern 810. In some embodiments, insert(s) 840 may serve to vary the bonding temperature of different portions and/or regions of thread pattern 810.

In some embodiments, insert(s) 840 may be composed of a polymeric material. In some embodiments, insert(s) 840 may be composed of a polymeric foam material. Exemplary polymeric and polymeric foam materials include, but are not limited to, silicone, ethyl vinyl acetate (EVA), polyurethane (PU), expanded thermoplastic polyurethane (eTPU), a thermoplastic polyurethane (TPU), an EVA-based foam or a PU-based foam. In some embodiments, insert(s) 840 may be composed of a ceramic or a metal. In some embodiments, the material of insert(s) 840 may have a melting temperature higher than the melting temperature of the polymeric material(s) of thread pattern 810. In some embodiments, the material of insert(s) 840 may have a melting temperature higher than the highest temperature applied to mold 800 during bonding of thread pattern 810.

In some embodiments, the material of insert(s) 840 may additionally or alternatively serve to control the amount of pressure applied to thread pattern 810 in mold 800. In some embodiments, insert(s) 840 may serve to vary the pressure applied to different portions and/or regions of thread pattern 810 in mold 800. In such embodiments, by varying the pressure applied to different portions and/or regions of thread pattern 810, characteristics of thread pattern 810 in different portions and/or regions may be varied. Variable pressure can control the variation in one or more characteristics of thread pattern 810 by controlling one or more of: (i) the degree of melting or softening of a polymeric material in thread pattern 810, (ii) the degree of bonding at intersection points between thread lines in thread pattern 810, and (iii) in embodiments including a thread pattern 810 with a plurality of thread layers, the degree of bonding between layers of thread pattern 810.

In some embodiments, the hardness and/or density of a material for an insert 840 may be used to tailor the amount of pressure applied to thread pattern 810 in mold 800. In some embodiments, a plurality of inserts 840 made of materials with different hardness and/or densities may be used to vary the amount of pressure applied to different portions and/or regions of thread pattern 810 in mold 800. In some embodiments, an insert 840 may include regions with different hardness and/or density for varying the amount of pressure applied to different portions and/or regions of thread pattern 810 in mold 800.

In some embodiments, the interior surface of mold 800 and/or insert(s) 840 may include one or more cavities configured to control the amount of heat and/or pressure applied to different portions and/or regions of thread pattern 810 in mold 800. In some embodiments, a cavity may serve to prevent bonding of threads in one or more portions or regions of thread pattern 810.

In some embodiments, insert(s) 840 may be a textured insert including a plurality of regions with different textures and/or elevations. For example, an insert 840 may include textured regions as described herein for textured sheet 1600.

In some embodiments, different amounts of heat may be uniformly or non-uniformly applied to thread pattern 810 within mold 800 in separate heating steps. In such embodiments, the separate heating steps may serve to selectively soften, melt, and/or activate particular threads within thread pattern 810. For example, a first heating step may soften or melt the polymeric material of a first thread within thread pattern 810 and a second heating step may soften or melt the polymeric material of a second thread within thread pattern 810. As another example, a first heating step may soften or melt the polymeric material of a first thread within thread pattern 810 and a second heating step may activate an activatable agent of a second thread within thread pattern 810.

In some embodiments, after pressing thread pattern 810 against the interior surface of the mold cavity of mold 800 and heating thread pattern 810, bladder 820 may be deflated and thread pattern 810 may be removed from the mold cavity to cool. In some embodiments, after pressing thread pattern 810 against the interior surface of the mold cavity of mold 800 and heating thread pattern 810, thread pattern 810 may be cooled while thread pattern 810 remains in the mold cavity. In some embodiments, mold 800 may be cooled while thread pattern 810 remains in the mold cavity, thereby cooling thread pattern 810. In some embodiments, thread pattern 810 may be cooled while thread pattern 810 is pressed against the interior surface of the mold cavity. In some embodiments, mold 800 may be cooled while thread pattern 810 is pressed against the interior surface of the mold cavity, thereby cooling thread pattern 810.

In some embodiments, thread pattern 810 within mold 800 may be cooled to a temperature below the crystallization temperature of the polymeric material(s) of polymer thread(s) of thread pattern 810. Cooling of thread pattern 810 within mold 800, and thus the polymeric material(s) of polymer thread(s), to a temperature below the crystallization temperature of the polymeric material(s) can facilitate bonding of thread lines of thread pattern together at intersection points and/or anchor points.

In some embodiments, the mold cavity of mold 800 may be sized and shaped for a particular foot type and size (i.e., length and width). In some embodiments, mold 800 may be a customized mold including a customized interior mold cavity surface. In some embodiments, mold 800 may be customized for a particular individual. In some embodiments, mold 800 may include a mold cavity created by digitally scanning a human foot. In some embodiments, mold 800 may include a customized mold cavity created by digitally scanning an individual's foot. In some embodiments, an individual's foot may be scanned using a CREAFORM Go!SCAN 3D scanner, Serial No: 570489, manufactured by Ametek Ultra Precision Technologies.

When bonding polymer thread(s) of a thread pattern to thermo-form uppers for footwear as discussed herein, only mold(s) 800 may need to be interchanged to form different sizes, shapes, and/or types of uppers. The interchangeability and modularity of molds may reduce manufacturing costs by reducing the number of parts that need to changed/adjusted when forming uppers for different articles of footwear. Reducing the parts that need to changed/adjusted when forming uppers for different articles of footwear may facilitate the use of an automated process for thermo-forming uppers for articles of footwear. Further, it may facilitate cost-effective manufacturing of customized uppers.

As shown for example in FIG. 8C, after polymer thread(s) of thread pattern 810 are bonded, inflatable bladder 820 may be deflated and an upper-shaped material defined by thread pattern 810 may be removed from the mold cavity. In some embodiments, excess material may be removed (for example, cut) from thread pattern 810 to define edges of an upper. In some embodiments, excess material may be removed after cooling thread pattern 810. In some embodiments, edges of bonded thread pattern 810 may be folded and/or sown at a seam (e.g., a seam 163) to define edges of an upper.

FIG. 9 shows a heat press 900 according to some embodiments. Heat press 900 may apply pressure and heat to a thread pattern (for example, thread pattern 122) to bond continuous thread(s) of a thread pattern at locations of anchor points and/or intersection points between thread lines. In some embodiments, heat press 900 may provide heat at a predetermined temperature equal to or above the melting point of polymeric material(s) of polymer thread(s) of a thread pattern. In some embodiments, heat press 900 may provide heat at a predetermined temperature below the melting point of polymeric material(s) of polymer thread(s) of a thread pattern, but high enough to cause the polymeric material(s) to bond (fuse) together, or to other materials of the thread pattern.

The temperature used to bond continuous thread(s) of a thread pattern with heat press 900 may be the same as or similar to the temperatures discussed herein for three-dimensionally thermo-molding a thread pattern. In some embodiments, the predetermined temperature may be 180 degrees C. or less. In some embodiments, the predetermined temperature may be in the range of 180 degrees C. to 80 degrees C. In some embodiments, the predetermined temperature may be 160 degrees C. or less. In some embodiments, the predetermined temperature may be in the range of 160 degrees C. to 65 degrees C. In some embodiments, the predetermined temperature may be such that polymeric material(s) of polymer thread(s) of thread pattern 810 undergo no chemical reactions during heating.

Heat may be applied to a thread pattern in heat press 900 in one or more ways, such as but not limited to, radio frequency heat sealing (welding), high frequency heat sealing (welding), infra-red welding, and steaming. Heat transfer between a thread pattern and heat press 900 may be via conduction and/or convection. In some embodiments, heat may be applied to a single outer surface of a thread pattern in heat press 900. In some embodiments, heat may be applied to both outer surfaces of a thread pattern in heat press 900.

In some embodiments, heat may be uniformly applied a thread pattern within heat press 900. In such embodiments, the temperature at which a thread pattern is bonded within heat press 900 may be substantially the same across all portions of the thread pattern. For example, heat may be uniformly applied to forefoot, midfoot, and heel portions of a thread pattern in forefoot portion 930, midfoot portion 932, and heel portion 934 of heat press 900.

In some embodiments, heat may be non-uniformly applied to a thread pattern within heat press 900. In such embodiments, the temperature at which a thread pattern is bonded within heat press 900 is different for different portions and/or regions of the thread pattern. For example, in some embodiments, heat may be non-uniformly applied to two or more of forefoot, midfoot, and heel portions of a thread pattern in forefoot portion 930, midfoot portion 932, and heel portion 934 of heat press 900. In such embodiments, a thread pattern may be heated to a first temperature in one of the portions and heated to a second temperature in another one of the portions. As another example, in some embodiments, heat may be non-uniformly applied to medial and lateral sides of a thread pattern in heat press 900. In such embodiments, a medial side of a thread pattern may be heated to a first temperature and a lateral side of the thread pattern may heated to a second temperature.

In some embodiments, heat may be non-uniformly applied to two or more of a medial forefoot region, a lateral forefoot region, a medial midfoot region, a lateral midfoot region, a medial heel region, and a lateral heel region of a thread pattern in heat press 900. For example, a thread pattern may be heated to a first temperature in a medial side of forefoot portion 930 of heat press 900 and heated to a second temperature in a lateral side of forefoot portion 930 of heat press 900.

By varying the bonding temperature of different portions and/or regions of a thread pattern in heat press 900, characteristics of the thread pattern in different portions and/or regions may be varied as described above in connection with thread pattern 810 and mold 800.

In some embodiments, a first bonding temperature within heat press 900 may be +/−10 degrees C. different from a second bonding temperature.

In some embodiments, the heat applied to a thread pattern may be controlled by controlling heat applied to heat press 900. In some embodiments, the heat applied to a thread pattern may be additionally or alternatively controlled by one or more inserts 940 disposed between an interior surface of heat press 900 and the thread pattern. In such embodiments, insert(s) 940 may control the heat applied to a thread pattern by controlling the heat transfer between heat press 900 and the thread pattern. In some embodiments, insert(s) 940 may serve to uniformly distribute heat across all or a portion of a thread pattern within heat press 900. In some embodiments, insert(s) 940 may serve to vary the bonding temperature of different portions and/or regions of a thread pattern in heat press 900.

Insert(s) 940 for heat press 900 may be the same or similar to insert(s) 840. In some embodiments, the material of insert(s) 940 may serve to control the amount of pressure applied to a thread pattern in heat press 900. In some embodiments, insert(s) 940 may serve to vary the pressure applied to different portions and/or regions of a thread pattern in heat press 900. In such embodiments, by varying the pressure applied to different portions and/or regions of a thread pattern, characteristics of the thread pattern in different portions and/or regions may be varied as described above in connection with thread pattern 810 and mold 800.

In some embodiments, an interior surface of heat press 900 and/or insert(s) 940 may include one or more cavities configured to control the amount of heat and/or pressure applied to different portions and/or regions of a thread pattern in heat press 900. In some embodiments, a cavity may serve to prevent bonding of threads in one or more portions or regions of a thread pattern.

In some embodiments, insert(s) 940 may be a textured insert including a plurality of regions with different textures and/or elevations. For example, an insert 940 may include textured regions as described herein for textured sheet 1600.

In some embodiments, different amounts of heat may be uniformly or non-uniformly applied to a thread pattern within heat press 900 in separate heating steps. In such embodiments, the separate heating steps may serve to selectively soften, melt, and/or activate particular threads of a thread pattern within heat press 900. For example, a first heating step may soften or melt the polymeric material of a first thread within a thread pattern and a second heating step may soften or melt the polymeric material of a second thread within the thread pattern. As another example, a first heating step may soften or melt the polymeric material of a first thread within a thread pattern and a second heating step may activate an activatable agent of a second thread within the thread pattern.

In some embodiments, after applying heat and pressure to the thread pattern in heat press 900, the thread pattern may be removed from heat press 900 to cool. In some embodiments, after applying heat and pressure to the thread pattern in heat press 900, the thread pattern may be removed from heat press 900 and placed in a cold press to cool. In some embodiments, after applying heat and pressure to the thread pattern in heat press 900, the thread pattern may be cooled while the thread pattern remains within heat press 900. In some embodiments, heat press 900 may be cooled while the thread pattern remains within heat press 900, thereby cooling the thread pattern.

In some embodiments, the thread pattern within heat press 900 may be cooled to a temperature below the crystallization temperature of the polymeric material(s) of polymer thread(s) of the thread pattern. In some embodiments, the thread pattern within a cold press may be cooled to a temperature below the crystallization temperature of the polymeric material(s) of polymer thread(s) of the thread pattern. Cooling of the thread pattern, and thus the polymeric material(s) of polymer thread(s), to a temperature below the crystallization temperature of the polymeric material(s) can facilitate bonding of thread lines thread pattern together at intersection points and/or anchor points.

In some embodiments, after heat pressing a thread pattern, excess material may be removed (for example, cut) from the patterned material to define the edges of the patterned material. In some embodiments, excess material may be removed after cooling the thread pattern. In some embodiments, edges of a thread pattern bonded in heat press 900 may be folded and/or sown at a seam (e.g., a seam 163) to define edges of an upper.

In some embodiments, continuous thread(s) of a thread pattern may be bonded by pressing a thread pattern against the outer surface of an object configured to provide a desired shape to the thread pattern and heating the thread pattern to impart the desired shape. In some embodiments, the object may be a last.

Figure 31:
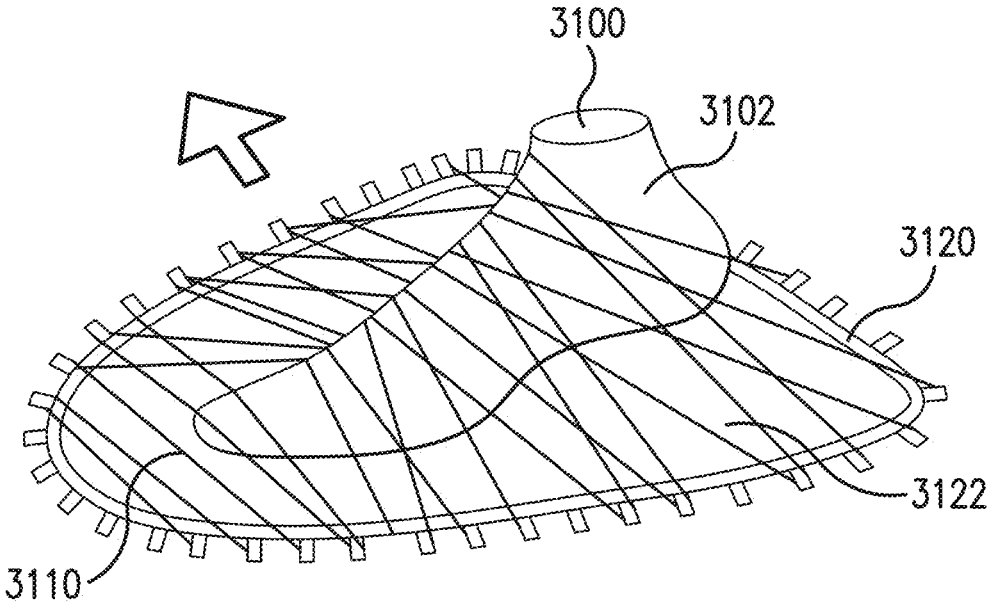
FIG. 31 illustrates a method of pressing a thread pattern against an object according to some embodiments.

FIG. 31 illustrates a method of pressing a thread pattern 3110 against a last 3100 such that thread pattern 3110 conforms to the outer shape of last 3100. Thread pattern 3110 in FIG. 31 is a representative exemplary thread pattern. Various thread patterns discussed herein (for example, thread pattern 122) may bonded by pressing the thread pattern against last 3100.

In some embodiments, thread pattern 3110 may be wound around a hollow support plate 3120 with anchor points 3124 so that last 3100 can be inserted through an opening 3122 in hollow support plate 3120. In such embodiments, inserting last 3100 through opening 3122 serves to press thread pattern 3110 against an outer surface 3102 of last 3100.

After pressing thread pattern 3110 against last 3100, thread pattern 3110 may be heated while disposed over last 3100 to bond continuous thread(s) of thread pattern 3110. In some embodiments, heat may be applied by placing thread pattern 3110 and last 3100 within a heated environment, such as an oven. In some embodiments, heat may be applied to thread pattern 3110 using a mold plate configured to press thread pattern 3110 against last 3100. In some embodiments, heat may be applied to thread pattern 3110 by heating last 3100.

The temperature(s) at which thread pattern 3110 is bonded may be the same as those described above in connection with mold 800 and heat press 900. Similarly, heat and/or pressure may be applied to thread pattern 3110 uniformly or non-uniformly as described above in connection with mold 800 and heat press 900.

In some embodiments, a thread pattern may include one or more continuous threads with a plurality of thread lines extending tangential to an edge of the thread pattern. The edge may be, for example, a perimeter edge of a thread pattern, a perimeter edge of an opening in a thread pattern, and/or a perimeter boundary of a functional zone in a thread pattern.

In some embodiments, a thread pattern may include one or more continuous threads with a plurality of thread lines extending tangential to a perimeter edge of the thread pattern. By threading thread lines tangential to a perimeter edge, the thread pattern can define the perimeter edge. In some embodiments, threading thread lines tangential to a perimeter edge can provide strength at the perimeter edge. In some embodiments, threading thread lines tangential to a perimeter edge can provide stretchability at the perimeter edge. The material(s) of thread lines extending tangential to a perimeter edge can influence the strength and/or stretchability provided at the perimeter edge. In some embodiments, the perimeter edge may define an opening in the thread pattern.

In some embodiments, threading thread lines tangential to a perimeter edge can provide a bonding or attachment surface near the perimeter edge for bonding or attaching another footwear component, such as but not limited to, a sole, a collar element, a throat element, a heel counter, or a toe box element. In some embodiments, the edge may be an edge that defines a part of a seam at which the thread pattern is attached to another footwear component.

In some embodiments, a thread pattern may include one or more continuous threads with a plurality of thread lines extending tangential to a perimeter boundary of a functional zone in the thread pattern. A "functional zone" is a zone of the thread pattern designed to provide one or more zonal characteristics to a particular zone on the thread pattern. Exemplary zonal characteristics include, but are not limited to, strength, breathability, stretchability, texture, tackiness, or abrasion resistance. One or more zonal characteristics of a functional zone are different from the characteristics of the thread pattern adjacent the functional zone. In some embodiments, a functional zone may delineate different features of an upper including the thread pattern. For example, a functional zone may delineate a toe box or a heel counter of an upper including the thread pattern.

In some embodiments, a functional zone may be defined by a region of the thread pattern bounded by the perimeter boundary. In some embodiment, a functional zone may be defined by a region adjacent to the perimeter boundary. In such embodiments, the functional zone may include a region on a thread pattern at perimeter boundary and immediately adjacent to the perimeter boundary where a relatively high density of thread lines is present.

In some embodiments, winding thread lines tangential to a perimeter boundary of a functional zone may be used to create an increased thickness at the perimeter boundary. In some embodiments, the increased thickness may create a bump or similar feature at the perimeter boundary. In some embodiments, the increased thickness may create a bump or similar feature designed to provide desired aesthetics and/or texture. In some embodiments, the increased thickness may create a bump or similar feature designed to provide increased strength at the perimeter boundary. For example, the bump may provide increased strength for an eyestay reinforcement region on the thread pattern. In some embodiments, the increased thickness may create a bump or similar feature designed to provide increased cushioning at the perimeter boundary.

In some embodiments, a thread pattern may include one or more continuous threads with a plurality of thread lines extending tangential to an opening located in the thread pattern. By threading thread lines tangential to an opening, the thread pattern can define the opening. In some embodiments, threading thread lines tangential to an opening can provide strength at a perimeter of the opening. In some embodiments, threading thread lines tangential to an opening can provide stretchability at a perimeter of the opening. In some embodiments, stretchability at an opening may be desirable for an opening defining the throat and/or collar of an article of footwear. In such embodiments, stretchability at the throat and/or collar may increase the ease of entry for a wearer's foot into an upper including the thread pattern. In some embodiments, threading thread lines tangential to an opening can provide a bonding or attachment surface near a perimeter of the opening for bonding or attaching another footwear component. In some embodiments, the opening may define a portion of a seam for bonding or attaching a footwear component to a thread pattern.

In some embodiments, methods of making an upper for an article of footwear may include defining a plurality of anchor points (for example, anchor points 1010), defining a boundary line, and winding a continuous thread around the plurality of anchor points such that the continuous thread includes a set of thread lines, with each thread line in the set extending between two respective anchor points and tangential to the boundary line. The boundary line may be a perimeter edge of a thread pattern, a perimeter boundary for a functional zone in a thread pattern, or a perimeter of an opening in a thread pattern. In the examples described below, thread lines extending tangential to the boundary line are described below as "opening-tangential thread lines." In embodiments including a boundary line defining a perimeter edge for a thread pattern or a perimeter boundary for a functional zone, the thread lines extending tangential to the boundary line may be referred to as "edge-tangential thread lines" or "zone-tangential thread lines."

In some embodiments, after winding the continuous thread, the method may include bonding the continuous thread at points of intersection between two or more the wound thread lines as discussed herein.

Any of the embodiments of thread pattern 1000 described herein may be created by winding a continuous thread around anchor points as described herein. In some embodiments, the boundary line to which thread lines extend tangentially may be a perimeter edge of an opening in a thread pattern. In some embodiments, the boundary line to which thread lines extend tangentially may be a perimeter edge of a thread pattern. In some embodiments, the boundary line to which thread lines extend tangentially may be boundary line for a functional zone in a thread pattern. For example, as described below, the boundary line may be perimeter edge 1004 or secondary perimeter edge 1009. In some embodiments, a boundary line may have a curved shape. For example, the boundary line may have circular shape or an elliptical shape. The shape of an opening in a thread pattern, a perimeter edge of a thread pattern, or a functional zone in a thread pattern may be defined by the shape of a boundary line to which thread lines extend tangentially.

Figure 10A:
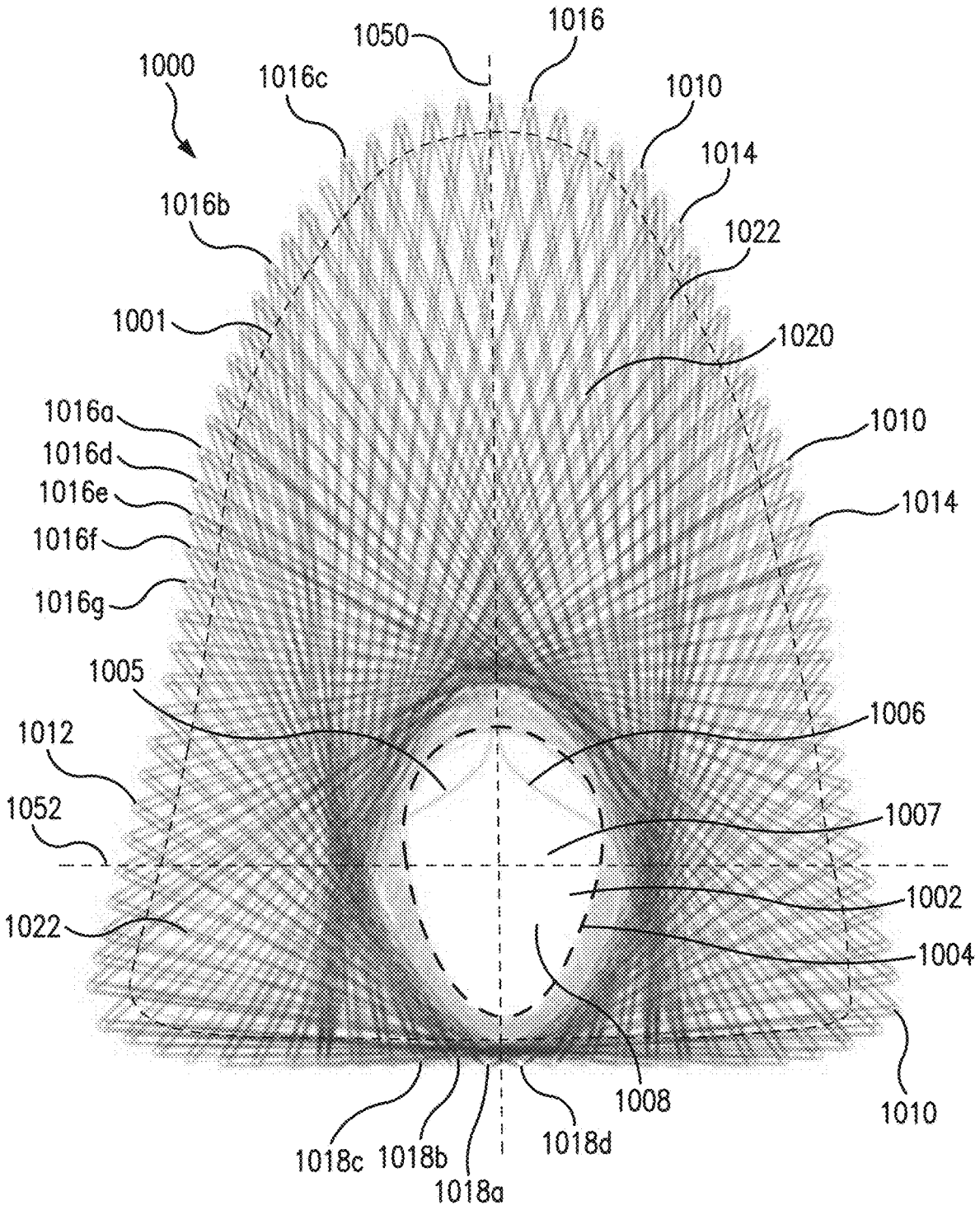
FIG. 10A shows a thread pattern according to some embodiments.
Figure 10B:
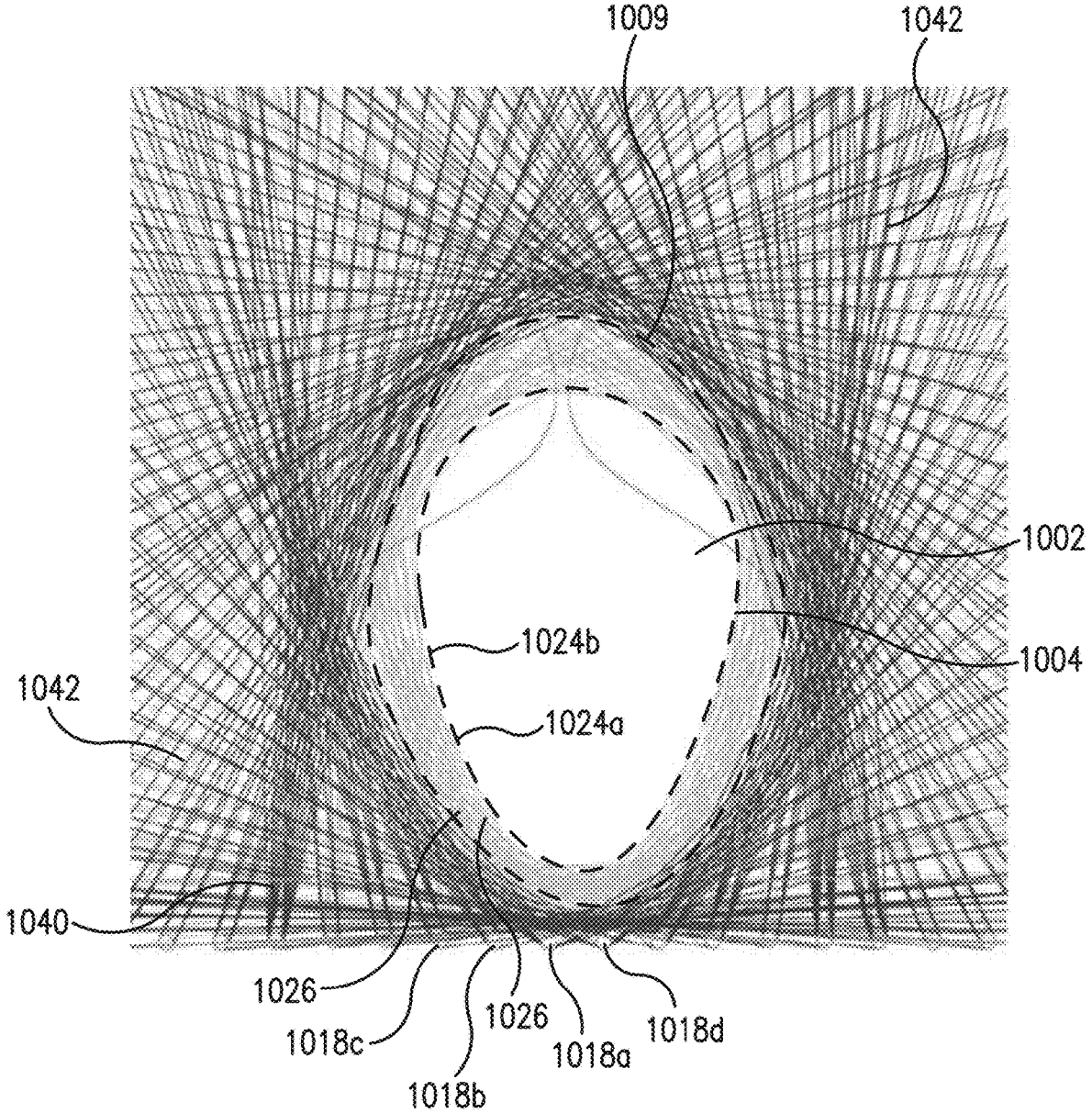
FIG. 10B is a zoomed in view of a portion of FIG. 10A.
Figure 10C:
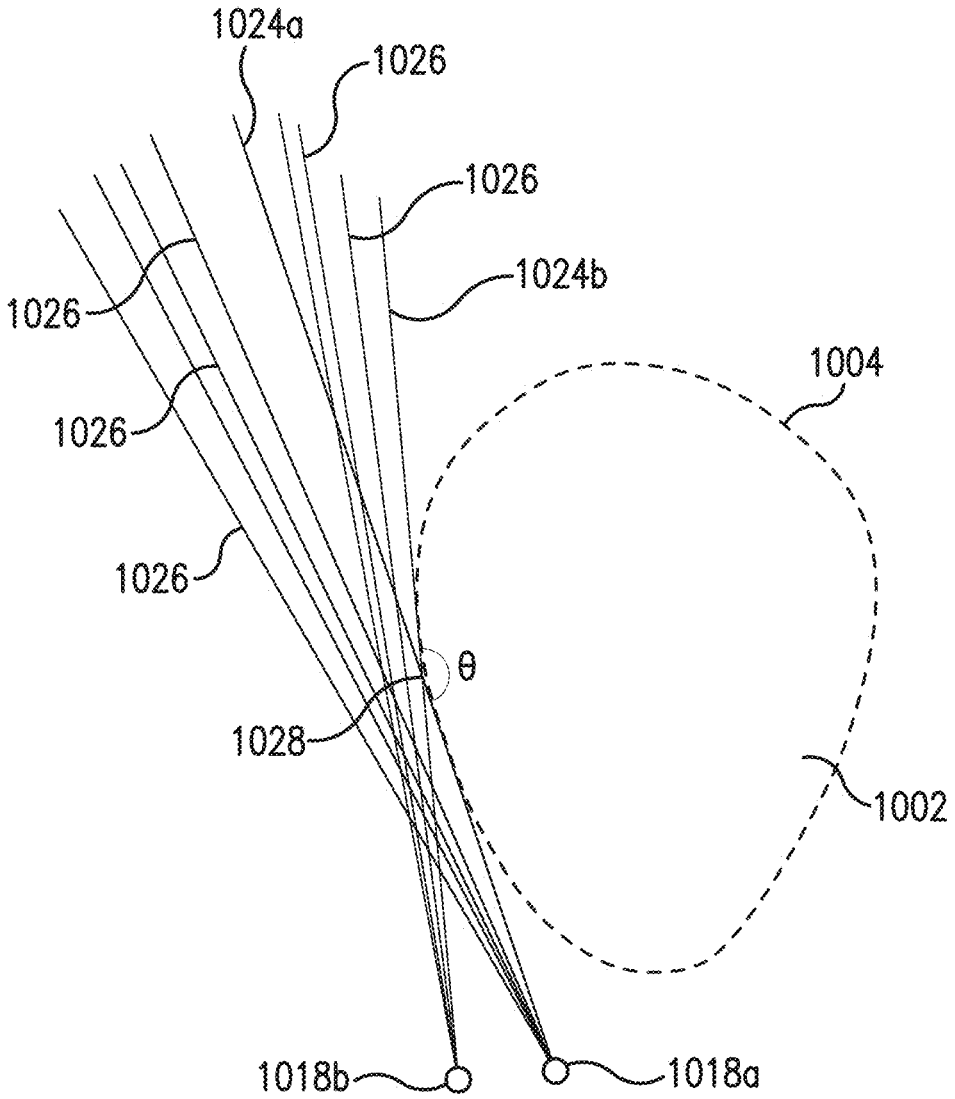
FIG. 10C illustrates a plurality of thread lines from FIGS. 10A and 10B.

FIGS. 10A-10C illustrate a thread pattern 1000 for an upper for an article of footwear according to some embodiments. In some embodiments, thread pattern 1000 may define all or a portion of an upper material that is used to form an upper for an article of footwear. Thread pattern 1000 may be utilized on any article of footwear described herein. For example, thread pattern 122 may be or may include thread pattern 1000.

Thread pattern 1000 may include one or more openings 1002. Each opening 1002 in thread pattern 1000 is defined by a perimeter edge 1004. In some embodiments, an opening 1002 may be an opening in an upper for an article of footwear. In some embodiments, an opening 1002 may define at least a portion of a collar for an upper. For example, opening 1002 may define at least a portion of collar 156 for upper 120. In some embodiments, an opening 1002 may define at least a portion of a throat for an upper. For example, opening 1002 may define at least a portion of throat area 150 for upper 120. In some embodiments, an opening 1002 may be an aesthetic feature on an upper. For example, opening 1002 may be define a boundary for a differently colored or patterned region on an upper. In some embodiments, opening 1002 may be an opening in only a sub-set of thread layers defining thread pattern 1000. For example, opening 1002 may be an opening in only a first thread layer of thread pattern 1000. In such embodiments, another thread layer may be wound above or below the first thread layer in thread pattern. In some embodiments, providing an opening in only a sub-set of thread layers defining thread pattern 1000 may provide one or more functional zones in thread pattern 1000.

An opening 1002 of thread pattern 1000 may include a medial side 1005, a lateral side 1006, a forefoot side 1007, and a rearfoot side 1008. Medial side 1005 of thread pattern 1000 or opening 1002 is defined as the side of thread pattern 1000 or opening 1002 on the medial side of a longitudinal line 1050 extending through the center of opening 1002. Lateral side 1006 of thread pattern 1000 or opening 1002 is defined as the side of thread pattern 1000 or opening on the lateral side of longitudinal line 1050 extending through the center of opening 1002. Forefoot side 1007 of thread pattern 1000 or opening 1002 is defined as the side of thread pattern 1000 or opening 1002 on the forefoot side of a transverse line 1052 extending through the center of opening 1002. Rearfoot side 1008 of thread pattern 1000 or opening 1002 is defined as the side of thread pattern 1000 or opening 1002 on the rearfoot side of transverse line 1052 extending through the center of opening 1002.

Features of thread pattern 1000 located on medial side 1005 may be referred to as medial features of thread pattern 1000. Features of thread pattern 1000 located on lateral side 1006 may be referred to as lateral features of thread pattern 1000. Features of thread pattern 1000 located on forefoot side 1007 may be referred to as forefoot features of thread pattern 1000. Features of thread pattern 1000 located on rearfoot side 1008 may be referred to as rearfoot features of thread pattern 1000.

Thread pattern 1000 may include anchor points 1010 disposed around perimeter edge 1004 of an opening 1002. In some embodiments, an upper formed using thread pattern 1000 may include anchor points 1010. In some embodiments, after winding one or more continuous threads to form thread pattern 1000, portions of thread pattern 1000 including anchor points 1010 may be removed from thread pattern 1000 (for example, perimeter portion 1001 shown in FIG. 10A). In such embodiments, finished thread pattern 1000 may not include anchor points 1010, and similarly, an upper formed using thread pattern 1000 may not include anchor points 1010.

Anchor points 1010 of thread pattern 1000 may include a plurality of medial side anchor points 1012. For purposes of the present application, medial side anchor points 1012 are defined as anchor points located on medial side 1005 of thread pattern 1000.

Anchor points 1010 of thread pattern 1000 may a plurality of lateral side anchor points 1014. For purposes of the present application, lateral side anchor points 1014 are defined as anchor points located on lateral side 1006 of thread pattern 1000.

Anchor points 1010 of thread pattern 1000 may a plurality of forefoot anchor points 1016. For purposes of the present application, forefoot anchor points 1016 are defined as anchor points located on forefoot side 1007 of thread pattern 1000.

Anchor points 1010 of thread pattern 1000 may a plurality of rearfoot anchor points 1018. For purposes of the present application, rearfoot anchor points 1018 are defined as anchor points located on rearfoot side 1008 of thread pattern 1000.

Thread pattern 1000 includes one or more continuous threads wound around anchor points 1010 to form thread pattern 1000. For example, as illustrated in FIG. 10A, thread pattern 1000 includes a first continuous thread 1020 with thread lines 1022 extending between respective anchor points 1010. In some embodiments, thread pattern 1000 may include a second continuous thread 1040 with thread lines 1042 extending between respective anchor points 1010.

Thread lines 1022 of continuous thread 1020 may include a plurality of thread lines 1022 extending between two respective anchor points 1010 and extending tangential to perimeter edge 1004 of opening 1002. Thread lines 1022 extending tangential to perimeter edge 1004 of opening 1002 may be referred to as "opening-tangential thread lines." FIGS. 10A-10C show a plurality of opening-tangential thread lines 1024.

Thread lines 1022 of continuous thread 1020 may also include a plurality of thread lines 1022 extending between two respective anchor points 1010 and not tangential to perimeter edge 1004 of opening 1002. Thread lines 1022 not extending tangential to perimeter edge 1004 of opening 1002 may be referred to as "non-opening-tangential thread lines." FIGS. 10A-10C show a plurality of non-opening-tangential thread lines 1026.

In some embodiments, thread lines 1024 extending tangential to perimeter edge 1004 of opening 1002 are not wound around an anchor point located at perimeter edge 1004 of opening 1002. In some embodiments, thread pattern 1000 may include anchor points located at perimeter edge 1004 of opening 1002 and no thread lines 1024 extending tangential to perimeter edge 1004 of opening 1002 are wound around the anchor points at perimeter edge 1004. In some embodiments, thread pattern 1000 may be devoid of anchor points located at perimeter edge 1004 of opening 1002.

In some embodiments, opening-tangential thread lines 1024 may include one or more thread lines 1024 located on medial side 1005 of perimeter edge 1004. A thread line 1024 located on medial side 1005 of perimeter edge 1004 means that the thread line 1024 defines a portion of medial side 1005 of perimeter edge 1004. A thread line 1024 located on medial side 1005 of perimeter edge 1004 may extend into lateral side 1006 of thread pattern 1000, but is not considered located on lateral side 1006 because it does not define a portion of perimeter edge 1004 on lateral side 1006. In some embodiments, opening-tangential thread lines 1024 may define all of medial side 1005 of perimeter edge 1004.

In some embodiments, opening-tangential thread lines 1024 may include one or more thread lines 1024 located on lateral side 1006 of perimeter edge 1004. A thread line 1024 located on lateral side 1006 of perimeter edge 1004 means that the thread line 1024 defines a portion of lateral side 1006 of perimeter edge 1004. A thread line 1024 located on lateral side 1006 of perimeter edge 1004 may extend into medial side 1005 of thread pattern 1000, but is not considered located on medial side 1005 because it does not define a portion of perimeter edge 1004 on medial side 1005. In some embodiments, opening-tangential thread lines 1024 may define all of lateral side 1006 of perimeter edge 1004.

In some embodiments, opening-tangential thread lines 1024 may include one or more thread lines 1024 located on medial side 1005 of perimeter edge 1004 and one or more thread lines 1024 located on lateral side 1006 of perimeter edge 1004. In such embodiments, the opening-tangential thread lines 1024 may define all or a portion of medial side 1005 and lateral side 1006 of perimeter edge 1004. In some embodiments, perimeter edge 1004 may be surrounded by opening-tangential thread lines 1024 such that all of medial side 1005 and lateral side 1006 of perimeter edge 1004 are defined by thread lines 1024.

Opening-tangential thread lines 1024 may include thread lines 1024 that overlap each other at an overlap point 1028 in thread pattern 1000. Any two thread lines 1024 of thread pattern 1000 may overlap each other at an overlap point 1028. For example, as shown in FIG. 10C, a first opening-tangential thread line **1024*a* may overlap a second opening-tangential thread line 1024*b* at overlap point 1028**.

Opening-tangential thread lines 1024 that overlap each other at an overlap point 1028 may be disposed at an angle relative to each other. The relative angle of the two thread lines 1024 may be defined by the angle of intersection (θ) at an overlap point 1028. Unless specified otherwise, the angle of intersection (θ) is the angle formed by the intersection of two thread lines 1024 and is measured on the side of the thread lines 1024 facing opening 1002 (as shown in FIG. 10C).

In some embodiments, the angle of intersection (θ) at an overlap point 1028 may be in the range of 90° to 179°, including subranges. For example, 0 may be 90°, 100°, 110°, 120°, 130°, 140°, 150°, 160°, 170°, or 179°, or within a range having any two of these values as endpoints, inclusive of the endpoints. In some embodiments, θ may be in a range of 90° to 179°, 100° to 179°, 110° to 179°, 120° to 179°, 130° to 179°, 140° to 179°, 150° to 179°, 160° to 179°, or 170° to 179°. In some embodiments, θ may be greater than 90°, greater than 120°, or greater than 150°.

In some embodiments, thread pattern 1000 may include one or more opening-tangential thread lines 1024 extending between a forefoot anchor point 1016 and a rearfoot anchor point 1018. In some embodiments, a thread line 1024 extending between a forefoot anchor point 1016 and a rearfoot anchor point 1018 may be located on medial side 1005 of perimeter edge 1004. In some embodiments, a thread line 1024 extending between a forefoot anchor point 1016 and a rearfoot anchor point 1018 may be located on lateral side 1006 of perimeter edge 1004. In some embodiments, thread pattern 1000 may include a plurality of opening-tangential thread lines 1024, with each thread line 1024 extending between respective forefoot anchor points 1016 and rearfoot anchor points 1018.

In some embodiments, thread pattern 1000 may include one or more opening-tangential thread lines 1024 extending between a medial side anchor point 1012 and a lateral side anchor point 1014. In some embodiments, a thread line 1024 extending between a medial side anchor point 1012 and a lateral side anchor point 1014 may be located on medial side 1005 of perimeter edge 1004. In some embodiments, a thread line 1024 extending between a medial side anchor point 1012 and a lateral side anchor point 1014 may be located on lateral side 1006 of perimeter edge 1004. In some embodiments, thread pattern 1000 may include a plurality of opening-tangential thread lines 1024, with each thread line 1024 extending between respective medial side anchor points 1012 and lateral side anchor points 1014.

Thread pattern 1000 may include any suitable number of opening-tangential thread lines 1024. In some embodiments, thread pattern 1000 may include four or more opening-tangential thread lines 1024. In some embodiments, thread pattern 1000 may include 10 or more opening-tangential thread lines 1024. In some embodiments, thread pattern 1000 may include 20 or more opening-tangential thread lines 1024. In some embodiments, thread pattern 1000 may include 30 or more opening-tangential thread lines 1024. In some embodiments, thread pattern 1000 may include a number of opening-tangential thread lines 1024 in a range of 2 to 50. For example, thread pattern 1000 may include 2 to 50, 4 to 50, 10 to 50, 20 to 50, or 30 to 50 opening-tangential thread lines 1024.

In some embodiments, a higher number of opening-tangential thread lines 1024 may increase the strength of opening 1002 at perimeter edge 1004. For example, a higher number of opening-tangential thread lines 1024 may increase the tear strength of opening 1002 at perimeter edge 1004.

In some embodiments, a higher number of opening-tangential thread lines 1024 may facilitate attachment of another footwear component at perimeter edge 1004. For example, opening-tangential thread lines 1024 may facilitate stitching of a collar element, a throat element, a heel counter, a cushioning element, a padding element, or a liner (for example, a sock liner) at perimeter edge 1004. In such embodiments, opening-tangential thread lines 1024 can serve as attachment points for a stich that attaches the footwear component. And since opening-tangential thread lines 1024 are tangential to perimeter edge 1004, the thread lines 1024 can provide increased strength for the stitch in directions orthogonal to the perimeter edge 1004.

In some embodiments, a plurality of adjacent anchor points 1010 of thread pattern 1000 may each include an opening-tangential thread line 1024 extending therefrom. As used herein, a first anchor point described as "adjacent" to second anchor point means that the second anchor point is the first anchor point's first or second closest anchor point neighbor. An anchor point will typically include two "adjacent" anchor point neighbors, typically located on opposing sides of the anchor point. In embodiments including equally spaced anchor points, an anchor point's first and second closest anchor point neighbors may be located at the same distance from the anchor point. As an example, anchors points 1018*a* and 1018*c* are adjacent to anchor point 1018*b* in FIG. 10A. As another example, anchor points 1016*d* and 1016*f* are adjacent to anchor point 1016*e* in FIG. 10A.

For example, in some embodiments, the plurality of anchor points 1010 of thread pattern 1000 may include a first rearfoot anchor point 1018*a*, a second rearfoot anchor point 1018*b* adjacent to first rearfoot anchor point 1018*a*, a first forefoot anchor point 1016*a* and a second forefoot anchor point 1016*b*. In such embodiments, the plurality of thread lines 1022 of thread pattern 1000 may include a first opening-tangential thread line 1024 extending from first rearfoot anchor point 1018*a* to first forefoot anchor point 1016*a* and a second opening-tangential thread line 1024 extending from second rearfoot anchor point 1018*b* to second forefoot anchor point 1016*b*.

In such embodiments, opening-tangential thread lines 1024 extending from adjacent rearfoot anchor points 1018*a*, 1018*b* may overlap at an overlap point 1028. For example, as shown in FIG. 10C, first open-tangential thread line 1024*a* may overlap second opening-tangential thread line 1024*b* at overlap point 1028. Any two opening-tangential thread lines 1024 may overlap at an overlap point. For example, in some embodiments, thread pattern may include a third opening tangential thread line 1024 and a fourth opening-tangential thread line 1024 that overlap each other at a second overlap point 1028.

In some embodiments, opening-tangential thread lines 1024 overlapping at an overlap point 1028 may be directly bonded to each other at the overlap point 1028. In some embodiments, opening-tangential thread lines 1024 overlapping at an overlap point 1028 may be directly bonded to each other via a polymeric material of at least one of: the first open-tangential thread line 1024 or the second open-tangential thread line 1024.

Any suitable number of adjacent anchor points 1010 of thread pattern 1000 may each include an opening-tangential thread line 1024 extending therefrom. For example, in some embodiments, anchor points 1010 of thread pattern 1000 may further include a third rearfoot anchor point 1018*c* adjacent to second rearfoot anchor point 1018*b* and a third forefoot anchor point 1016*c*. In such embodiments, the plurality of thread lines 1022 of thread pattern 1000 may include a third opening adjacent thread line 1024 extending from third rearfoot anchor point 1018*c* to third forefoot anchor point 1016*c*.

In some embodiments, an anchor point 1010 of thread pattern 1000 may include an opening-tangential thread line 1024 extending therefrom and a plurality of non-opening-tangential thread lines 1026 extending therefrom. Thread lines 1022 extending between two respective anchor points 1010 and not tangential to an opening 1002 are considered "non-opening-tangential thread lines." In some embodiments, an anchor point 1010 may have a thread line communication number and at least one of the threads counted in the thread line communication number may be an opening-tangential thread line 1024 and the remainder of the thread lines are non-opening-tangential thread lines.

For example, in some embodiments, anchor points 1010 of thread pattern 1000 may include a first rearfoot anchor point 1018*a* and five adjacent forefoot anchor points 1016*a*, 1016*d*, 1016*e*, 1016*f*, and 1016*g*. In such embodiments, rearfoot anchor point 1018*a* may include the following thread lines extending therefrom: (i) an opening-tangential thread line 1024 extending from anchor point 1018*a* to anchor point 1016*a*, (ii) a first non-opening-tangential thread line 1026 extending from anchor point 1018*a* to anchor point 1016*d*, (iii) a second non-opening-tangential thread line 1026 extending from anchor point 1018*a* to anchor point 1016*e*, (iv) a third non-opening-tangential thread line 1026 extending from anchor point 1018*a* to anchor point 1016*f*, and (v) a fourth non-opening-tangential thread line 1026 extending from anchor point 1018*a* to anchor point 1016*g*.

By threading thread lines in this fashion, thread pattern 1000 can include a high density of thread lines near perimeter edge 1004 of opening 1002 and extending nearly tangential to opening 1002. By threading a high density of thread lines in this fashion, characteristics of thread pattern 1000 at opening 1002 can be controlled. For example, the softness, stretchability, and/or strength of thread pattern 1000 at opening 1002 can be controlled by threading thread lines as described above. In some embodiments, the strength of opening 1002 can be maximized. For example, the tear strength of opening 1002 can be maximized. In some embodiments, the softness and/or stretchability of thread pattern 1000 at opening 1002 can be maximized for a wearer's comfort.

In some embodiments, a high number thread lines extending nearly tangential to perimeter edge 1004 may facilitate attachment of other footwear components at perimeter edge 1004. For example, nearly opening-tangential thread lines may facilitate stitching of a collar element, a throat element, a heel counter, a cushioning element, a padding element, or a liner (for example a sock liner) at perimeter edge 1004. In such embodiments, the nearly opening-tangential thread lines can serve as attachment points for a stich that attaches the footwear component. And since the nearly opening-tangential thread lines are almost tangential to perimeter edge 1004, the thread lines can provide increased strength for the stitch in directions orthogonal to the perimeter edge 1004. Additionally, in some embodiments, a high number thread lines extending nearly tangential to perimeter edge 1004 may facilitate adhesive bonding of other footwear components at perimeter edge 1004. In such embodiments, the high number thread lines extending nearly tangential to perimeter edge 1004 may create a continuous surface, or substantially continuous surface, near perimeter edge to which a footwear component can be adhesively bonded.

Any suitable number of adjacent anchor points 1010 of thread pattern 1000 may each include an opening-tangential thread line 1024 and a plurality of non-opening-tangential thread lines 1026 extending therefrom. For example, in some embodiments, anchor points 1010 of thread pattern 1000 may include a second rearfoot anchor point 1018*b* adjacent to first rearfoot anchor point 1018*a*. In such embodiments, rearfoot anchor point 1018*b* may include the following thread lines extending therefrom: (i) an opening-tangential thread line 1024 extending from anchor point 1018*b* to a forefoot anchor point 1016 and (ii) a non-opening-tangential thread line 1026 extending from anchor point 1018*b* to one of the five adjacent forefoot anchor points 1016*a*, 1016*d*, 1016*e*, 1016*f*, and 1016*g*.

As another example, in some embodiments, anchor points 1010 of thread pattern 1000 may include a second rearfoot anchor point 1018*d* adjacent to first rearfoot anchor point 1018*a*. In such embodiments, rearfoot anchor point 1018*d* may include the following thread lines extending therefrom: (i) an opening-tangential thread line 1024 extending from anchor point 1018*d* to one of the five adjacent forefoot anchor points 1016*a*, 1016*d*, 1016*e*, 1016*f*, and 1016*g* and (ii) a non-opening-tangential thread line 1026 extending from anchor point 1018*d* to a forefoot anchor point 1016.

As previously discussed, thread pattern 1000, with or without anchor points 1010, may be used to form an upper for an article of footwear. In some embodiments, an opening 1002 of thread pattern 1000 may not corresponded directly to an opening in an upper. For example, in some embodiments, a portion of thread pattern 1000 near opening 1002 may be folded, sown, or otherwise utilized to form a perimeter edge of an opening on an upper. In such embodiments, thread pattern 1000 may include a secondary perimeter edge 1009.

In embodiments including secondary perimeter edge 1009, secondary perimeter edge 1009 may define at least a portion of a collar for an upper. For example, a secondary perimeter edge 1009 may define at least a portion of collar 156 for upper 120. In some embodiments, a secondary perimeter edge 1009 may define at least a portion of a throat for an upper. For example, secondary perimeter edge 1009 may define at least a portion of throat area 150 for upper 120.

In embodiments including secondary perimeter edge 1009, thread lines 1042 of a second continuous thread 1040 may extend tangential to or nearly tangential to secondary perimeter edge 1009 in the same fashion as discussed above for perimeter edge 1004. In all of the embodiments discussed above, secondary perimeter edge 1009 can take the place of perimeter edge 1004 and thread lines 1042 can take the place of thread lines 1022. FIGS. 10A and 10B illustrate thread lines 1042 as darker thread lines extending tangential to, nearly tangential to, or not tangential to secondary perimeter edge 1009 in the same fashion as discussed above for thread lines 1022.

While the embodiments described above are described in context with a perimeter edge 1004 and a secondary perimeter edge 1009 for an opening 1002 in a thread pattern, the edges 1004 and 1009 may alternatively be edges for a perimeter edge of a thread pattern or a perimeter boundary for a functional zone in a thread pattern. In such embodiments, thread lines may extend tangential to or nearly tangential to edges 1004 and 1009 for a perimeter edge of a thread pattern or a perimeter boundary for a functional zone in a thread pattern in the same fashion as discussed above for opening 1002. In such embodiments, the thread lines extending tangential to the edges 1004 and 1009 may be referred to as "edge-tangential thread lines" or "zone-tangential thread lines." Also, thread lines not extending tangential to the edges 1004 and 1009 may be referred to as "non-edge-tangential thread lines" or "non-zone-tangential thread lines."

In some embodiments, an upper for an article of footwear may be made by bonding two thread patterns together. In such embodiments, a first thread pattern may be bonded to a second thread pattern to form an upper material with a void shaped to receive a human foot between the first and second thread patterns. For example, a first thread pattern defining a medial portion of an upper material may be bonded to a second thread pattern defining a lateral portion of an upper material to define a void shaped to receive a human foot. By bounding two thread patterns together in this fashion, the stretch and/or stiffness around and underneath a wearer's foot can be controlled.

Figure 11:
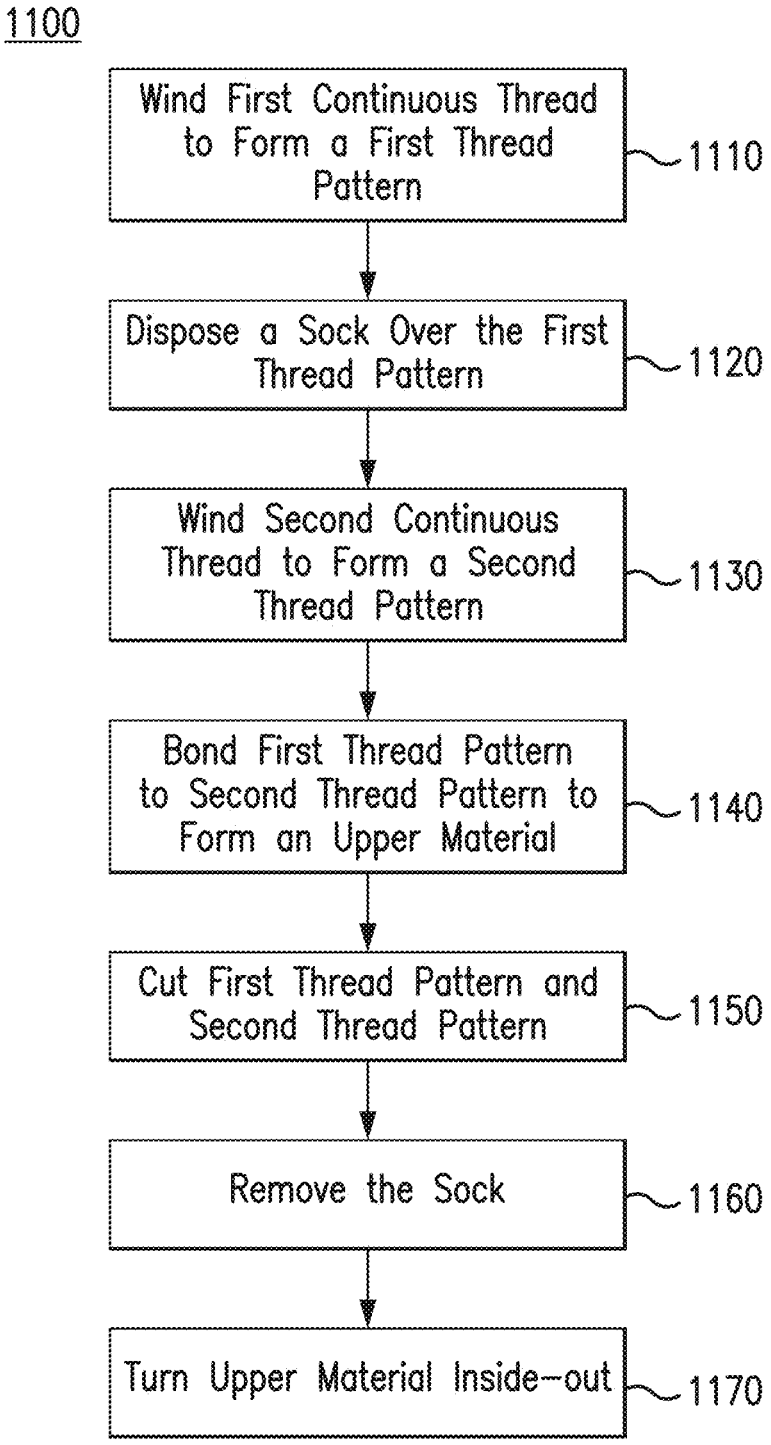
FIG. 11 is an exemplary flowchart of a method according to some embodiments.

FIG. 11 shows a method 1100 of making an upper (for example, upper 120) for an article footwear of (for example, article of footwear 100) according to some embodiments. FIGS. 12A-12F illustrate steps of method 1100. Unless stated otherwise, the steps of method 1100 need not be performed in the order set forth in FIG. 11. Additionally, unless specified otherwise, the steps of method 1100 need not be performed sequentially. The steps can be performed simultaneously. Additionally, method 1100 need not include all the steps described. As one example, method 1100 need not include the step of removing the sheet. In such embodiments, the sheet may form a part of an upper material. As another example, the sheet may be removed after or during step 1170, rather than before step 1170 as show in FIG. 11.

In step 1110, a first continuous thread 1210 may be wound around a plurality of anchor points disposed on a support plate to form a first thread pattern 1200 as described herein. Accordingly, the first continuous thread 1210 is wound to include a plurality of thread lines with each thread line extending between two respective anchor points. In some embodiments, first thread pattern 1200 formed in step 1110 may include a plurality of continuous threads wound around anchor points on a support plate.

In step 1120, a sheet 1220 may be disposed over first continuous thread 1210 forming thread pattern 1200. In some embodiments, sheet 1220 may be disposed in direct contact with the thread pattern 1200 formed with first continuous thread 1210. In some embodiments, step 1120 may be performed after step 1130 and sheet 1220 may be disposed between first thread pattern 1200 and a second thread pattern 1230 formed in step 1130. In such embodiments, sheet 1220 may be disposed in direct contact with first thread pattern 1200 and/or second thread pattern 1230 in step 1120.

In some embodiments, sheet 1220 may be a sock-shaped flat sheet. In some embodiments, sheet 1220 may be a hollow sock-shaped material. In such embodiments, the hollow sock-shaped material may be capable of being turned inside-out.

In some embodiments, sheet 1220 may be composed of a polymeric material. In some embodiments, sheet 1220 may be composed of a silicone material. In some embodiments, sheet may be composed of polytetrafluoroethylene (PTFE). In some embodiments, sheet may be composed of a ceramic material or a metallic material.

In some embodiments, one or more surfaces of sheet 1220 may include one or more textured regions for imparting a texture to first thread pattern 1200 and/or second thread pattern 1230 during step 1140. Textured regions of sheet 1220 may be the same characteristics as textured regions of textured sheet 1600 described herein.

In some embodiments, sheet 1220 may be composed of a fabric or textile material. In some embodiments, sheet 1220 may be formed of a woven, non-woven, or knitted fabric or textile material. For example, sheet 1220 may be a woven, non-woven, or layer composed of cotton, thermoplastic polyurethane (TPU), polyester, polyamide, polyethylene (PE), PE foam, polyurethane (PU) foam, and co-polymers or polymer blends including one or more these polymers.

In step 1130, a second continuous thread 1240 may be wound over sheet 1220 and around the plurality of anchor points disposed on a support plate to form a second thread pattern 1230. Accordingly, second continuous thread 1240 incudes a plurality of thread lines with each thread line extending between two respective anchor points. In some embodiments, second thread pattern 1230 formed in step 1110 may include a plurality of continuous threads wound around anchor points on a support plate.

In some embodiments, step 1130 may not be performed over sheet 1220. Rather, step 1130 may performed, and after forming second thread pattern 1230, sheet 1220 may be disposed between first thread pattern 1200 and second thread pattern 1230. In such embodiments, step 1120 may be performed after step 1130.

In some embodiments, first continuous thread 1210 wound in step 1110 and second continuous thread 1240 wound in step 1130 may be portions of a single thread. In some embodiments, first continuous thread 1210 wound in step 1110 and second continuous thread 1240 wound in step 1130 may include different threads.

After forming first thread pattern 1200 and second thread pattern 1230, and after positioning sheet 1220 between the thread patterns, first thread pattern 1200 and second thread pattern 1230 may be bonded to each other to form an upper material 1260 in step 1140. In some embodiments, bonding first thread pattern 1200 to second thread pattern 1230 may include bonding first thread pattern 1200 to second thread pattern 1230 around a perimeter 1222 of sheet 1220. Bonding around perimeter 1222 of sheet 1220 can create a seam 1252 around perimeter 1222. In some embodiments, first thread pattern 1200 and second thread pattern 1230 may be bonded to each other in a heat press (for example, heat press 900).

In some embodiments, bonding first thread pattern 1200 to second thread pattern 1230 may include directly bonding first thread pattern 1200 to second thread pattern 1230. In such embodiments, first thread pattern 1200 and second thread pattern 1230 may be directly bonded to each other via a polymeric material of at least one of: first thread pattern 1200 or second thread pattern 1230. In some embodiments, bonding first thread pattern 1200 to second thread pattern 1230 may include indirectly bonding first thread pattern 1200 to second thread pattern 1230 via, for example, an adhesive layer.

In some embodiments, bonding first thread pattern 1200 to second thread pattern 1230 may include bonding first continuous thread 1210 to second continuous thread 1240. In some embodiments, bonding first thread pattern 1200 to second thread pattern 1230 may include directly bonding first continuous thread 1210 to second continuous thread 1240. In such embodiments, first continuous thread 1210 and second continuous thread 1240 may be directly bonded to each other via a polymeric material of at least one of: first continuous thread 1210 or second continuous thread 1240.

In some embodiments, the step of bonding first thread pattern 1200 to second thread pattern 1230 may include directly bonding thread lines of first thread pattern 1200 to each other and directly bonding thread lines of second thread pattern 1230 to each other. In such embodiments, thread lines of first thread pattern 1200 may be directly bonded to each other at intersection points between thread lines in step 1140 while sheet 1220 is disposed between first thread pattern 1200 and second thread pattern 1230. Similarly, in such embodiments, thread lines of second thread pattern 1230 may be directly bonded to each other at intersection points between thread lines in step 1140 while sheet 1220 is disposed between first thread pattern 1200 and second thread pattern 1230.

In some embodiments, bonding step 1140 may be replaced with a different coupling step configured to attach first thread pattern 1200 and second thread pattern 1230. For example, in some embodiments, step 1140 may include stitching first thread pattern 1200 to second thread pattern 1230. In any event, a seam for attaching first thread pattern 1200 and second thread pattern 1230 may be created in step 1140. In some embodiments, bonding step 1140 may include a plurality of coupling steps. For example, bounding step 1140 may include a bonding first thread pattern 1200 to second thread pattern 1230 and stitching first thread pattern 1200 to second thread pattern 1230.

In step 1150, first thread pattern 1200 and second thread pattern 1230 may be cut into a shape corresponding to the shape of an upper. For example, first thread pattern 1200 and second thread pattern 1230 may be cut to define a perimeter edge 1250 having a shape corresponding to the shape of an upper. In some embodiments, first thread pattern 1200 and second thread pattern 1230 may be cut around perimeter 1222 of sheet 1220. Cutting first thread pattern 1200 and second thread pattern 1230 in step 1150 may include any suitable cutting process, for example a laser cutting process.

In some embodiments, cutting in step 1150 may include defining an opening 1254 in upper material 1260. In some embodiments, opening 1254 may define an opening in an upper for an article of footwear. In some embodiments, opening 1254 may define at least a portion of a collar for an upper. For example, opening 1254 may define at least a portion of collar 156 for upper 120. In some embodiments, opening 1254 may define at least a portion of a throat for an upper. For example, opening 1254 may define at least a portion of throat area 150 for upper 120.

In some embodiments, first thread pattern 1200 and second thread pattern 1230 may be cut after bonding the thread patterns in step 1140. In such embodiments, first thread pattern 1200 and second thread pattern 1230 may be cut at or within seam 1252 around perimeter 1222 of sheet 1220. When cutting within seam 1252, not all of seam 1252 is cut away so that first thread pattern 1200 and second thread pattern 1230 remain attached at seam 1252 after cutting in step 1150. In some embodiments, a portion of seam 1252 may be cut away entirely to define an opening 1254.

In some embodiments, first thread pattern 1200 and second thread pattern 1230 may be cut before bonding the thread patterns in step 1140. In such embodiments, seam 1252 may be formed after cutting in step 1150. And in such embodiments, seam 1252 may be formed such that it defines an opening 1254.

In some embodiments, method 1100 may include removing sheet 1220 from upper material 1260 in step 1160. In such embodiments, an upper formed of upper material 1260 will not include sheet 1220. In some embodiments, removing sheet 1220 from upper material 1260 in step 1160 may be performed after turning upper material 1260 inside-out in step 1170. In some embodiments, sheet 1220 may be removed through an opening 1254 defined during cutting and/or bonding first thread pattern 1200 and second thread pattern 1230.

In some embodiments, method 1100 may not include removing sheet 1220. In such embodiments, sheet 1220 may be attached to upper material 1260 during method 1100. Also, in such embodiments, an upper formed of upper material 1260 may include sheet 1220. For example, sheet 1220 may define a layer of an upper formed of upper material 1260, like fabric layer 172 of upper 120.

Figure 12C:
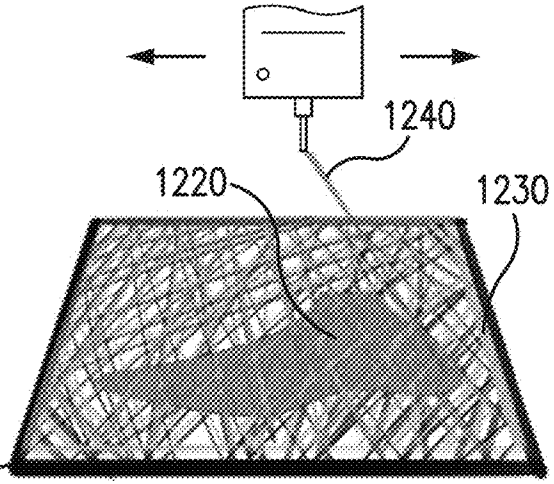
FIGS. 12A-12F show an exemplary process for making an upper according to some embodiments.
Figure 12B:
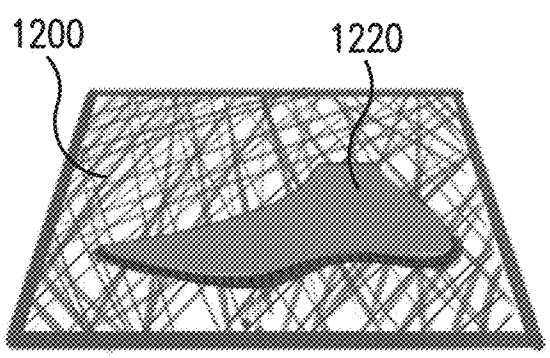
Figure 12A:
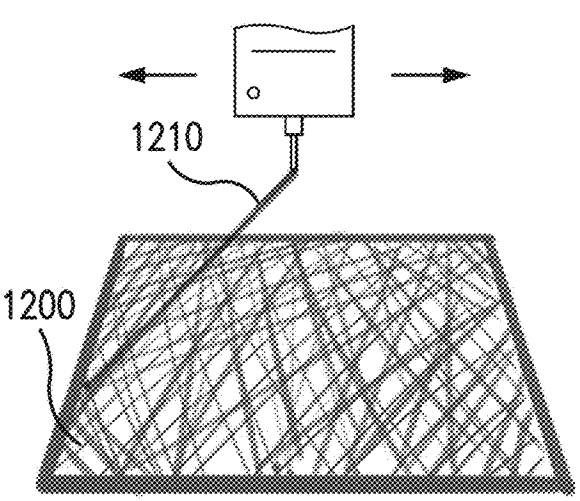
Figure 12F:
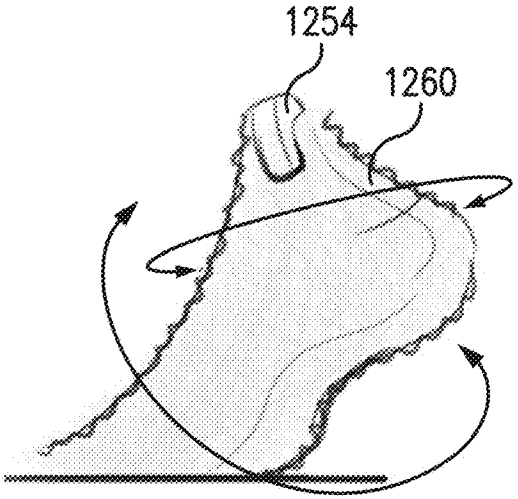
Figure 12E:
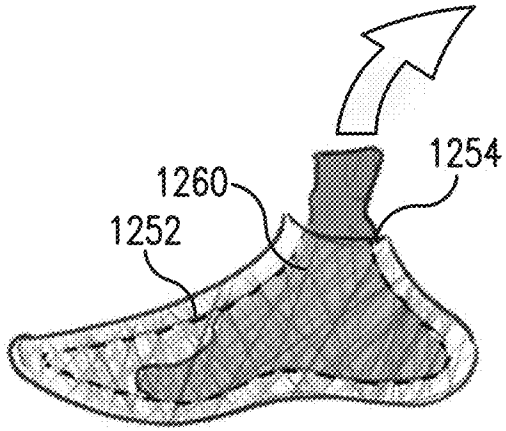
Figure 12D:
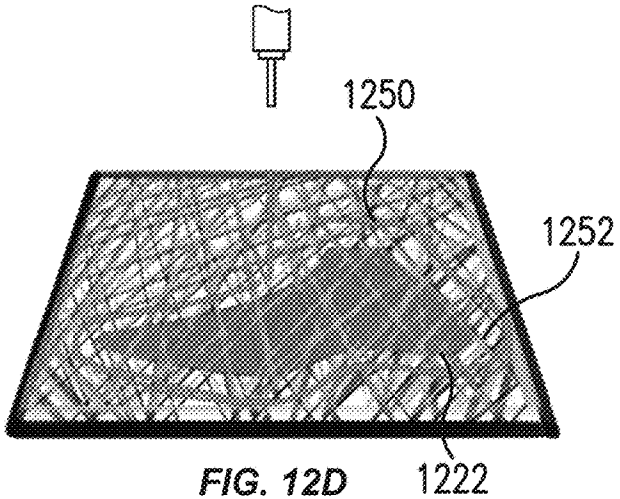

In some embodiments, method 1100 may include turning upper material 1260 inside-out in step 1170 (see FIG. 12F). In such embodiments, turning upper material 1260 inside-out may create a void shaped to receive a human foot (for example, void 155 of upper 120) between first thread pattern 1200 and second thread pattern 1230. In embodiments including step 1170, seam 1252 may be inverted and at least partially concealed within the void. In some embodiments, turning upper material 1260 inside-out may create a clean edge on the exterior of upper material 1260 at seam 1252. In some embodiments, sheet 1220 may also be turned inside-out in step 1170. In some embodiments, method 1100 may not include step 1170.

In some embodiments, wound thread patterns as described herein may be integrated into a sole for an article of footwear. In some embodiments, wound thread patterns may be integrated into a sole by embedding a wound thread pattern into a sole material. In some embodiments, a wound thread pattern may define a portion of an upper for an article of footwear and extend through a sole material, thereby integrating the wound thread pattern into the sole. Integrating one or more wound thread patterns into a sole may serve to couple thread pattern(s) to a sole.

In some embodiments, a thread pattern defining a portion of an upper and integrated into a sole may facilitate energy transfer from the individual's foot to the surface his or her foot is in contact with (for example, the ground) during use. Such an integrated thread pattern may assist in energy transfer because continuous thread lines of a thread pattern can extend into one side of a sole, through the sole, and out another side of the sole.

Figure 14:
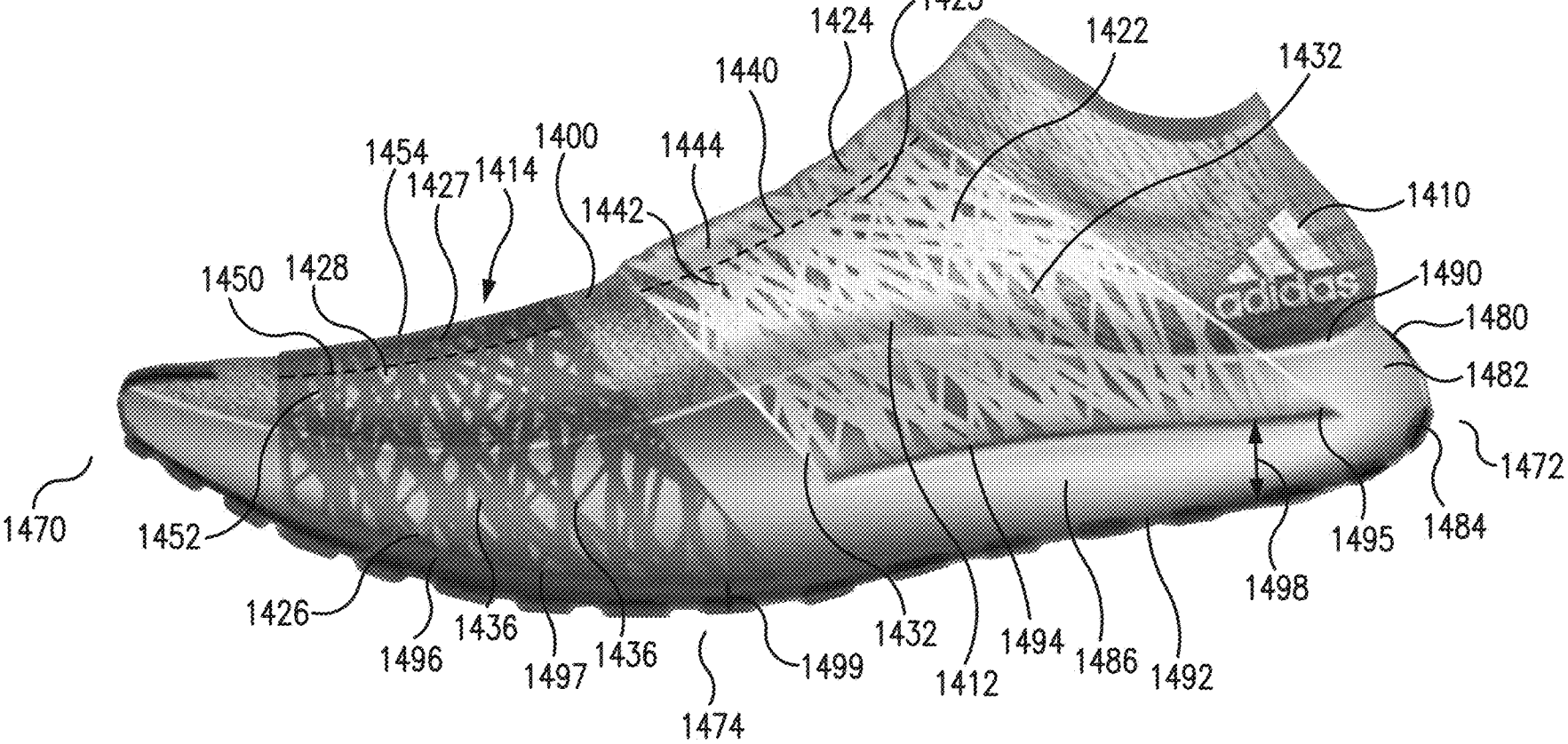
FIG. 14 shows an article of footwear according to some embodiments.

FIGS. 13 and 14 show articles of footwear 1300, 1400 including one or more thread patterns integrated into a sole according to some embodiments. Article of footwear 1300 includes a sole 1380 and an upper 1310 coupled to sole 1380. Sole 1380 includes a top surface 1390 and a bottom surface 1392 opposite top surface 1390. Sole 1380 also includes a forefoot end 1370, a heel end 1372, a medial side 1374, and a lateral side opposite medial side 1374. During use, top surface 1390 is adjacent a wearer's foot and bottom surface 1392 contacts the ground. Sole 1380 may include a midsole 1382 and/or an outsole 1384. In some embodiments, all or a portion of sole 1380 may be injection molded.

Similarly, article of footwear 1400 includes a sole 1480 and an upper 1410 coupled to sole 1480. Sole 1480 includes a top surface 1490 and a bottom surface 1492 opposite top surface 1490. Sole 1480 also includes a forefoot end 1470, a heel end 1472, a medial side 1474, and a lateral side opposite medial side 1474. During use, top surface 1490 is adjacent a wearer's foot and bottom surface 1492 contacts the ground. Sole 1480 may include a midsole 1482 and/or an outsole 1484. In some embodiments, all or a portion of sole 1480 may be injection molded.

As shown in FIG. 13, upper 1310 includes a thread pattern 1322 defining a portion of upper 1310. Similarly, as shown in FIG. 14, upper 1410 includes a first thread set 1422 and a second thread set 1426. Thread pattern 1322 and thread sets 1422, 1426 may have any of the characteristics of thread patterns as described herein. Also, thread pattern 1322 and thread sets 1422, 1426 may be wound and bonded in the same fashion as described herein. For example, a plurality of thread lines of thread pattern 1322 and thread sets 1422, 1426, respectively, may be directly bonded to each other at points of intersection between two or more of the thread lines.

Article of footwear 1300 may include a seam 1340 at which two opposing ends of thread pattern 1322 are attached. In some embodiments, a first end 1323 of thread pattern 1322 may be directly coupled to a second end 1324 of thread pattern 1322 at seam 1340. In some embodiments, a first end 1323 of thread pattern 1322 may be directly bonded to a second end 1324 of thread pattern 1322 at seam 1340.

In some embodiments, a portion of first end 1323 and a portion of second end 1324 may overlap at seam 1340. At the overlap, first end 1323 and second end 1324 may be coupled by, for example, a stich, or via direct bonding of a polymeric material of thread pattern 1322.

Thread lines 1332 of thread pattern 1322 may be directly or indirectly coupled together at seam 1340. In some embodiments, thread lines 1332 may be stitched together at seam 1340. In some embodiments, thread lines 1332 may be directly bonded at seam 1340. In such embodiments, thread lines 1332 may be directly bonded at seam 1340 via a polymeric material of the thread lines 1332.

In some embodiments, a plurality of thread lines 1332 of thread pattern 1322 may extend from a first side 1342 of seam 1340, through sole 1380, and to a second side 1344 of seam 1340. In some embodiments, a plurality of thread lines 1332 of thread pattern 1322 extending from first side 1342 of seam 1340, through sole 1380, and to second side 1344 of seam 1340 may be continuous thread lines. For example, one or more thread lines 1332 may be a continuous thread line extending between anchor points in a thread pattern as described herein. In some embodiments, thread pattern 1322 may include anchor points. In some embodiments, thread pattern 1322 may not include anchor points because anchor points have been removed from thread pattern 1322.

In some embodiments, thread lines 1332 of thread pattern 1322 may extend from a medial side 1312 of upper 1310, through sole 1380, and to a lateral side 1314 of upper 1310. In some embodiments, a plurality of thread lines 1332 of thread pattern 1322 extending from medial side 1312 of upper 1310, through sole 1380, and to lateral side 1314 of upper 1310 may be continuous thread lines. Thread lines 1332 that extend from medial side 1312 of upper 1310, through sole 1380, and to lateral side 1314 of upper 1310 may or may not be coupled at seam 1340. In some embodiments, thread lines 1332 that extend from medial side 1312 of upper 1310, through sole 1380, and to lateral side 1314 of upper 1310 may be directly or indirectly coupled to the sides of upper 1310. For example, the thread lines 1332 may be stitched or directly bonded to the sides of upper 1310.

In some embodiments, thread lines 1332 of thread pattern 1322 may extend from a forefoot end 1311 of upper 1310, through sole 1380, and to a heel end 1313 of upper 1310. In some embodiments, a plurality of thread lines 1332 of thread pattern 1322 extending from forefoot end 1311 of upper 1310, through sole 1380, and to heel end 1313 of upper 1310 may be continuous thread lines. Thread lines 1332 that extend from forefoot end 1311 of upper 1310, through sole 1380, and to heel end 1313 of upper 1310 may or may not be coupled at a seam.

In some embodiments, thread lines 1332 that extend from forefoot end 1311 of upper 1310, through sole 1380, and to heel end 1313 of upper 1310 may be directly or indirectly coupled to the forefoot end 1311 and heel end 1313 of upper 1310. For example, the thread lines 1332 may be stitched or directly bonded to forefoot end 1311 and heel end 1313 of upper 1310. Thread lines 1332 of thread pattern 1322 extending from forefoot end 1311 of upper 1310, through sole 1380, and to heel end 1313 of upper 1310 may serve to provide desired properties for article of footwear 1300, for example, bending stiffness and/or torsional stiffness.

In some embodiments, thread lines 1332 extending through sole 1380 may extend through midsole 1382. In some embodiments, thread lines 1332 extending through sole 1380 may extend through outsole 1384. In some embodiments, thread lines 1332 extending through sole 1380 may extend through an interface between midsole 1382 and outsole 1384.

In some embodiments, a portion of each of the plurality of thread lines 1332 that extend through sole 1380 is embedded within sole 1380. In some embodiments, a portion of each of the plurality of thread lines 1332 that extend through sole 1380 is embedded within midsole 1382. In some embodiments, a portion of each of the plurality of thread lines 1332 that extend through sole 1380 is embedded within outsole 1384.

As described herein, a thread line or thread pattern embedded within a sole material means that all or a portion the previously exposed areas of thread lines or a thread pattern are surrounded on all sides by sole material. In such embodiments, if there are spaces between individual thread lines of a thread pattern, sole material may fill the spaces. A thread line or thread pattern embedded within a sole material means the thread line or thread pattern is in direct contact with the portion of the sole material through which it extends. In some embodiments, a sole may include one or more voids through which thread lines or a thread pattern extend. In such embodiments, thread lines or a thread pattern are not embedded within a sole material at the void(s) because no sole material is present at the void(s).

In some embodiments, a plurality of thread lines 1332 may extend from first side 1342 of seam 1340, over a portion of a first side (for example, the medial side 1386) of sole 1380, through sole 1380, over a portion of a second side (for example, the lateral side) of sole 1380, and to second side 1344 of seam 1340. In some embodiments, a plurality of thread lines 1332 may extend from medial side 1312 of upper 1310, over a portion of a first side (for example, the medial side 1386) of sole 1380, through sole 1380, over a portion of a second side (for example, the lateral side) of sole 1380, and to lateral side 1314 of upper 1310. In such embodiments, thread pattern 1322 extends from upper 1310 and covers a portion of the side surfaces of sole 1380.

Thread lines 1332 that extend through sole 1380 may enter sole 1380 at an entry point on a side surface of sole 1380. For example, as shown in FIG. 13, thread lines 1332 may enter sole 1380 entry points 1394 on medial side 1386 of sole 1380. Lateral side of sole 1380 may have entry points similar to entry points 1394. A plurality of entry points 1394 on sole 1380 may be referred to as an entry line 1395. Entry line 1395 extends along a side surface of sole 1380 and is defined by the plurality of entry points 1394 for each thread line 1332 extending through sole 1380.

In some embodiments, the location of entry line 1395 for thread lines 1332 may vary relative to bottom surface 1392 of sole 1380 along the length of sole 1380. For example, in some embodiments, the plurality of thread lines 1332 may include a first plurality of thread lines 1332 extending through sole 1380 at a first distance 1396 from bottom surface 1392 of sole 1380 and a second plurality of thread lines 1332 extending through sole at a second distance 1398 from bottom surface 1392 of sole 1380.

As shown in FIG. 13, first distance 1396 and second distance 1398 may be defined by the vertical distance between bottom surface 1392 of sole 1380 and entry line 1395. In embodiments where bottom surface 1392 includes traction members, such as tread, bottom surface 1392 is defined by the bottommost surfaces of the traction members. In embodiments wherein distances 1396, 1398 vary along line 1395 for a plurality of thread lines 1332, the average distance along line 1495 for the plurality of thread lines 1332 defines distances 1396, 1398.

First distance 1396 and second distance 1398 may be different. In some embodiments, first distance 1396 may be less than second distance 1398. In some embodiments, first distance 1396 may be greater than second distance 1398. In some embodiments, second distance 1398 may be 10% or more different from first distance 1396. By tailoring first distance 1396 and second distance 1398, various characteristics of an article of footwear can be controlled. For example, sole 1380 can be provided with desired stiffness at different regions of the sole. Such regional stiffness can control how a wearer's foot and/or sole 1380 deforms during use. For example, a relatively large distance 1396/1398 can help control the way sole 1380 deforms when it contacts the ground during use.

In some embodiments, as shown for example, in FIG. 14, an upper may include a plurality of different sets of thread lines extending through a sole. Upper 1410 may include a plurality of thread lines 1432 defining a first set 1422 of thread lines extending from a first side 1442 of a first seam 1440, through sole 1480, and to a second side 1444 of first seam 1440. Upper 1410 may also include a plurality of thread lines 1436 defining a second set 1426 of thread lines extending from a first side 1452 of a second seam 1450, through sole 1480, and to a second side 1454 of second seam 1450.

In some embodiments, first and second sets 1422, 1426 may be portions of the same thread pattern. In some embodiments, first and second sets 1422, 1426 may be separate thread patterns.

In some embodiments, a first end 1423 of first thread set 1422 may be directly coupled to a second end 1424 of first thread set 1422 at first seam 1440. In some embodiments, first end 1423 of thread set 1422 may be directly bonded to second end 1424 of thread set 1422 at first seam 1440.

Similarly, in some embodiments, a first end 1427 of second thread set 1426 may be directly coupled to a second end 1428 of second thread set 1426 at second seam 1450. In some embodiments, first end 1427 of thread set 1426 may be directly bonded to second end 1428 of thread set 1426 at second seam 1450.

In some embodiments, a portion of first end 1423 of first thread set 1422 and a portion of second end 1424 may overlap at first seam 1440. At the overlap, first end 1423 and second end 1424 may be coupled by, for example, a stich, or via direct bonding of a polymeric material of first thread set 1422.

Similarly, in some embodiments, a portion of first end 1427 of second thread set 1426 and a portion of second end 1428 may overlap at second seam 1450. At the overlap, first end 1427 and second end 1428 may be coupled by, for example, a stich, or via direct bonding of a polymeric material of second thread set 1426.

Thread lines 1432 of first thread set 1422 may be directly or indirectly coupled together at first seam 1440. In some embodiments, thread lines 1432 may be stitched together at seam 1440. In some embodiments, thread lines 1432 may be directly bonded at seam 1440. In such embodiments, thread lines 1432 may be directly bonded at seam 1440 via a polymeric material of the thread lines 1432.

Similarly, thread lines 1436 of second thread set 1426 may be directly or indirectly coupled together at second seam 1450. In some embodiments, thread lines 1436 may be stitched together at seam 1450. In some embodiments, thread lines 1436 may be directly bonded at seam 1450. In such embodiments, thread lines 1436 may be directly bonded at seam 1450 via a polymeric material of the thread lines 1436.

In some embodiments, a plurality of thread lines 1432 of first thread set 1422 may extend from a first side 1442 of first seam 1440, through sole 1480, and to a second side 1444 of first seam 1440. In some embodiments, a plurality of thread lines 1432 of first thread set 1422 extending from first side 1442 of seam 1440, through sole 1480, and to second side 1444 of seam 1440 may be continuous thread lines. For example, the thread lines 1432 may be a continuous thread line extending between anchor points in a thread pattern as described herein. In some embodiments, thread set 1422 may include anchor points. In some embodiments, thread set 1422 may not include anchor points because anchor points have been removed from thread set 1422.

Similarly, in some embodiments, a plurality of thread lines 1436 of second thread set 1426 extend from a first side 1452 of second seam 1450, through sole 1480, and to a second side 1454 of second seam 1450. In some embodiments, a plurality of thread lines 1436 of second thread set 1426 extending from first side 1452 of seam 1450, through sole 1480, and to second side 1454 of seam 1450 may be continuous thread lines. For example, the thread lines 1436 may be a continuous thread line extending between anchor points in a thread pattern as described herein. In some embodiments, thread set 1426 may include anchor points. In some embodiments, thread set 1426 may not include anchor points because anchor points have been removed from thread set 1426.

In some embodiments, thread lines 1432 of thread set 1422 may extend from a medial side 1412 of upper 1410, through sole 1480, and to a lateral side 1414 of upper 1410. In some embodiments, a plurality of thread lines 1432 of first thread set 1422 extending from medial side 1412 of upper 1410, through sole 1480, and to lateral side 1414 of upper 1410 may be continuous thread lines. Thread lines 1432 that extend from medial side 1412 of upper 1410, through sole 1480, and to lateral side 1414 of upper 1410 may or may not be coupled at first seam 1440. In some embodiments, thread lines 1432 that extend from medial side 1412 of upper 1410, through sole 1480, and to lateral side 1414 of upper 1410 may be directly or indirectly coupled to the sides of upper 1410. For example, the thread lines 1432 may be stitched or directly bonded to the sides of upper 1410.

Similarly, in some embodiments, thread lines 1436 of thread set 1426 may extend from a medial side 1412 of upper 1410, through sole 1480, and to a lateral side 1414 of upper 1410. In some embodiments, a plurality of thread lines 1436 of second thread set 1426 extending from medial side 1412 of upper 1410, through sole 1480, and to lateral side 1414 of upper 1410 may be continuous thread lines. Thread lines 1436 that extend from medial side 1412 of upper 1410, through sole 1480, and to lateral side 1414 of upper 1410 may or may not be coupled at second seam 1450. In some embodiments, thread lines 1436 that extend from medial side 1412 of upper 1410, through sole 1480, and to lateral side 1414 of upper 1410 may be directly or indirectly coupled to the sides of upper 1410. For example, the thread lines 1436 may be stitched or directly bonded to the sides of upper 1410.

In some embodiments, thread lines 1432 extending through sole 1480 may extend through midsole 1482. In some embodiments, thread lines 1432 extending through sole 1480 may extend through outsole 1484. In some embodiments, thread lines 1432 extending through sole 1480 may extend through an interface between midsole 1482 and outsole 1484.

Similarly, in some embodiments, thread lines 1436 extending through sole 1480 may extend through midsole 1482. In some embodiments, thread lines 1436 extending through sole 1480 may extend through outsole 1484. In some embodiments, thread lines 1436 extending through sole 1480 may extend through an interface between midsole 1482 and outsole 1484.

In some embodiments, a portion of each of the plurality of thread lines 1432 that extend through sole 1480 is embedded within sole 1480. In some embodiments, a portion of each of the plurality of thread lines 1432 that extend through sole 1480 is embedded within midsole 1482. In some embodiments, a portion of each of the plurality of thread lines 1432 that extend through sole 1480 is embedded within outsole 1484.

Similarly, in some embodiments, a portion of each of the plurality of thread lines 1436 that extend through sole 1480 is embedded within sole 1480. In some embodiments, a portion of each of the plurality of thread lines 1436 that extend through sole 1480 is embedded within midsole 1482. In some embodiments, a portion of each of the plurality of thread lines 1436 that extend through sole 1480 is embedded within outsole 1484.

In some embodiments, a plurality of thread lines 1432 may extend from first side 1442 of first seam 1440, over a portion of a first side (for example, the medial side 1486) of sole 1480, through sole 1480, over a portion of a second side (for example, the lateral side) of sole 1480, and to second side 1444 of first seam 1440. In some embodiments, a plurality of thread lines 1432 may extend from medial side 1412 of upper 1410, over a portion of a first side (for example, the medial side 1486) of sole 1480, through sole 1480, over a portion of a second side (for example, the lateral side) of sole 1480, and to lateral side 1414 of upper 1410. In such embodiments, thread set 1422 extends from upper 1410 and covers a portion of the side surfaces of sole 1480.

Similarly, in some embodiments, a plurality of thread lines 1436 may extend from first side 1452 of second seam 1450, over a portion of a first side (for example, the medial side 1486) of sole 1480, through sole 1480, over a portion of a second side (for example, the lateral side) of sole 1480, and to second side 1454 of second seam 1450. In some embodiments, a plurality of thread lines 1436 may extend from medial side 1412 of upper 1410, over a portion of a first side (for example, the medial side 1486) of sole 1480, through sole 1480, over a portion of a second side (for example, the lateral side) of sole 1480, and to lateral side 1414 of upper 1410. In such embodiments, thread set 1426 extends from upper 1410 and covers a portion of the side surfaces of sole 1480.

Thread lines 1432 that extend through sole 1480 may enter sole 1480 at an entry point on a side surface of sole 1480. For example, as shown in FIG. 14, thread lines 1422 may enter sole 1480 at entry points 1494 on medial side 1486 of sole 1480. Lateral side of sole 1480 may have entry points similar to entry points 1494. A plurality of entry points 1494 on sole 1480 may be referred to as an entry line 1495. Entry line 1495 extends along a side surface of sole 1480 and is defined by the plurality of entry points 1494 for each thread line 1432 extending through sole 1480.

Similarly, thread lines 1436 that extend through sole 1480 may enter sole 1480 at an entry point on a side surface of sole 1480. For example, as shown in FIG. 14, thread lines 1436 may enter sole 1480 at entry points 1496 on medial side 1486 of sole 1480. Lateral side of sole 1480 may have entry points similar to entry points 1496. A plurality of entry points 1496 on sole 1480 may be referred to as an entry line 1497. Entry line 1497 extends along a side surface of sole 1480 and is defined by the plurality of entry points 1496 for each thread line 1436 extending through sole 1480.

In some embodiments, first set 1422 of thread lines 1432 and second set 1426 of thread lines 1436 may be disposed in the same portion of an article of footwear, for example a forefoot portion, a midfoot portion, or a heel portion. In some embodiments, first set 1422 of thread lines 1432 and second set 1426 of thread lines 1436 may be disposed in different portions of an article of footwear. For example, in some embodiments, first set 1422 may be disposed in a forefoot portion of an article of footwear and second set 1426 may be disposed in a heel portion of the article of footwear. As another example, in some embodiments, first set 1422 may be disposed in a forefoot portion of an article of footwear and second set 1426 may be disposed in a midfoot portion of the article of footwear.

In some embodiments, first set 1422 of thread lines 1432 may at least partially overlap second set 1426 of thread lines 1436 on an article of footwear. In some embodiments, first set 1422 of thread lines 1432 may not overlap second set 1426 of thread lines 1436. In some embodiments, there may be more than two sets of thread lines. Each set of thread lines may have characteristics as described for first set 1422 and second set 1426.

In some embodiments, first set 1422 of thread lines 1432 may extend through sole 1480 at a first distance 1498 from bottom surface 1492 of sole 1480, and second set 1426 of thread lines 1436 may extend through sole 1480 at a second distance 1499 from bottom surface 1492 of sole 1480.

As shown in FIG. 14, first distance 1498 and second distance 1499 may be defined by the vertical distance between bottom surface 1492 of sole 1480 and entry lines 1495, 1497. In embodiments where bottom surface 1492 includes traction members, such as tread, bottom surface 1492 is defined by the bottommost surfaces of the traction members. In embodiments wherein distances 1498, 1499 vary along lines 1495, 1497, the average distance along lines 1495, 1497 defines distances 1498, 1499.

First distance 1498 and second distance 1499 may be different. In some embodiments, first distance 1498 may be less than second distance 1499. In some embodiments, first distance 1498 may be greater than second distance 1499. In some embodiments, second distance 1499 may be 10% or more different from first distance 1498. By tailoring first distance 1498 and second distance 1499, various characteristics of an article of footwear can be controlled. For example, sole 1480 can be provided with desired stiffness at different regions of the sole. Such regional stiffness can control how a wearer's foot and/or sole 1480 deforms during use. For example, a relatively large distance 1498/1499 can help control the way sole 1480 deforms when it contacts the ground during use.

Articles of footwear including one or more wound thread patterns integrated into a sole may be made by embedding the one or more wound thread patterns in a sole material. In some embodiments, embedding the one or more wound thread patterns may include directly molding a sole material on the wound thread pattern(s) such that a least a portion of the thread pattern(s) is embedded within the sole material. In some embodiments, a process for directly molding a sole material on the wound thread patterns(s) may include injection molding a sole material around the thread pattern(s).

In some embodiments, one or more wound thread patterns may be wound around a support structure, such as a support plate described herein, and then placed into a mold for molding a sole material on the wound thread pattern(s). In some embodiments, one or more wound thread patterns may be wound on a mold plate for molding a sole material on the wound thread pattern(s). For example, a mold plate may include anchor points for winding a continuous thread into one or more thread patterns. And after winding the thread pattern(s) on the anchor points of the mold plate, sole material may be molded on the wound thread pattern(s) using the mold plate.

Figure 15A:
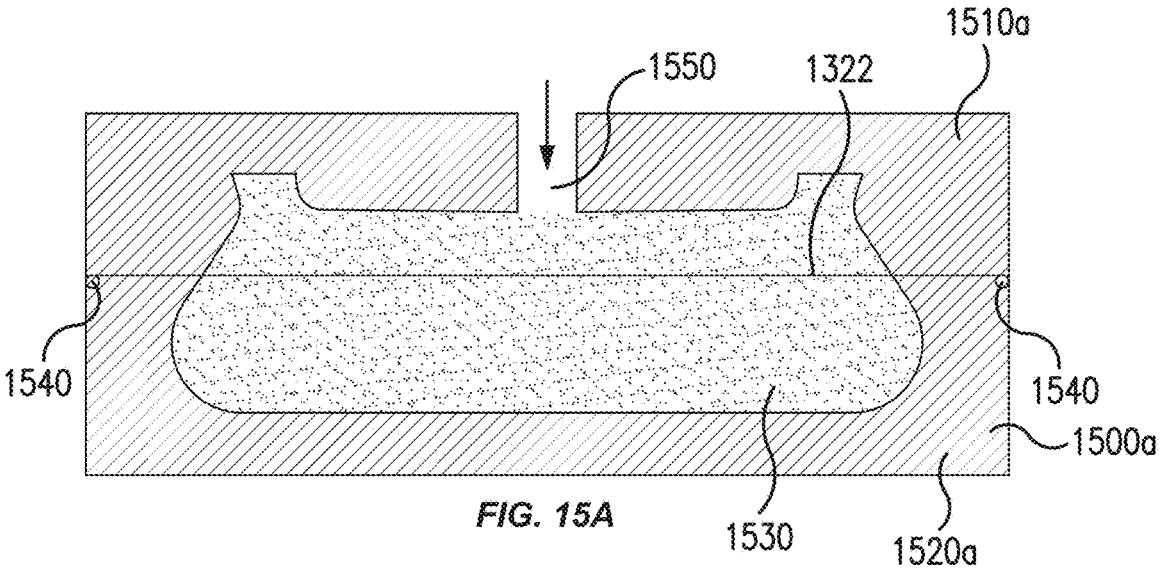
FIG. 15A shows a mold according to some embodiments.
Figure 15B:
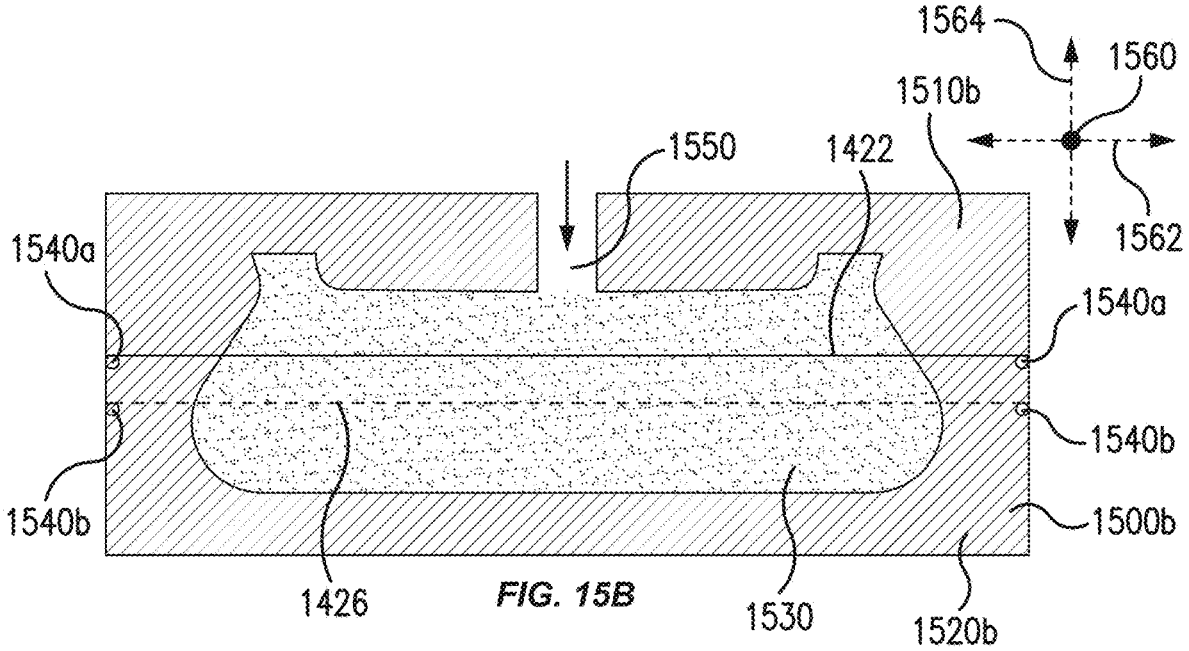
FIG. 15B shows a mold according to some embodiments.

FIGS. 15A and 15B show molds 1500*a* and 1500*b* for molding a sole material on one or more thread patterns according to some embodiments. Mold 1500*a* is described in reference to molding a sole material (sole 1380) around thread pattern 1322. Mold 1500*b* is described in reference to molding a sole material (sole 1480) around thread sets 1422 and 1426.

Mold 1500*a* includes a first mold plate 1510*a* and a second mold plate 1520*a*. When assembled together first mold plate 1510*a* and second mold plate 1520*a* define a mold cavity 1530. In some embodiments, during use, a sole material may be flowed into mold cavity 1530 through a port (for example port 1550) to mold the sole material around thread pattern 1322. In some embodiments, a sole material may be injected into mold cavity 1530 through port 1550. In some embodiments, mold 1500*a* may be a compression mold. In such embodiments, during use, a first sole material piece may be placed into mold 1500*a*, thread pattern 1322 may be wound or placed over the first sole material piece, a second sole material piece is placed over thread pattern 1322, and the two sole material pieces are compression molded around thread pattern 1322.

As shown in FIG. 15A, thread pattern 1322 may be disposed between first mold plate 1510*a* and second mold plate 1520*a* such that at least a portion of thread pattern 1322 is located within mold cavity 1530. In some embodiments, first end 1323 and second end 1324 of thread pattern 1322 may not be located within mold cavity 1530 so that these ends may remain free of sole material after molding. The portion of thread pattern 1322 located within mold cavity 1530 may be embedded within a sole material when the sole material is molded around thread pattern 1322 in mold cavity 1530.

In some embodiments, all of thread pattern 1322 may be located within mold cavity 1530. In such embodiments, first end 1323 and second end 1324 may terminate inside a sole molded on thread pattern 1322. In some embodiments, one of first end 1323 and second end 1324 may terminate inside a sole molded on thread pattern 1322. In such embodiments, the end not terminating inside the sole may be directly or indirectly coupled to a side of upper 1310. In some embodiments, the end directly or indirectly coupled to a side of upper 1310 may define all or a portion of a structural element on upper, for example a lace reinforcement.

In some embodiments, mold 1500*a* may include anchor points 1540 for winding thread pattern 1322 on mold 1500*a*. Anchor points 1540 may be located on first mold plate 1510*a* or second mold plate 1520*a*. Anchor points 1540 may be, for example, pins or projections extending from first mold plate 1510*a* or second mold plate 1520*a*. In such embodiments, thread pattern 1322 may be wound around anchors points 1540, first mold plate 1510*a* and second mold plate 1520*a* are assembled to form mold cavity 1530, and then sole material is molded on thread pattern 1322 in mold cavity 1530.

Mold 1500*b* includes first mold plate 1510*b* and second mold plate 1520*b*. Like first mold plate 1510*a* and second mold plate 1520*a*, when assembled together, first mold plate 1510*b* and second mold plate 1520*b* define mold cavity 1530.

As shown in FIG. 15B, first thread set 1422 and second thread set 1426 may be disposed between first mold plate 1510*b* and second mold plate 1520*b* such that a portion of both thread sets is located within mold cavity 1530. First end 1423 and second end 1424 of first thread set 1422 are not located within mold cavity 1530 so that these ends may remain free of sole material after molding. Similarly, first end 1427 and second end 1428 of second thread set 1426 are not located within mold cavity 1530 so that these ends may remain free of sole material after molding. The portions of thread sets 1422, 1426 located within mold cavity 1530 may be embedded within a sole material when the sole material is molded around thread sets 1422, 1426 in mold cavity 1530.

In some embodiments, mold 1500*b* may include anchor points 1540 for winding first thread set 1422 and second thread set 1426 on mold 1500*b*. Anchor points 1540 may be located on first mold plate 1510*b* or second mold plate 1520*b*. Anchor points 1540 may be, for example, pins or projections extending from first mold plate 1510*b* or second mold plate 1520*b*. In such embodiments, thread sets 1422, 1426 may be wound around anchors points 1540, first mold plate 1510*b* and second mold plate 1520*b* are assembled to form mold cavity 1530, and then sole material is molded on thread sets 1422, 1426 in mold cavity 1530.

In some embodiments, anchor points 1540 of mold 1500*b* may include two or more anchor points 1540 separated from each other in a longitudinal direction 1560 (into the page), a transverse direction 1562, and/or a vertical direction 1564 orthogonal to longitudinal direction 1560 and transverse direction 1562. For example, compared to anchor points 1540*b*, anchor points 1540*a* may be forwardly located in longitudinal direction 1560, inwardly located in transverse direction 1562, and/or upwardly located in vertical direction 1564. By separating anchor points 1540 in this fashion, thread sets 1422, 1426 may be wound at desired locations and to have desired dimensions relative to a sole. For example, by separating anchor points 1540 in vertical direction 1564, first and second thread sets 1422, 1426 may extend through sole 1480 at different distances 1498, 1499, as illustrated in FIG. 14

In some embodiments, a surface of a thread pattern as described herein may be textured. In some embodiments, a surface of thread pattern may be textured using one or more of the following techniques.

Figure 16:
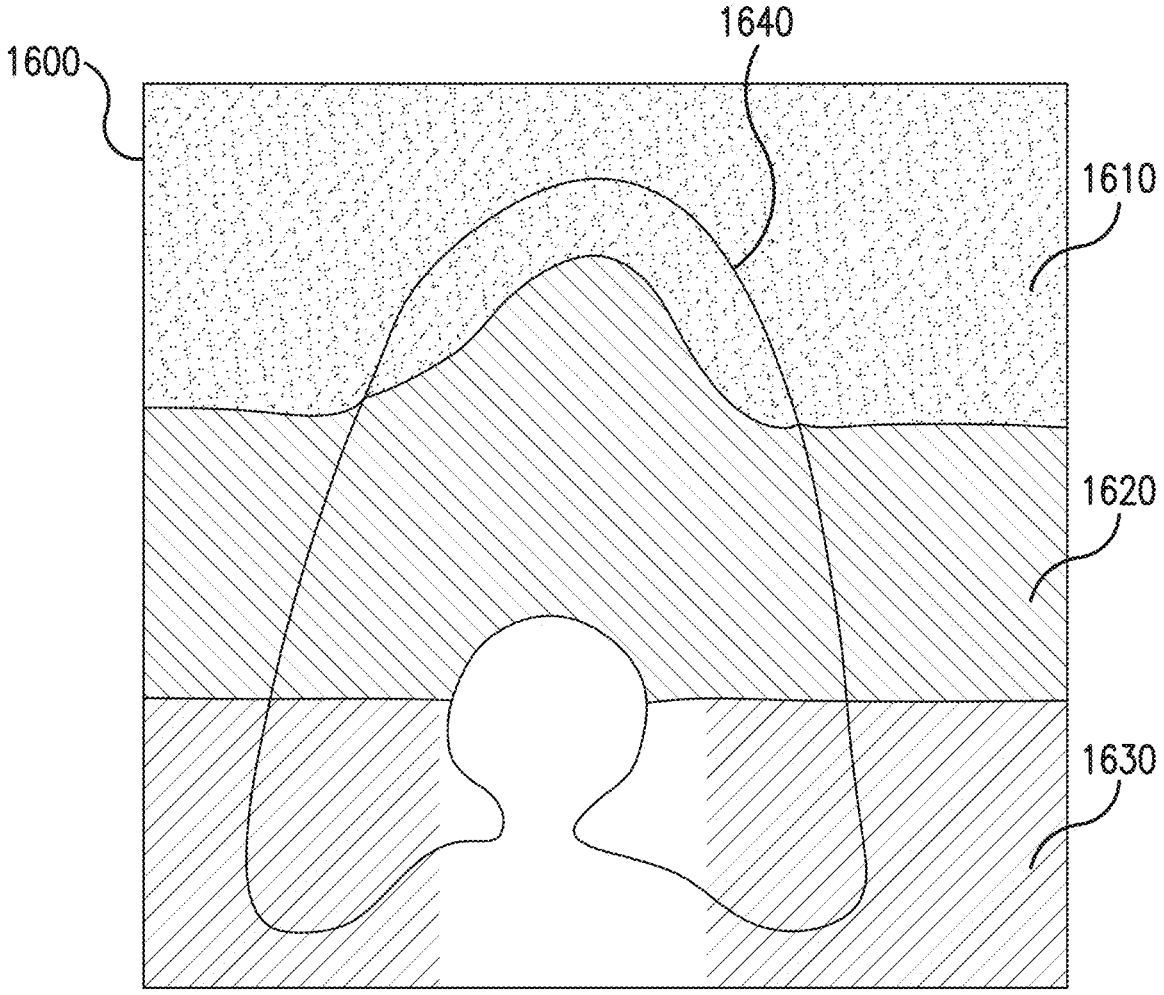
FIG. 16 shows a textured sheet according to some embodiments.

In some embodiments, a textured sheet may be utilized to impart texture to a surface of a thread pattern. FIG. 16 illustrates a textured sheet 1600 according to some embodiments. Textured sheet 1600 includes a plurality of regions with different textures and/or elevations. For example, textured sheet 1600 may include a first region 1610 having a first texture and/or elevation, a second region 1620 having a second texture and/or elevation, and a third region 1630 having a third texture and/or elevation. In some embodiments, one or more regions of textured sheet 1600 may have a smooth surface texture. Different elevations of textured sheet 1600 may impart differently raised areas on a thread pattern. Different elevations of textured sheet 1600 may be created by varying the thickness of textured sheet 1600.

During use, a thread pattern may be placed on textured sheet 1600, in for example the outlined area 1640 shown in FIG. 16. After being placed on textured sheet 1600, the thread pattern may be pressed onto sheet 1600 to impart the textured surface of sheet 1600 onto a surface of the thread pattern. In some embodiments, heat and pressure may be applied to impart the textured surface of sheet 1600 onto a surface of the thread pattern. In some embodiments, textured sheet 1600 and a thread pattern may be pressed in a heat press (for example, heat press 900) to impart the textured surface of sheet 1600 onto a surface of the thread pattern.

In some embodiments, textured sheet 1600 maybe a polymeric sheet. Suitable materials for textured sheet 1600 include, but are not limited to, silicone, polyether ether ketone (PEEK), a polymeric foam, a metal, or a ceramic.

Figure 17:
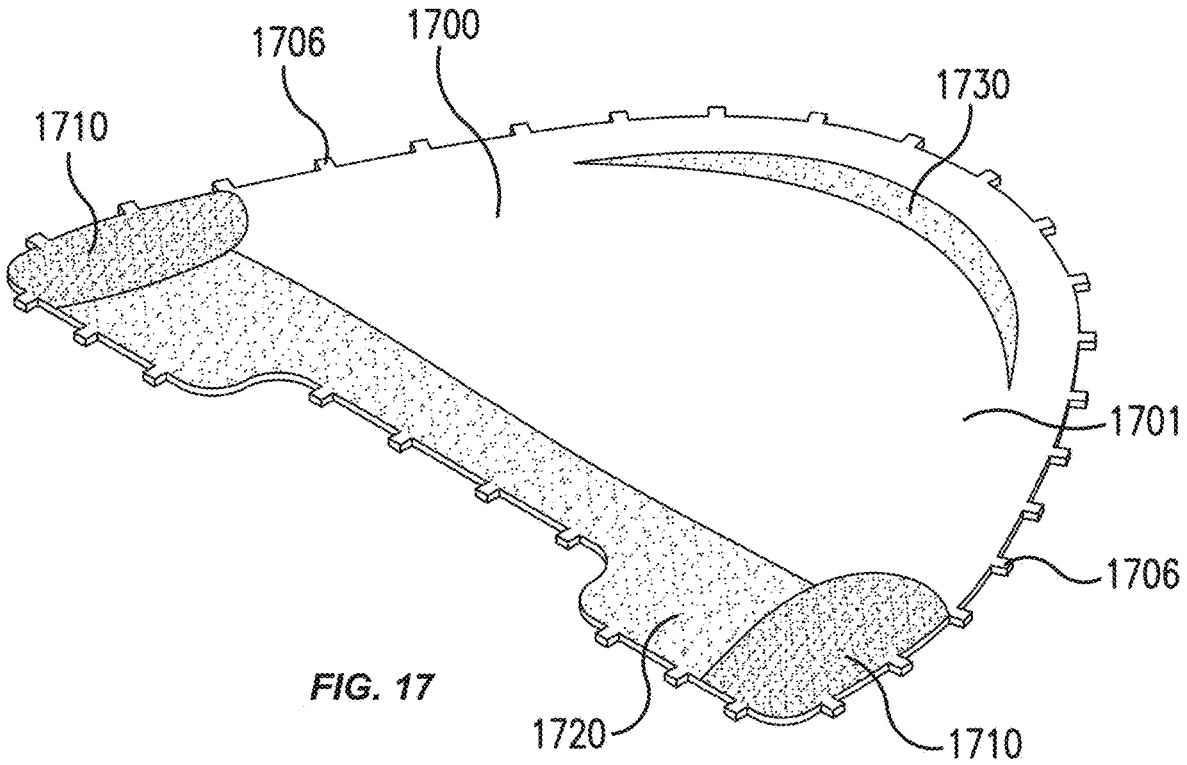
FIG. 17 shows a textured support plate according to some embodiments.

In some embodiments, a textured support plate 1700 may be utilized to impart texture to a surface of a thread pattern. FIG. 17 illustrates a textured support plate 1700 with projections 1706 according to some embodiments. Textured support plate 1700 may include a plurality of regions with different textures and/or elevations. For example, textured support plate 1700 may include two first regions 1710 having a first texture and/or elevation, a second region 1720 having a second texture and/or elevation, and a third region 1730 having a third texture and/or elevation. Textured regions on support plate 1700 may be formed on a front side 1701 of support plate 1700. In some embodiments, one or more regions of textured support plate 1700 may have a smooth surface texture. Different elevations of textured support plate 1700 may impart differently raised areas on a thread pattern. Different elevations of textured support plate 1700 may be created by varying the thickness of support plate 1700.

During use, a thread pattern may be wound over front side 1701 of textured support plate 1700 using projections 1706. After winding the thread pattern, the thread pattern may be pressed onto front side 1701 of support plate 1700 to impart the textured surface of plate 1700 onto a surface of the thread pattern. In some embodiments, heat and pressure may be applied to impart the textured surface of support plate 1700 onto a surface of the thread pattern. In some embodiments, textured support plate 1700 and a thread pattern may be pressed in a heat press (for example, heat press 900) to impart the textured surface of plate 1700 onto a surface of the thread pattern.

In some embodiments, texture may be imparted on a thread pattern by depositing a material on the thread pattern or physically manipulating the thread pattern. Suitable deposition processes for imparting texture to a thread pattern include, but are not limited to, a coating process, fused deposition modeling, and flocking. Suitable processes for physically manipulating a thread pattern to impart texture include, but are not limited to, brushing.

A fused deposition modeling process includes 3D printing a material onto a surface of a thread pattern. A coating process may include coating one or more materials on a surface of a thread pattern. In some embodiments, a coating process may include spraying one or more materials on a surface of a thread pattern. A flocking process may include two steps. First, an adhesive material is zonally coated on a thread pattern. Second, small fiber particles are deposited in areas coated with the adhesive. A brushing process can include raising up threads of a bonded thread pattern. In some embodiments, a brushing process may include passing one or more bristle-covered rollers over a thread pattern.

Figure 18:
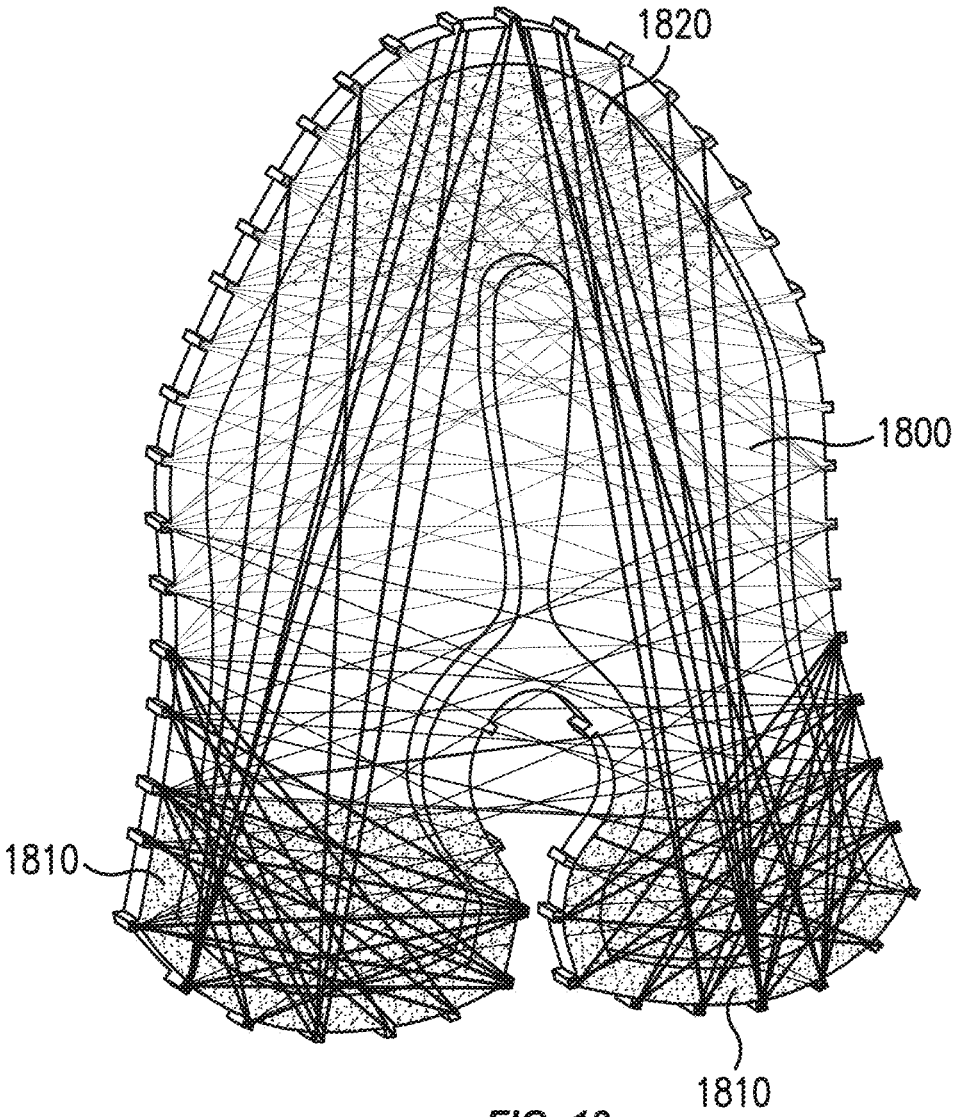
FIG. 18 shows a textured thread pattern according to some embodiments.

FIG. 18 shows an exemplary thread pattern 1800 including a plurality of regions with texture imparted to thread pattern 1800 by depositing a material on thread pattern 1800 or physically manipulating thread pattern 1800. Thread pattern 1800 includes a plurality of first regions 1810 having a first texture and a second region 1820 having a second texture. By varying the process parameters of the processes described above, regions 1810, 1820 may be imparted with different textures.

In some embodiments, a thread pattern may be wound around anchor points to define a portion of a sole. For example, in some embodiments, a thread pattern may be wound around anchor points to define cleats for a sole. As another example, a thread pattern may be wound around anchor points to define a support member for a sole. Exemplary support members include, but are not limited to, torsion plates or stiffening plates. In some embodiments, support members defined by a thread pattern may extend between cleats defined by a thread pattern. As another example, a thread pattern may be wound around anchor points to define an outsole.

Figure 19:
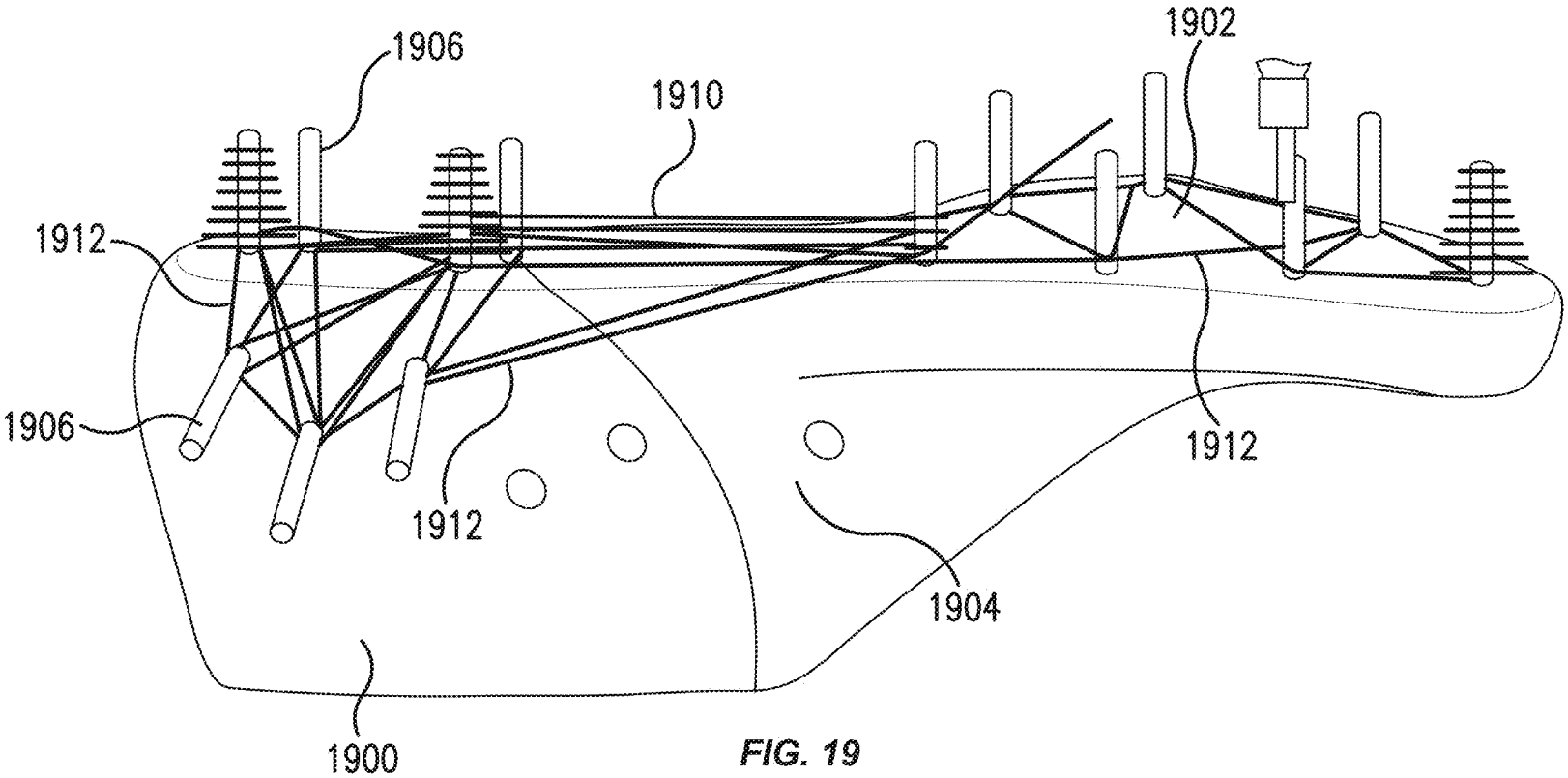
FIG. 19 shows a three-dimensional object according to some embodiments.

FIG. 19 illustrates a three-dimensional object 1900 for winding a thread pattern around anchor points 1906 to define a portion of a sole. In some embodiments, three-dimensional object 1900 may be a last.

Three-dimensional object 1900 includes a sole surface 1902 and an upper surface 1904. Sole surface 1902 includes anchor points 1906 for winding thread lines 1912 of a thread pattern 1910 to define a portion of a sole for an article of footwear. Upper surface 1904 includes anchor points 1906 for winding thread lines 1912 of thread pattern 1910 to define a portion of an upper for an article of footwear.

In some embodiments, three-dimensional object 1900 may be used to simultaneously wind a thread pattern 1910 that defines a portion of a sole and a portion of an upper for an article of footwear. In such embodiments, thread pattern 1910 may include a plurality of thread lines extending from a sole feature (for example, a cleat or support member) to an upper.

In some embodiments, anchor points 1906 may be integrally formed with object 1900. In some embodiments, anchor points 1906 may be removably coupled to object 1900. Anchor points 1906 may be projections, pins, knobs, or studs. In some embodiments, anchor points 1906 may be posts 2030 for a forming a cleat.

Thread lines 1912 of thread pattern 1910 may be bonded to each other at anchor points 1906 and/or intersection points as described herein. Thread pattern 1910 may be removed from object 1900 before or after bonding thread lines 1912. In some embodiments, thread lines 1912 of thread pattern 1910 may be bonded to each other at anchor points 1906 and/or intersection points while thread pattern 1910 is disposed on object 1900. In some embodiments, thread lines 1912 of thread pattern 1910 may be bonded to each other at anchor points 1906 and/or intersection points after thread pattern 1910 is removed from object 1900.

In some embodiments, anchor points 1906 may be incorporated into thread pattern 1910 and define a portion of thread pattern 1910 after thread pattern 1910 is bonded. For example, removable anchor points 1906 may be bonded to thread pattern 1910 and removed from object 1900 when thread pattern 1910 is removed from object 1900. One example of this is when anchor points are posts 2030 for a forming a cleat. In such embodiments, thread lines 1912 may be wound around posts 2030. Then, when bonding the thread lines 1912 at posts 2030, posts 2030 are also bonded to thread lines 1912. In some embodiments, posts 2030 may be directly bonded to thread lines 1912, for example, via a polymeric material of thread lines 1912 and/or posts 2030.

In some embodiments, a sole material may be molded over thread lines defining a portion of a sole. For example, a sole material may be molded over thread lines 1912 on object 1900 defining cleats and/or a support member. In such embodiments, object 1900 may be mold plate or a portion of a mold plate. For example, object 1900 may be mold plate 2020 and sole surface 1902 may be mold surface 2022.

Figure 20A:
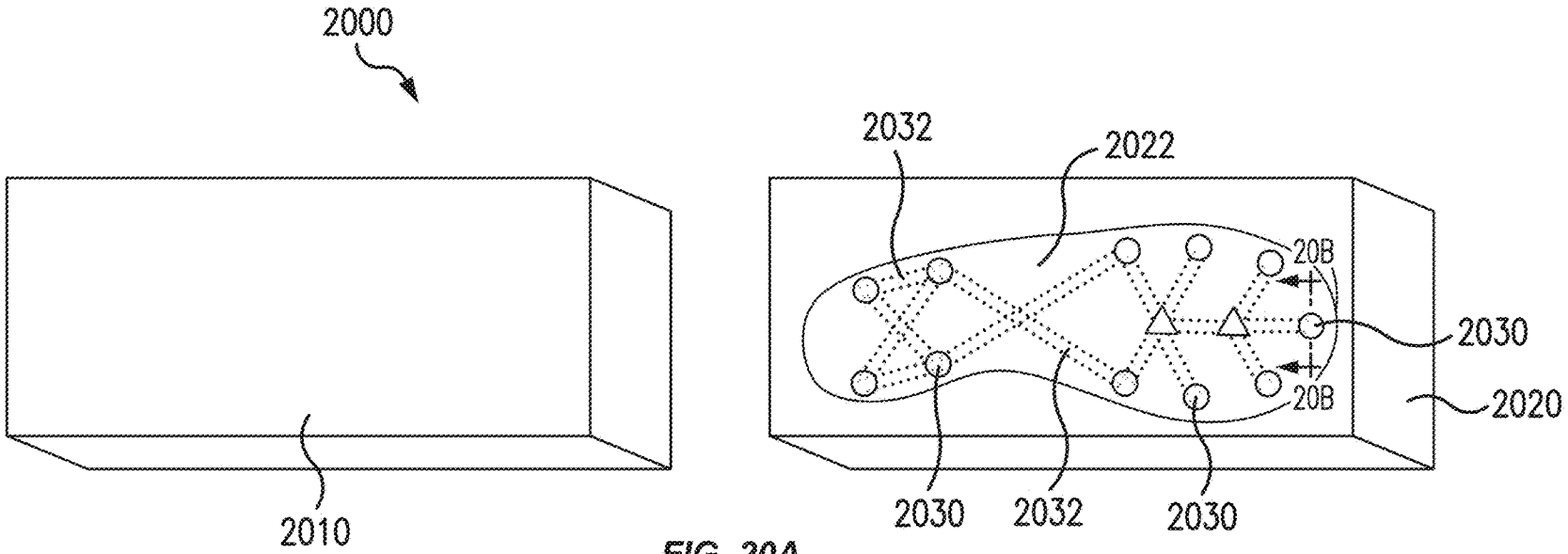
FIG. 20A shows a mold according to some embodiments.

FIG. 20 shows a mold 2000 for molding a sole (for example, sole 180) according to some embodiments. Mold 2000 includes a first mold plate 2010 and a second mold plate 2020. Second mold plate 2020 includes a mold surface 2022 over which a sole material is molded. When assembled, first mold plate 2010 and second mold plate 2020 form a mold cavity having an interior shape corresponding to the shape of a sole for an article of footwear.

Mold surface 2022 includes anchor points for winding a thread pattern. In some embodiments, the anchor points may be posts 2030 for forming traction elements, such as cleats. In some embodiments, the anchor points may be posts 2030 for winding a support member, and some embodiments, the supper member may include posts 2030.

In operation, thread lines 2032 of one or more continuous threads may be wound around posts 2030 in a similar fashion as discussed herein for winding continuous thread(s) around other anchor points. In other words, posts 2030 may define anchor points for thread lines 2032.

Figure 20B:
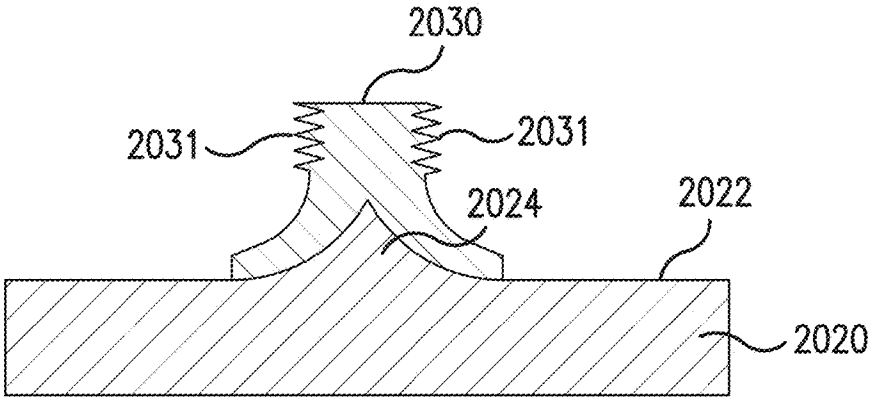
FIG. 20B shows a cross-sectional view of a portion of FIG. 20A according to some embodiments along line 20B-20B.

In some embodiments, as shown for example in FIG. 20B, posts 2130 may be removably attached to mold surface 2022. Removable posts 2030 may be attached to mold surface 2022 via a removable mechanical attachment, such as but not limited to, a friction fit, a magnetic force, and/or via a recess in mold surface 2022. In some embodiments, removable posts 2030 may be removably attached to studs 2024 formed on mold surface 2022. In such embodiments, studs 2024 may be arranged in a pattern for cleats of an article of footwear. In some embodiments, posts 2030 may include ridges 2031 to help hold threads during winding.

In some embodiments, posts 2030 may be irremovably fixed on mold surface 2022. In such embodiments, posts 2030 do not form a portion of a sole. Rather, a finished sole or sole component is removed from posts 2030 after winding and/or molding.

In some embodiments, after winding thread lines 2032 around posts 2030, thread lines 2032 may be bonded to each other at posts 2030 and/or at intersection points to form a sole, or a portion of a sole. In some embodiments, mold 2000 may be utilized to bond thread lines 2032 by applying heat and pressure to thread lines 2032 and posts 2030.

In some embodiments, after winding thread lines 2032 around posts 2030, sole material may be molded around thread lines 2032 and/or posts 2030 within mold 2000. In other words, thread lines 2032 may be embedded with a sole material defining at least a portion of a sole (for example, sole 180). In some embodiments, thread lines 2032 may be bonded to each other at posts 2030 and/or at intersection points before molding a sole material around thread lines 2032 and/or posts 2030 in mold 2000.

In some embodiments, mold 2000 may be an injection-molding mold. In some embodiments, mold 2000 may be used to partially consolidate a sole or sole component and the sole or sole component may be cured to fully solidify it after it is removed from mold 2000.

Figure 21:
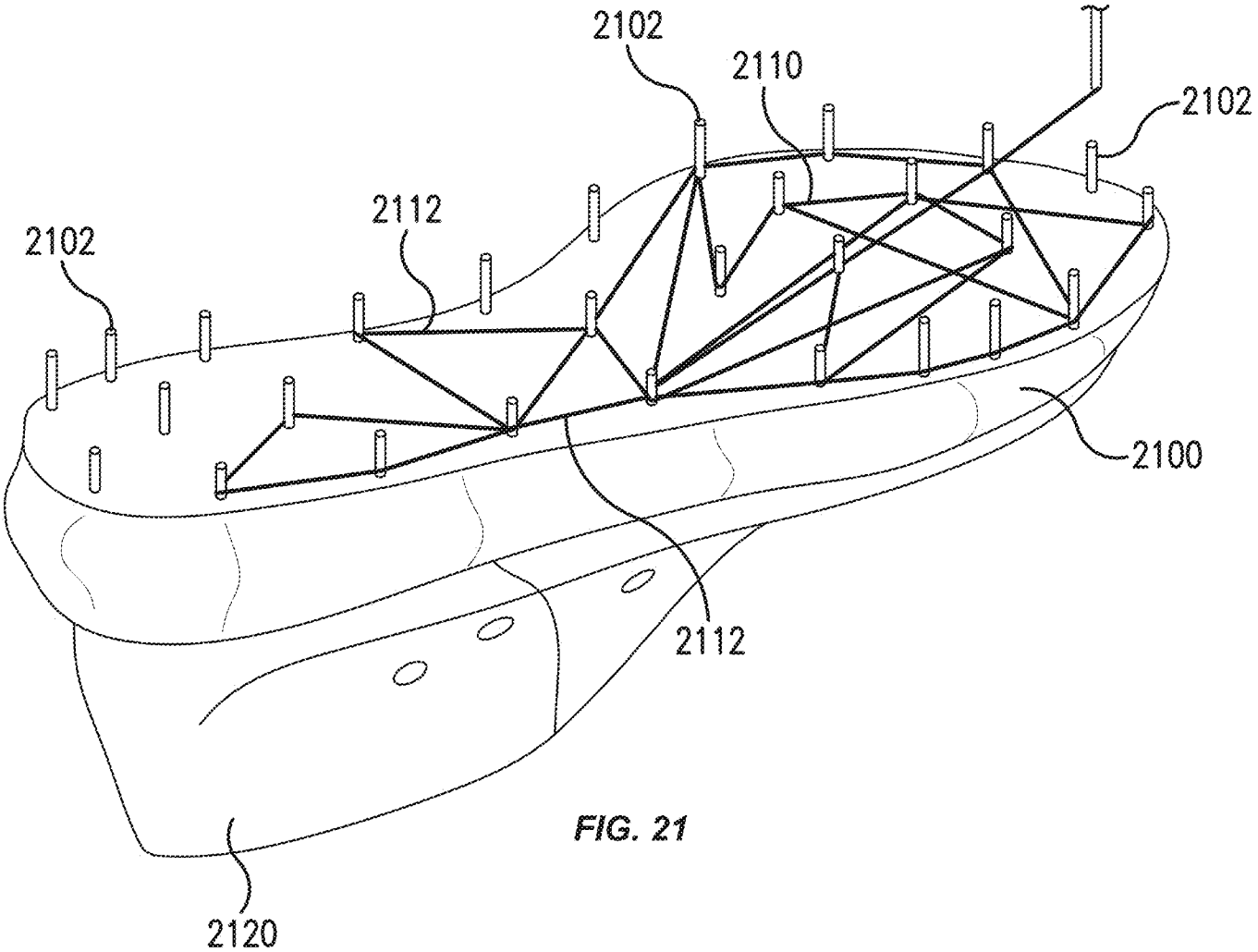
FIG. 21 shows a midsole according to some embodiments.

FIG. 21 illustrates a thread pattern 2110 wound around anchor points 2102 over a bottom surface 2101 of a midsole 2100 to form an outsole according to some embodiments. In some embodiments, anchor points 2102 may be formed on midsole 2100. In other words, anchor points 2102 may define a portion of midsole 2100. In such embodiments, anchor points 2102 may be an integral part of midsole 2100. In some embodiments, anchor points 2102 may be pins, or other similar projecting elements, extending from an object 2120 and through midsole 2100. In some embodiments, three-dimensional object 2120 may be a last or a mold plate.

After winding thread lines 2112 of thread pattern 2110, thread lines 2112 may be may be bonded to each other at anchor points 2102 and/or at intersection points to form an outsole on bottom surface 2101 of midsole 2100. In some embodiments, anchor points 2102 may be bonded to thread pattern 2110 when bonding thread lines 2112 to each other at anchor points 2102 and/or at intersection points. In some embodiments, anchor points 2102 may be directly bonded to thread lines 2112, for example, via a polymeric material of thread lines 2112 and/or anchor points 2102.

In some anchor points 2102 may be removed from midsole 2100 and thread pattern 2110 after bonding thread lines 2112. In such embodiments, anchor points 2102 are not present in a finalized sole including midsole 2100 and an outsole formed using thread pattern 2110.

In some embodiments, a thread pattern as described herein may including padding or lining for enhancing the comfort and/or aesthetics of an upper formed using the thread pattern. In some embodiments, a plurality of padding or lining elements may be disposed on a thread pattern.

Figure 22:
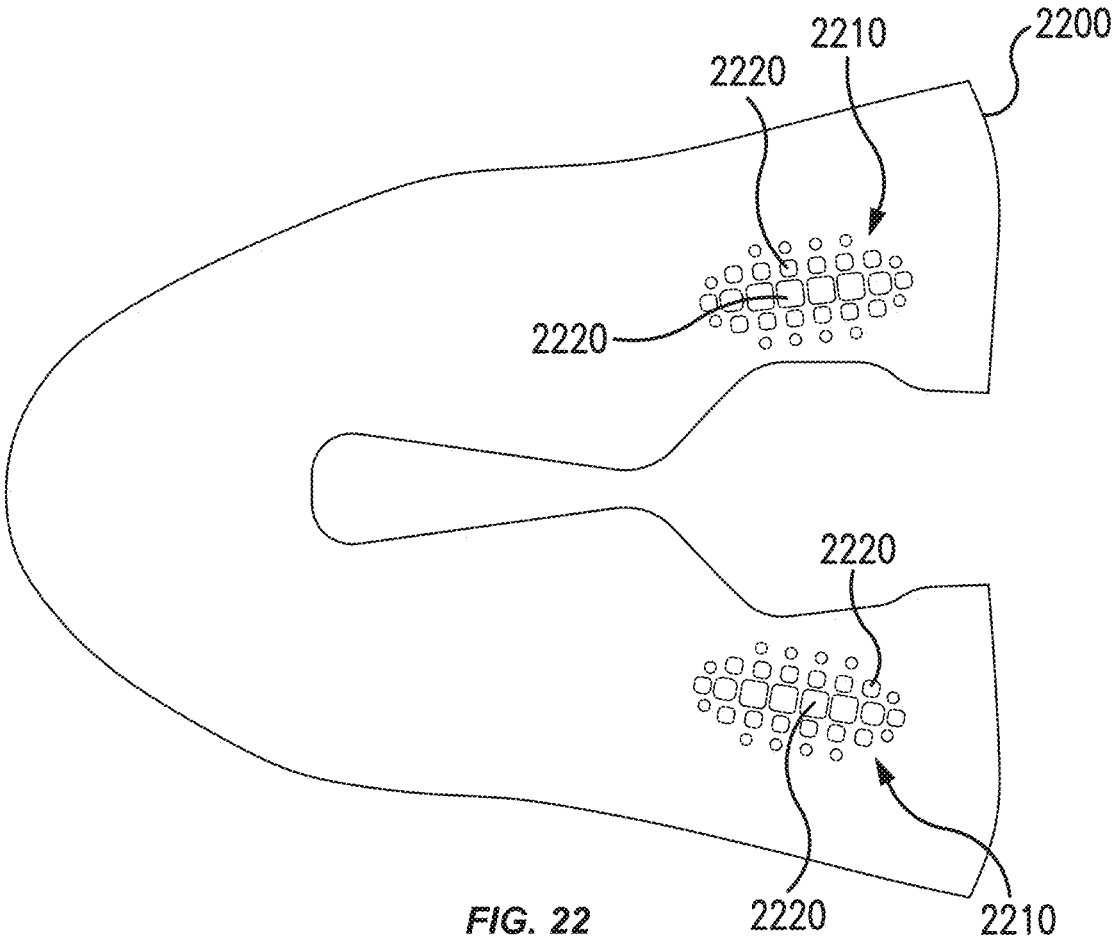
FIG. 22 shows a thread pattern with a padding material according to some embodiments.

FIG. 22 illustrates a padded thread pattern 2200 according to some embodiments. Thread pattern 2200 includes two padded regions 2210 including a plurality of padding elements 2220. Padding elements 2220 may be individual elements separated from each other on thread pattern 2200. Padding elements 2220 may be made of, for example, padding material, liner material, or foam material. Exemplary materials for padding elements include, but are not limited to, a foam, ethyl vinyl acetate (EVA), polyurethane (PU), expanded thermoplastic polyurethane (eTPU), a thermoplastic polyurethane (TPU), a knit fabric, a woven fabric, a non-woven fabric, Spandex, a suede, or a polymeric mesh (for example, a TPU mesh). In some embodiments, the foam may comprise, for example, an EVA-based foam or a PU-based foam and the foam may be an open-cell foam or a closed-cell foam.

In some embodiments, padding elements 2220 may be disposed in one or more discrete padded regions 2210 on a surface of thread pattern 2200. In some embodiments, padding elements 2220 may be disposed over an entire surface of thread pattern 2200. In some embodiments, different padding elements 2220 may have different heights to provide a three-dimensional effect for one or more padded regions 2210.

Figure 23:
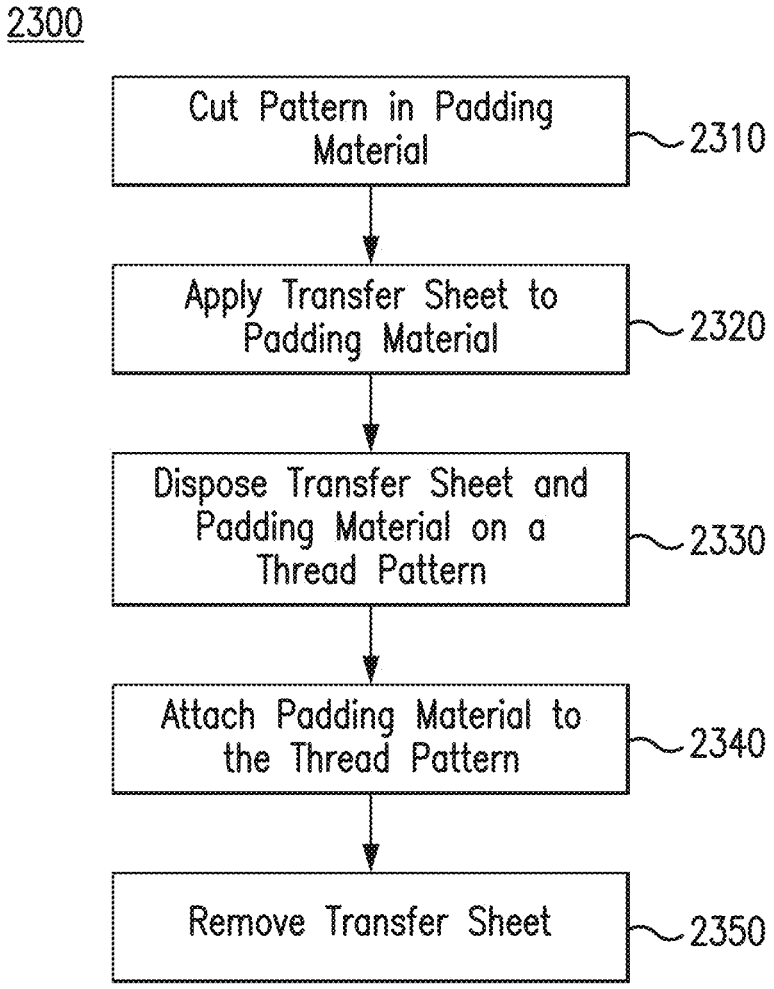
FIG. 23 is an exemplary flowchart of a method according to some embodiments.
Figure 24A:
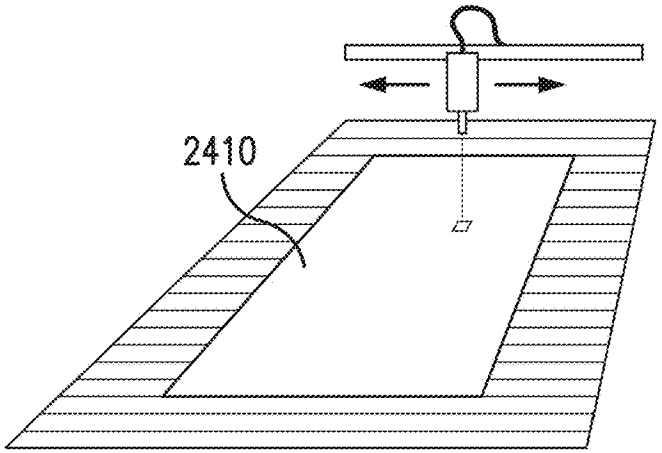
FIGS. 24A-24F show an exemplary process for making an upper according to some embodiments.
Figure 24B:
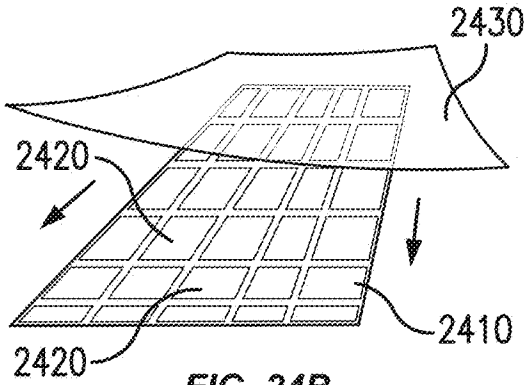
Figure 24C:
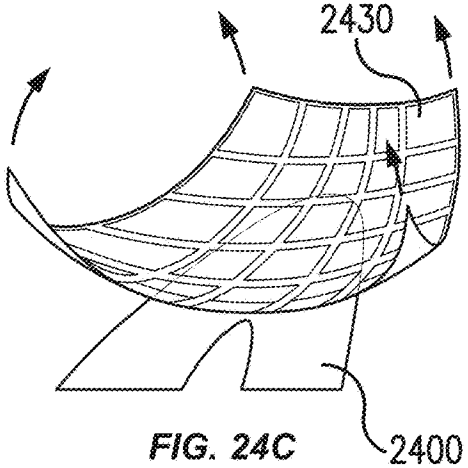
Figure 24D:
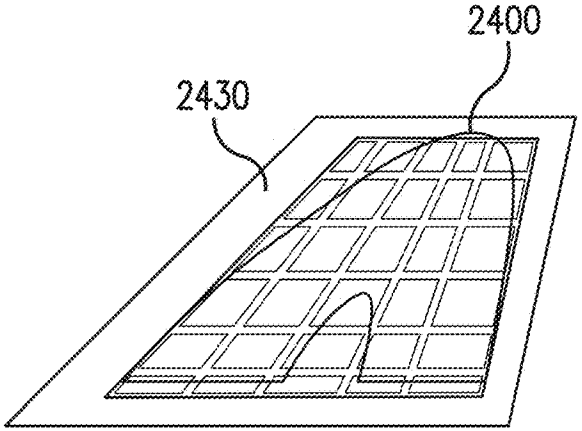
Figure 24E:
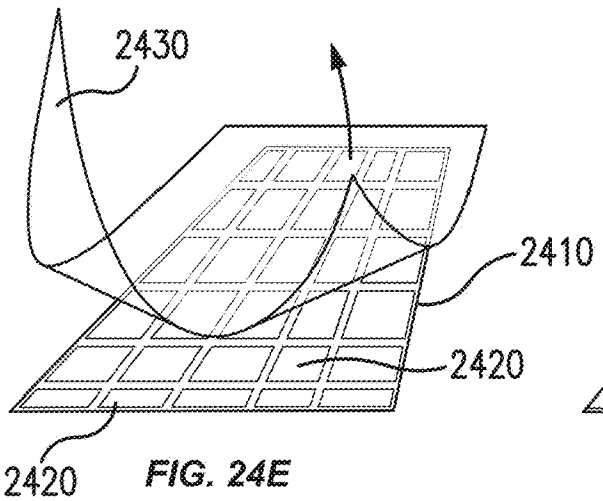
Figure 24F:
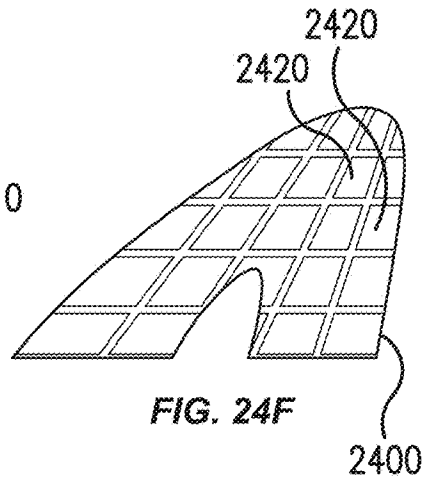

FIG. 23 shows a method 2300 of disposing padding material on a thread pattern according to some embodiments. FIGS. 24A-24F illustrate steps of method 2300. Unless stated otherwise, the steps of method 2300 need not be performed in the order set forth in FIG. 23. Additionally, unless specified otherwise, the steps of method 2300 need not be performed sequentially. The steps can be performed simultaneously.

In step 2310, a pattern is cut in a padding material 2410. The cut pattern may define individual padding elements 2420 to be applied to thread pattern 2400. Cutting padding material 2410 in step 2310 may include any suitable cutting process, for example a laser cutting process.

In step 2320, a transfer sheet 2430 is applied to the cut padding material 2410. Suitable transfer sheets, include, but are not limited to, MYLAR© (a biaxially-oriented polyethylene terephthalate silicone), cellophane, wax paper, and PTFE.

In step 2330, transfer sheet 2430 with padding elements 2420 attached is disposed on thread pattern 2400 such that padding elements 2420 are in contact with a surface of thread pattern 2400.

In step 2340, padding elements 2420 of padding material 2410 are attached to thread pattern 2400. In some embodiments, heat and pressure may be applied to attach padding elements 2420 to thread pattern 2400. In some embodiments, padding elements 2420 and thread pattern 2400 may be pressed in a heat press (for example, heat press 900) to attach padding elements 2420 to thread pattern 2400 in step 2340.

After attaching padding elements 2420 to thread pattern 2400 in step 2340, transfer sheet 2430 is removed in step 2350. Removing transfer sheet 2430 leaves behind padding elements 2420 attached to thread pattern 2400.

Figure 32:
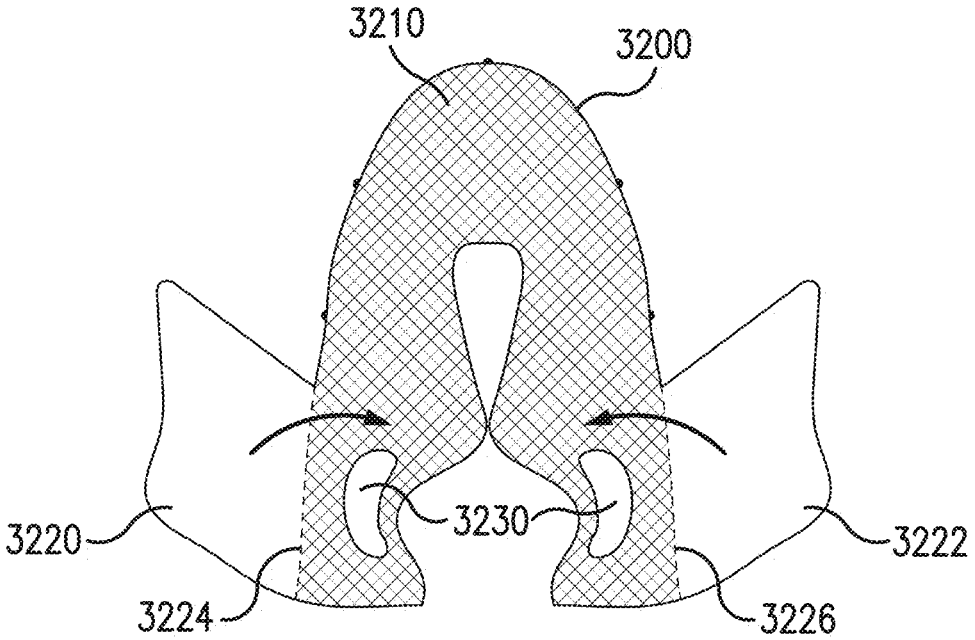
FIG. 32 shows an upper according to some embodiments.

FIG. 32 shows an upper 3200 including a thread pattern 3210 according to some embodiments. In some embodiments, upper 3200 may include a medial flap 3220. In some embodiments, upper 3200 may include a lateral flap 3222. In some embodiments, upper 3200 may include medial flap 3220 and lateral flap 3222.

In some embodiments, medial flap 3220 and/or lateral flap 3222 may be an integral part of thread pattern 3210. In other words, medial flap 3220 and/or lateral flap 3222 may be wound using one or more continuous threads that define the rest of thread pattern 3210.

In some embodiments, medial flap 3220 and/or lateral flap 3222 may be a separate piece attached to thread pattern 3210 at a seam. In particular, medial flap 3220 may be attached to thread pattern 3210 at a seam 3224 and lateral flap 3222 may be attached to thread pattern at a seam 3226. In some embodiments, medial flap 3220 and/or lateral flap 3222 may be a material including a thread pattern as described herein. In some embodiments, medial flap 3220 and/or lateral flap 3222 may not be a material including a thread pattern as described herein. For example, in such embodiments, medial flap 3220 and/or lateral flap 3222 may be a woven or knit material.

In embodiments including medial flap 3220, medial flap 3220 may be folded over a medial portion of upper 3200 and attached to a medial side upper 3200. In some embodiments, folded medial flap 3220 may encapsulate one or more padding elements 3230 between flap 3220 and the medial portion of upper 3200. Padding element(s) 3230 may be composed of, for example, neoprene, ePEBA, eTPU, EVA, TPU, or a foam, such as polyethylene foam, polyurethane foam, or a urethane foam.

In embodiments including lateral flap 3222, lateral flap 3222 may be folded over a lateral portion of upper 3200 and attached to a lateral side upper 3200. In some embodiments, folded lateral flap 3222 may encapsulate a padding element 3230 between flap 3222 and the lateral portion of upper 3200.

Figure 33:
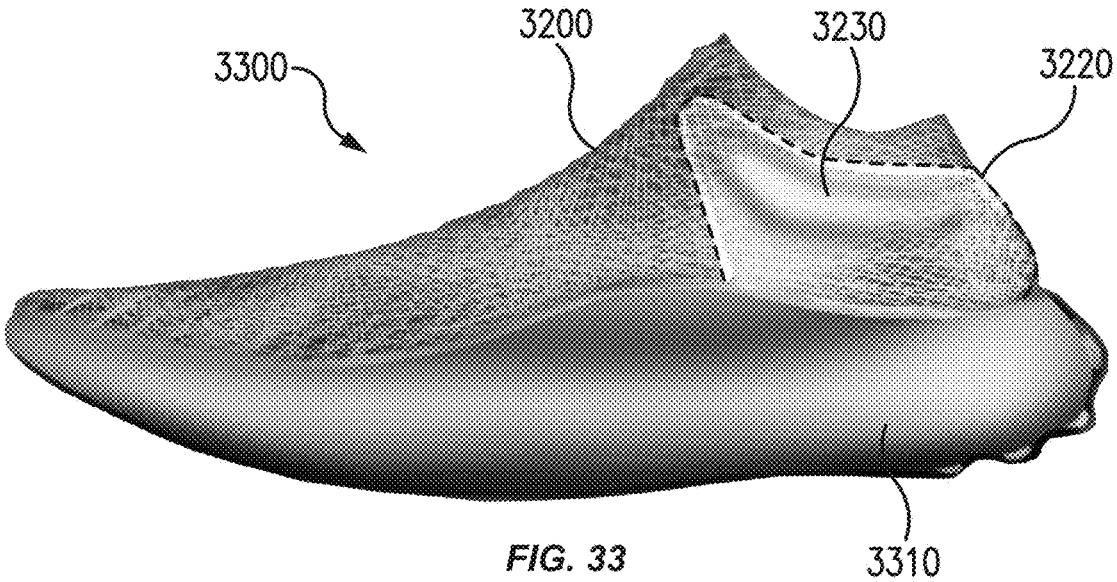
FIG. 33 shows an article of footwear according to some embodiments.

FIG. 33 shows an article of footwear 3300 including a sole 3310 coupled to upper 3200 with medial flap 3220 folded over a medial portion of upper 3200 and encapsulating a padding element 3230 between flap 3220 and the medial portion of upper 3200.

Figure 34:
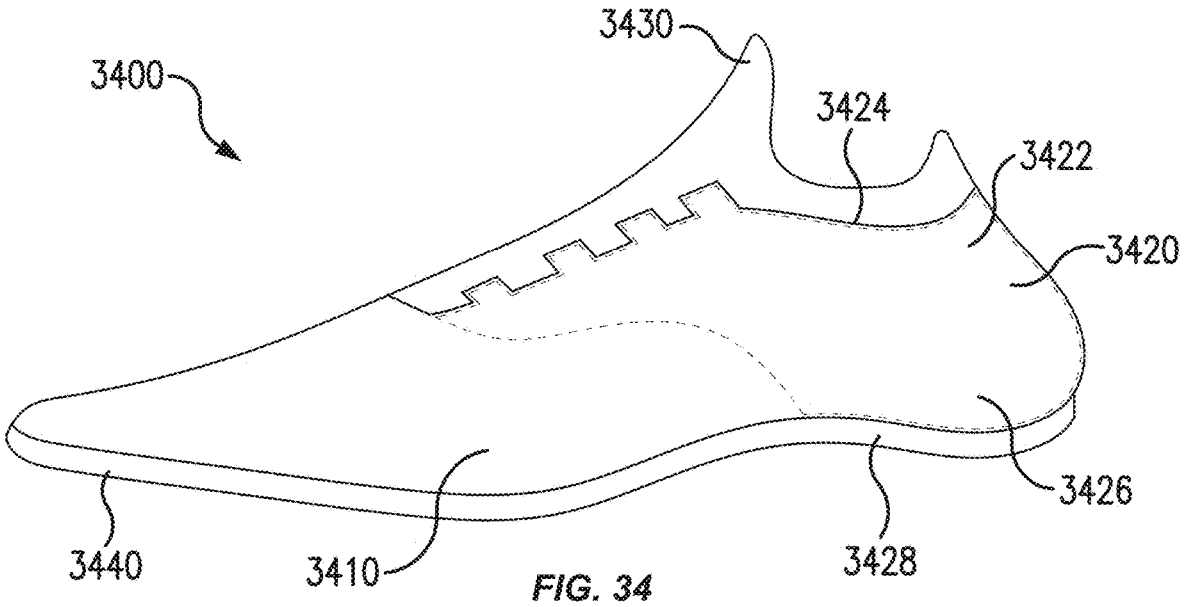
FIG. 34 shows an upper with a lining according to some embodiments.

FIG. 34 shows an upper 3400 according to some embodiments with a lining 3420 attached to a thread pattern 3410. Lining 3420 is disposed interior of thread pattern 3410 on upper 3400. In some embodiments, lining 3420 may be located in a heel portion of upper 3400 and wrap around a heel end of upper 3400.

In some embodiments, upper 3400 may include a collar 3430. In some embodiments, collar 3430 may include a portion defining a throat for upper 3400.

In some embodiments, a top end 3422 of lining 3420 may be attached to thread pattern 3410 at a seam 3424. In some embodiments, top end 3422 of lining 3420 may be attached to collar 3430 at seam 3424. In some embodiments, top end 3422 of lining 3420 may be attached to thread pattern 3410 and/or collar 3430 at seam 3424 and the rest of lining 3420 may not be directly attached to upper 3400. In such embodiments, a bottom end 3426 of lining 3420 may be a free end of lining 3420 not directly attached to upper 3400. In some embodiments, top end 3422 of lining 3420 may be attached to thread pattern 3410 and/or collar 3430 at seam 3424 and the rest of lining 3420 may not be directly attached to upper 3400 or any component of an article of footwear including upper 3400. In such embodiments, bottom end 3426 of lining 3420 may be a free end of lining 3420 not directly attached to upper 3400 or any component of an article of footwear including upper 3400.

In some embodiments, bottom end 3426 of lining 3420 may be attached to thread pattern 3410 at a seam 3428. In some embodiments, bottom end 3426 of lining 3420 may be attached to a bottom cushioning element 3440 at seam 3428. Bottom cushioning element 3440 may be, for example, a strobel board or a sock liner. In some embodiments, bottom end 3426 of lining 3420 may be attached to thread pattern 3410 and/or bottom cushioning element 3440 at seam 3428 and the rest of lining 3420 may not be directly attached to upper 3400. In such embodiments, top end 3422 of lining 3420 may be a free end of lining 3420 not directly attached to upper 3400. In some embodiments, bottom end 3426 of lining 3420 may be attached to thread pattern 3410 and/or cushioning element 3440 at seam 3428 and the rest of lining 3420 may not be directly attached to upper 3400 or any component of an article of footwear including upper 3400. In such embodiments, top end 3422 of lining 3420 may be a free end of lining 3420 not directly attached to upper 3400 or any component of an article of footwear including upper 3400.

While various embodiments have been discussed herein in the context of footwear, and in particular embodiments, uppers for articles of footwear, other articles of apparel may be manufactured using the winding processes discussed herein. Other articles of apparel include, but are not limited to, a strobel board, a sock liner, pants, shorts, leggings, a sock, a jacket, a coat, a hat, a sleeve, a shoe, a sweater, a shirt, a jersey, a bra, a bootie, and a glove. In some embodiments, when making these articles of apparel, and others, a thread pattern may be wound around anchor points to form a thread pattern defining all of a portion of these articles. In some embodiments, when making these articles of apparel, and others, a thread pattern may be wound around anchor points to form a thread pattern as discussed herein and all or a portion of these articles may be cut from the thread pattern. For example, a strobel board may be cut from a thread pattern.

One or more aspects of the methods of manufacturing an article of footwear discussed herein, or any part(s) or function(s) thereof (for example, defining a boundary line and winding continuous threads with a CNC machine), may be implemented using hardware, software modules, firmware, tangible computer readable media having instructions stored thereon, or a combination thereof and may be implemented in one or more computer systems or other processing systems.

Figure 35:
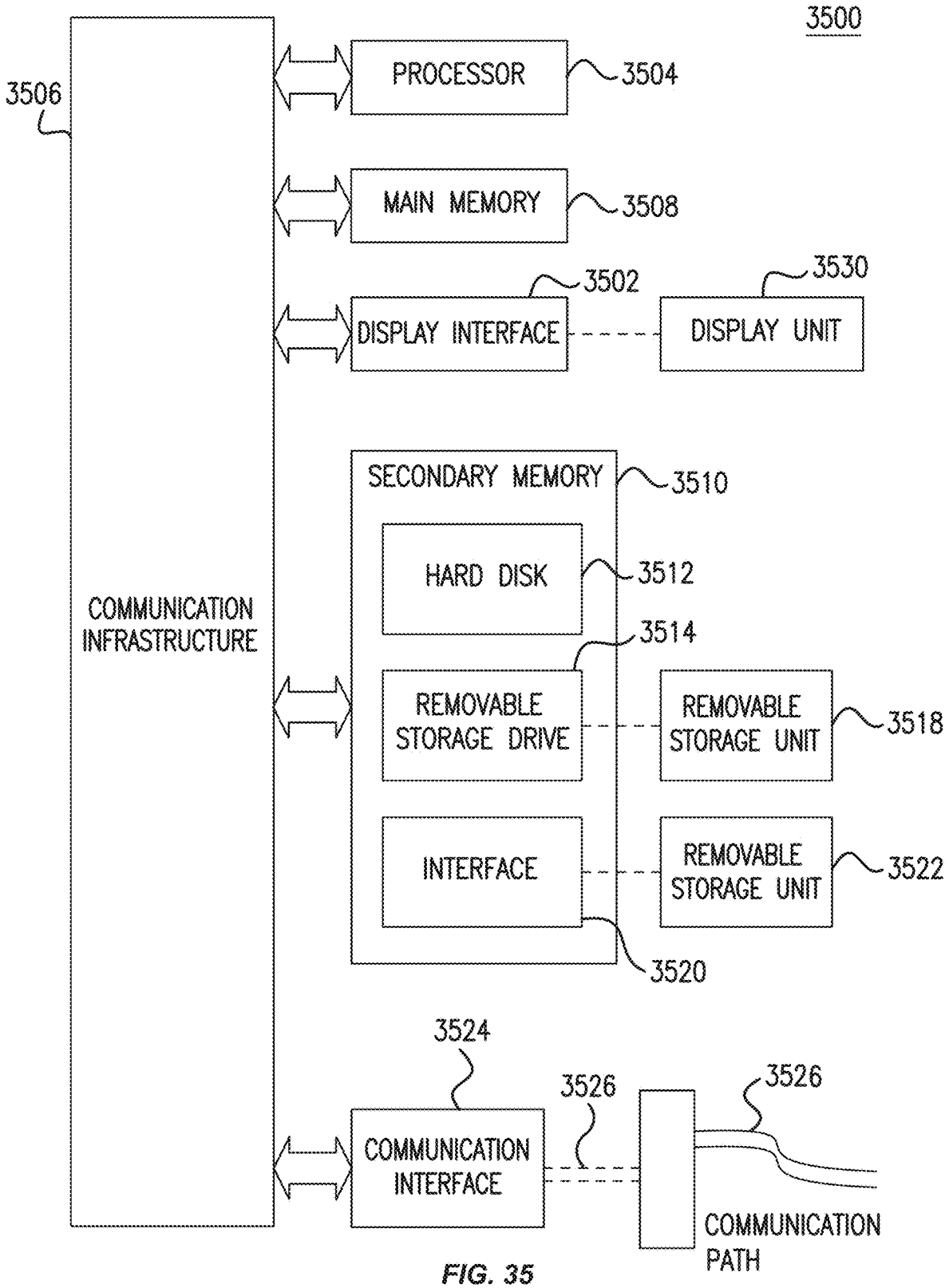
FIG. 35 shows a schematic block diagram of an exemplary computer system in which embodiments may be implemented.

FIG. 35 illustrates an exemplary computer system 3500 in which embodiments, or portions thereof, may be implemented as computer-readable code. For example, aspects of the methods discussed herein may be implemented in computer system 3500 using hardware, software, firmware, tangible computer readable media having instructions stored thereon, or a combination thereof and may be implemented in one or more computer systems or other processing systems.

If programmable logic is used, such logic may execute on a commercially available processing platform or a special purpose device. One of ordinary skill in the art may appreciate that embodiments of the disclosed subject matter can be practiced with various computer system configurations, including multi-core multiprocessor systems, minicomputers, and mainframe computers, computer linked or clustered with distributed functions, as well as pervasive or miniature computers that may be embedded into virtually any device.

For instance, at least one processor device and a memory may be used to implement the above-described embodiments. A processor device may be a single processor, a plurality of processors, or combinations thereof. Processor devices may have one or more processor "cores."

Various embodiments described herein may be implemented in terms of this example computer system 3500. After reading this description, it will become apparent to a person skilled in the relevant art how to implement one or more of the embodiments using other computer systems and/or computer architectures. Although operations may be described as a sequential process, some of the operations may in fact be performed in parallel, concurrently, and/or in a distributed environment, and with program code stored locally or remotely for access by single or multi-processor machines. In addition, in some embodiments the order of operations may be rearranged without departing from the spirit of the disclosed subject matter.

Processor device 3504 may be a special purpose or a general-purpose processor device. As will be appreciated by persons skilled in the relevant art, processor device 3504 may also be a single processor in a multi-core/multiprocessor system, such system operating alone, or in a cluster of computing devices operating in a cluster or server farm. Processor device 3504 is connected to a communication infrastructure 3506, for example, a bus, message queue, network, or multi-core message-passing scheme.

Computer system 3500 also includes a main memory 3508, for example, random access memory (RAM), and may also include a secondary memory 3510. Secondary memory 3510 may include, for example, a hard disk drive 3512, or removable storage drive 3514. Removable storage drive 3514 may include a floppy disk drive, a magnetic tape drive, an optical disk drive, a flash memory, a Universal Serial Bus (USB) drive, or the like. The removable storage drive 3514 reads from and/or writes to a removable storage unit 3518 in a well-known manner. Removable storage unit 3518 may include a floppy disk, magnetic tape, optical disk, etc. which is read by and written to by removable storage drive 3514. As will be appreciated by persons skilled in the relevant art, removable storage unit 3518 includes a computer usable storage medium having stored therein computer software and/or data.

Computer system 3500 (optionally) includes a display interface 3502 (which can include input and output devices such as keyboards, mice, etc.) that forwards graphics, text, and other data from communication infrastructure 3506 (or from a frame buffer not shown) for display on display unit 3530.

In additional and/or alternative implementations, secondary memory 3510 may include other similar means for allowing computer programs or other instructions to be loaded into computer system 3500. Such means may include, for example, a removable storage unit 3522 and an interface 3520. Examples of such means may include a program cartridge and cartridge interface (such as that found in video game devices), a removable memory chip (such as an EPROM, or PROM) and associated socket, and other removable storage units 3522 and interfaces 3520 which allow software and data to be transferred from the removable storage unit 3522 to computer system 3500.

Computer system 3500 may also include a communication interface 3524. Communication interface 3524 allows software and data to be transferred between computer system 3500 and external devices. Communication interface 3524 may include a modem, a network interface (such as an Ethernet card), a communication port, a PCMCIA slot and card, or the like. Software and data transferred via communication interface 3524 may be in the form of signals, which may be electronic, electromagnetic, optical, or other signals capable of being received by communication interface 3524. These signals may be provided to communication interface 3524 via a communication path 3526. Communication path 3526 carries signals and may be implemented using wire or cable, fiber optics, a phone line, a cellular phone link, an RF link or other communication channels.

In this document, the terms "computer program medium" and "computer usable medium" are used to generally refer to media such as removable storage unit 3518, removable storage unit 3522, and a hard disk installed in hard disk drive 3512. Computer program medium and computer usable medium may also refer to memories, such as main memory 3508 and secondary memory 3510, which may be memory semiconductors (for example, DRAMs, etc.).

Computer programs (also called computer control logic) are stored in main memory 3508 and/or secondary memory 3510. Computer programs may also be received via communication interface 3524. Such computer programs, when executed, enable computer system 3500 to implement the embodiments as discussed herein. In particular, the computer programs, when executed, enable processor device 3504 to implement the processes of the embodiments discussed here. Accordingly, such computer programs represent controllers of the computer system 3500. Where the embodiments are implemented using software, the software may be stored in a computer program product and loaded into computer system 3500 using removable storage drive 3514, interface 3520, and hard disk drive 3512, or communication interface 3524.

Embodiments described herein also may be directed to computer program products comprising software stored on any computer useable medium. Such software, when executed in one or more data processing device, causes a data processing device(s) to operate as described herein. Embodiments described herein may employ any computer useable or readable medium. Examples of computer useable mediums include, but are not limited to, primary storage devices (for example, any type of random access memory), secondary storage devices (for example, hard drives, floppy disks, CD ROMS, ZIP disks, tapes, magnetic storage devices, and optical storage devices, MEMS, nanotechnological storage device, etc.).

It is to be appreciated that the Detailed Description section, and not the Summary and Abstract sections, is intended to be used to interpret the claims. The Summary and Abstract sections may set forth one or more but not all exemplary embodiments of the present invention(s) as contemplated by the inventor(s), and thus, are not intended to limit the present invention(s) and the appended claims in any way.

The present invention(s) have been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The foregoing description of the specific embodiments will so fully reveal the general nature of the invention(s) that others can, by applying knowledge within the skill of the art, readily modify and/or adapt for various applications such specific embodiments, without undue experimentation, without departing from the general concept of the present invention(s). Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present invention(s) should not be limited by any of the above-described exemplary embodiments, but should be defined only in accordance with the following claims and their equivalents.

What is claimed is:

1. A method of making an upper for an article of footwear, the method comprising:

winding a first continuous thread around a plurality of anchor points disposed on a support plate to form a first thread pattern, the first continuous thread comprising a plurality of thread lines with each thread line extending between two respective anchor points;

disposing a sheet over the first continuous thread wound around the plurality of anchor points;

winding a second continuous thread over the sheet and around the plurality of anchor points disposed on the support plate to form a second thread pattern, the second continuous thread comprising a plurality of thread lines with each thread line extending between two respective anchor points;

bonding the first thread pattern to the second thread pattern to form an upper material; and removing the sheet.

2. The method of claim 1, further comprising turning the upper material inside-out.

3. The method of claim 1, wherein the first continuous thread and the second continuous thread are portions of a single thread.

4. The method of claim 1, wherein the first continuous thread and the second continuous thread comprise different threads.

5. The method of claim 1, wherein the sheet comprises a polymeric material.

6. The method of claim 1, wherein the sheet comprises a silicone material.

7. The method of claim 1, wherein bonding the first thread pattern to the second thread pattern comprises bonding the first thread pattern to the second thread pattern around a perimeter of the sheet.

8. The method of claim 1, wherein bonding the first thread pattern to the second thread pattern comprises directly bonding the first continuous thread to the second continuous thread.

9. The method of claim 1, further comprising cutting the first thread pattern and the second thread pattern around a perimeter of the sheet.

10. The method of claim 1, further comprising defining an opening in the upper material.

11. The method of claim 10, wherein the sheet is removed through the opening.

12. The method of claim 10, wherein the opening defines at least a portion of a collar for an article of footwear.

13. The method of claim 1, further comprising directly bonding the thread lines of the first thread pattern to each other and directly bonding the thread lines of the second pattern to each other.

14. The method of claim 13, wherein directly bonding the thread lines of the first thread pattern to each other and directly bonding the thread lines of the second thread pattern to each other is performed while the sheet is disposed between the first thread pattern and the second thread pattern.

15. The method of claim 13, wherein directly bonding the thread lines of the first thread pattern to each other and directly bonding the thread lines of the second thread pattern is performed while bonding the first thread pattern to the second thread pattern.

16. A method of making an upper for an article of footwear, the method comprising:

winding a first continuous thread around a plurality of anchor points disposed on a first support plate to form a first thread pattern, the first continuous thread comprising a plurality of thread lines with each thread line extending between two respective anchor points;

winding a second continuous thread around a plurality of anchor points disposed on a second support plate to form a second thread pattern, the second continuous thread comprising a plurality of thread lines with each thread line extending between two respective anchor points;

disposing a sheet between the first thread pattern and the second thread pattern;

bonding the first thread pattern to the second thread pattern while the sheet is disposed between the first thread pattern and the second thread pattern to form an upper material, and removing the sheet.

17. The method of claim 16, further comprising turning the upper material inside-out.

18. The method of claim 16, further comprising directly bonding the thread lines of the first thread pattern to each other and directly bonding the thread lines of the second thread pattern to each other.

19. A method of making an upper for an article of footwear, the method comprising:

winding a first continuous thread around a plurality of anchor points disposed on a support plate to form a first thread pattern, the first continuous thread comprising a plurality of thread lines with each thread line extending between two respective anchor points;

disposing a sheet over the first continuous thread wound around the plurality of anchor points, wherein the sheet comprises a silicone material;

winding a second continuous thread over the sheet and around the plurality of anchor points disposed on the support plate to form a second thread pattern, the second continuous thread comprising a plurality of thread lines with each thread line extending between two respective anchor points; and bonding the first thread pattern to the second thread pattern to form an upper material.

20. A method of making an article of apparel, the method comprising:

winding a first continuous thread around a plurality of anchor points disposed on a support plate to form a first thread pattern, the first continuous thread comprising a plurality of thread lines with each thread line extending between two respective anchor points;

disposing a sheet over the first continuous thread wound around the plurality of anchor points;

winding a second continuous thread around the plurality of anchor points disposed on the support plate to form a second thread pattern, the second continuous thread comprising a plurality of thread lines with each thread line extending between two respective anchor points;

bonding the first thread pattern and the second thread pattern with the sheet disposed between the first thread pattern and the second thread pattern; and removing the sheet.

21. The method of claim 20, wherein the bonding comprises directly bonding the thread lines of the first thread pattern to each other and directly bonding the thread lines of the second pattern to each other.

22. The method of claim 21, wherein directly bonding the thread lines of the first thread pattern to each other and directly bonding the thread lines of the second thread pattern to each other is performed while the sheet is disposed between the first thread pattern and the second thread pattern.

23. The method of claim 20, wherein the sheet comprises a silicone material.

24. The method of claim 20, further comprising, after bonding the first thread pattern, cutting the first thread pattern into a shape for all or a portion of the article of apparel.

* * * * *